US007166422B2

(12) United States Patent
Nakahira et al.

(10) Patent No.: US 7,166,422 B2
(45) Date of Patent: Jan. 23, 2007

(54) SILVER HALIDE COLOR PHOTOGRAPHIC MATERIAL, AND METHOD OF IMAGE FORMATION

(75) Inventors: Shinichi Nakahira, Kanagawa (JP); Shin Soejima, Kanagawa (JP); Hiroyuki Yoneyama, Kanagawa (JP); Naoya Shibata, Kanagawa (JP); Naoto Ohshima, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/151,918

(22) Filed: May 22, 2002

(65) Prior Publication Data

US 2003/0087210 A1 May 8, 2003

(30) Foreign Application Priority Data

May 23, 2001 (JP) ..... 2001-154680
Sep. 27, 2001 (JP) ..... 2001-296318

(51) Int. Cl.
*G03C 1/46* (2006.01)
*G03C 1/06* (2006.01)

(52) U.S. Cl. ..... 430/505; 430/383; 430/384; 430/385; 430/388; 430/583; 430/584; 430/604; 430/963

(58) Field of Classification Search ..... 430/505, 430/583, 584, 963, 567, 383, 388, 384, 385, 430/604, 605
See application file for complete search history.

(56) References Cited

U.S. PATENT DOCUMENTS 5,118,592 A * 6/1992 Hasebe ..... 430/376
5,260,184 A * 11/1993 Marsden et al. ..... 430/398
5,359,080 A * 10/1994 Shimura et al. ..... 548/317.5
5,776,664 A * 7/1998 Yamashita et al. ..... 430/405
6,296,995 B1 * 10/2001 Camp et al. ..... 430/505
2002/0058216 A1 * 5/2002 Nakamura et al. ..... 430/584

FOREIGN PATENT DOCUMENTS

JP 61-282834 12/1986

OTHER PUBLICATIONS

English Abstract of Chinese Patent Publication No. 1025456C (Jan. 15, 1992) Chinese Office Action.

* cited by examiner

*Primary Examiner*—Thorl Chea
(74) *Attorney, Agent, or Firm*—Sughrue Mion, PLLC

(57) ABSTRACT

Provided is a silver halide color photographic material having at least one yellow-coloring photosensitive silver halide emulsion layer, at least one magenta-coloring photosensitive silver halide emulsion layer, at least one cyan-coloring photosensitive silver halide emulsion layer, and at least one non-photosensitive non-coloring hydrophilic colloid layer on a reflective support, wherein, after being color developed, the reflection density A(λ) at a wavelength of λ nm in the non-exposed portion of the material is at most 0.07 at 450 nm, at most 0.09 at 550 nm and at most 0.07 at 650 nm and the mean grain size of the silver halide grains in the yellow-coloring photosensitive silver halide emulsion layer in the material is at most 0.70 μm.

51 Claims, No Drawings

SILVER HALIDE COLOR PHOTOGRAPHIC MATERIAL, AND METHOD OF IMAGE FORMATION

BACKGROUND OF THE INVENTION

1. Field of the Invention

The present invention relates to a silver halide color photographic material, in particular to a silver halide color photographic material of good whiteness. The invention also relates to a method of image formation on the silver halide color photographic material.

2. Description of the Related Art

With the popularization of digital cameras and personal computers in recent years, the frequency of using silver halide photographic materials in printing digital image information thereon is increasing. Image printing materials other than silver halide photographic materials, such as those for inkjet printers are now in wide use for printing digital image information thereon. In order that silver halide photographic materials such as color printing paper are competitive with those printing materials, they are much desired to be more rapidly and stably processed to form high-quality images thereon.

In particular, the recent improvement in the image quality of image printing materials except silver halide photographic materials is remarkable, and it is much desired to further improve the quality of silver halide photographic materials in order that they are competitive over the recent image printing materials. To improve the image quality of silver halide photographic materials, one important factor is to improve couplers to thereby improve the hue of color dyes formed. In addition, it is well known in the art that another important factor is to increase the degree of whiteness of the background area of the photographic materials, or that is, to improve the density and the tone of the non-exposed portion of the materials. If the whiteness of the background area of photographic materials is low, it lowers and worsens the brightness and the tone of the highlight area of the materials, often causing color mixing in the area that contains different color dyes to worsen the images formed. If so, in addition, the image contrast is visually lowered in the area composed of a non-colored part and a colored part. The whiteness is especially important in the background area of photographic materials, such as color paper, on which the images formed are directly seen as they are.

To obtain photographic materials of good whiteness, it is important to prevent silver halides from being fogged, and to specifically plan photographic materials so that the coloring matters such as sensitizing dyes do not remain in the processed photographic materials. To achieve this, various investigations have been made in the art, for example, as in JP-A 6-39936, 6-59421, and 6-202291. In particular, it is important that silver halides in photographic materials are not fogged not only just after the photographic materials are produced but also while the photographic materials produced are stored before being exposed and processed. To prevent photographic materials from being fogged while they are stored, for example, it is known to add an antifogging agent thereto as in JP-A 62-215272; to add catechol or hydroquinones as in JP-A 11-143011; and to add a water-soluble reducing agent of formulae (I) to (III) as in JP-A 11-102045.

Another method known for improving the quality of the white background area of photographic materials is to prevent photographic materials from being stained with the processing solutions used for processing them, or to add to photographic materials some coloring matters complementary to the unnecessary colors therein to thereby control and neutralize the color in the background area of photographic materials.

The quality of color paper just after production is a matter of importance, but the quality stability thereof not changing in time while stored before exposed and processed is also important. In particular, the change in the white background area of color paper is often striking, and this is the most important matter that color paper does not fog during storage.

When processed rapidly, photographic materials are subjected to high-temperature, high-activity treatment and are often fogged, and in addition, sensitizing dyes often remain in them and unfavorably color their background area. Therefore, it is especially desired to improve the quality of the white background area of photographic materials to be processed rapidly.

Given that situation, we, the present inventors have assiduously studied and have found that the emulsions obtained in the prior art mentioned above are still unsatisfactory. In particular, when the photographic materials that have been heretofore proposed, as in the above, are stored for a long time, the blue-sensitive emulsion layers therein are significantly fogged and the yellow density in the background area therein increases.

Through our further studies, it has been found that the yellow density increase in the background area of photographic materials is not expected in the forced heat test which we carried out for estimating the fog level of stored photographic materials, and that the fog density increase in photographic materials exposed to X rays corresponds to the relative correlation to the fog level of yellow, magenta and cyan in the photographic materials actually stored for a long time. From these findings, it is presumed that the yellow density increase in the background area of photographic materials will be caused by exposure to natural radiations and therefore the fog increase could not be evaded by the prior art techniques mentioned above.

In particular, the yellow density increase is remarkable in photographic materials which are designed to lower the density of the white background area thereof so as to control the whiteness of that area to a desired level. In other words, even when the yellow density increase that results from the fog increase in the blue-sensitive emulsion layers is on the same level in different photographic materials, the color change in the white background area of photographic materials of which the whiteness is not increased is not so striking and is on the acceptable level, while, on the other hand, the yellow density increase in photographic materials of which the whiteness has been increased is more striking and, as a result, it lowers the whiteness of the photographic materials. Accordingly, it is desired to develop photographic materials having a desired degree of whiteness not only immediately after their production but also during and after storage thereof.

In addition, it is also desired to develop silver halide color photographic materials of high sensitivity, of which the gradation characteristics are good in that the shoulder contrast is lowered little even when the exposure time for them is short.

SUMMARY OF THE INVENTION

The present invention has been made in consideration of the matters mentioned above, and its object is to provide a silver halide color photographic material of good whiteness in the background. Another object of the invention is to provide a silver halide color photographic material of high sensitivity, of which the shoulder contrast is lowered little, even when the exposure time thereof is short. Still another object of the invention is to provide a silver halide color photographic material having good whiteness not only just after its production but also even after being stored.

Still another object of the invention is to provide a silver halide color photographic material which is stable while stored before being exposed and processed and which can be rapidly processed without interfering with the quality stability thereof, and to provide a method of rapid image formation on the photographic material.

We, the present inventors have assiduously studied, and, as a result, have found that the objects of the invention can be attained by the silver halide color photographic material and the method of image formation thereon mentioned below. The invention is as follows:

<1> A silver halide color photographic material comprising at least one yellow-coloring photosensitive silver halide emulsion layer, at least one magenta-coloring photosensitive silver halide emulsion layer, at least one cyan-coloring photosensitive silver halide emulsion layer, and at least one non-photosensitive non-coloring hydrophilic colloid layer on a reflective support; wherein, after being color developed, the reflection density A(λ) at a wavelength of λ nm in a non-exposed portion of the material is at most 0.07 at 450 nm, at most 0.09 at 550 nm and at most 0.07 at 650 nm, and at least one of the mean grain size of the silver halide grains in the yellow-coloring photosensitive silver halide emulsion layer in the material is at most 0.70 μm; and the material contains at least one color-sensitizing dye represented by the following general formula (I) or (II):

General formula (I)

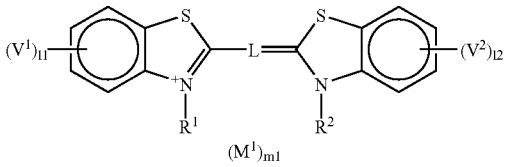

wherein $V^1$ and $V^2$ each independently represent a monovalent substituent, provided that neither $V^1$ nor $V^2$ is an aromatic group and at least two mutually adjacent $V^1$s and mutually adjacent $V^2$s do not bond to each other to form an aromatic or alicyclic ring that forms a condensed ring with a benzene ring, and at least one of $V^1$ and $V^2$ is not a bromine atom; $l_1$ and $l_2$ each independently represent 0, 1, 2, 3 or 4; L represents a methine group; $R^1$ and $R^2$ each independently represent an alkyl group; $M^1$ represents a counter ion; and $m_1$ represents a number of at least 0, which number is necessary to neutralize the charge in the molecule;

General formula (II)

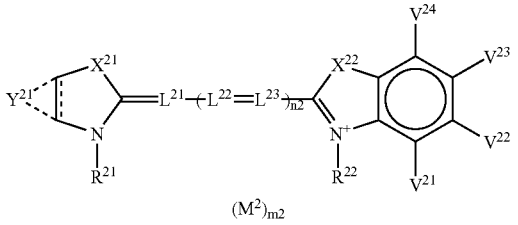

wherein $Y^{21}$ represents an atomic group necessary for forming a pyrrole, furan or thiophene ring, and may be condensed with any other carbon ring or hetero ring and may be substituted; $X^{21}$ and $X^{22}$ each independently represent an oxygen atom, a sulfur atom, a selenium atom or $NR^{23}$; $R^{21}$ $R^{22}$ and $R^{23}$ each independently represent an alkyl group, an aryl group or a heterocyclic group; $V^{21}$, $V^{22}$, $V^{23}$ and $V^{24}$ each independently represent a hydrogen atom or a substituent, provided that two of the substituents $V^{21}$, $V^{22}$, $V^{23}$ and $V^{24}$, which are adjacent to each other, do not bond to each other to form a saturated or unsaturated condensed ring; $L^{21}$, $L^{22}$ and $L^{23}$ each independently represent a methine group; $n_2$ represents 0, 1, 2, 3 or 4; $M^2$ represents a counter ion; and $m_2$ represents a number of at least 0, which number is necessary to neutralize the charge in the molecule.

<2> A silver halide color photographic material comprising at least one yellow-coloring photosensitive silver halide emulsion layer, at least one magenta-coloring photosensitive silver halide emulsion layer, at least one cyan-coloring photosensitive silver halide emulsion layer, and at least one non-photosensitive non-coloring hydrophilic colloid layer on a reflective support; wherein the chromaticity in the non-exposed portion of the material satisfies, after being color developed, the following condition [A], and the mean grain size of the silver halide grains in the yellow-coloring photosensitive silver halide emulsion layer in the material is at most 0.70 μm; or the material contains at least one color-sensitizing dye represented by the following general formula (I) or (II):

Condition [A]

$$91 \leqq L^* \leqq 96,\ 0.3 \leqq a^* \leqq 1.6,\ -8.0 \leqq b^* \leqq -4.8;$$

General formula (I)

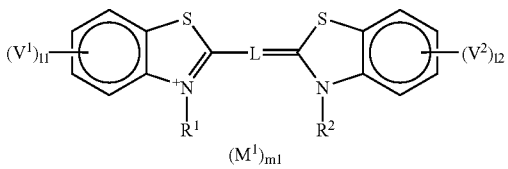

wherein $V^1$ and $V^2$ each independently represent a monovalent substituent, provided that neither $V^1$ nor $V^2$ is an aromatic group and at least two mutually adjacent $V^1$s and mutually adjacent $V^2$s do not bond to each other to form an aromatic or alicyclic ring that forms a condensed ring with a benzene ring, and at least one of $V^1$ and $V^2$ is not a bromine atom; $l_1$ and $l_2$ each independently represent 0, 1, 2, 3 or 4; L represents a methine group; $R^1$ and $R^2$ each independently represent an alkyl group; $M^1$ represents a counter ion; and $m_1$ represents a number of at least 0, which number is necessary to neutralize the charge in the molecule;

General formula (II)

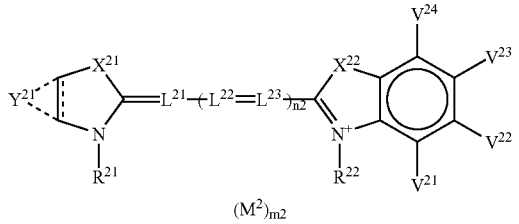

wherein $Y^{21}$ represents an atomic group necessary for forming a pyrrole, furan or thiophene ring, and may be condensed with any other carbon ring or hetero ring and may be substituted; $X^{21}$ and $X^{22}$ each independently represent an oxygen atom, a sulfur atom, a selenium atom or $NR^{23}$; $R^{21}$, $R^{22}$ and $R^{23}$ each independently represent an alkyl group, an aryl group or a heterocyclic group; $V^{21}$, $V^{22}$, $V^{23}$ and $V^{24}$ each independently represent a hydrogen atom or a substituent, provided that two of the substituents $V^{21}$, $V^{22}$, $V^{23}$ and $V^{24}$, which are adjacent to each other, do not bond to each other to form a saturated or unsaturated condensed ring; $L^{21}$, $L^{22}$ and $L^{23}$ each independently represent a methine group; $n_2$ represents 0, 1, 2, 3 or 4; $M^2$ represents a counter ion; and $m_2$ represents a number of at least 0, which number is necessary to neutralize the charge in the molecule.

<A-1> A silver halide color photographic material comprising at least one yellow-coloring photosensitive silver halide emulsion layer, at least one magenta-coloring photosensitive silver halide emulsion layer, at least one cyan-coloring photosensitive silver halide emulsion layer, and at least one non-photosensitive non-coloring hydrophilic colloid layer on a reflective support; wherein, after being color developed, the reflection density A(λ) at a wavelength of λ nm in the non-exposed portion of the material is at most 0.07 at 450 nm, at most 0.09 at 550 nm and at most 0.07 at 650 nm and the mean grain size of the silver halide grains in the yellow-coloring photosensitive silver halide emulsion layer in the material is at most 0.70 μm.

<A-2> The silver halide color photographic material of above <A-1>, wherein, after being color developed, the reflection density A(λ) at a wavelength of λ nm in the non-exposed portion is at most 0.06 at 450 nm, at most 0.07 at 550 nm and at most 0.05 at 650 nm.

<A-3> The silver halide color photographic material of above <A-1> or <A-2>, wherein, after being color developed, the density ratio of the reflection density A(λ) at a wavelength of λ nm in the non-exposed portion satisfies the following conditions (I) and (II):

$$1.0 \leqq A(550)/A(450) \leqq 1.4 \quad \text{(I)}$$

$$0.6 \leqq A(650)/A(450) \leqq 1.2. \quad \text{(II)}$$

<A-4> A silver halide color photographic material comprising at least one yellow-coloring photosensitive silver halide emulsion layer, at least one magenta-coloring photosensitive silver halide emulsion layer, at least one cyan-coloring photosensitive silver halide emulsion layer, and at least one non-photosensitive non-coloring hydrophilic colloid layer on a reflective support; wherein the chromaticity in the non-exposed portion of the material satisfies, after being color developed, the following condition [A] and the mean grain size of the silver halide grains in the yellow-coloring photosensitive silver halide emulsion layer in the material is at most 0.70 μm:

Condition [A]

$$91 \leqq L^* \leqq 96,\ 0.3 \leqq a^* \leqq 1.6,\ -8.0 \leqq b^* \leqq -4.8.$$

<A-5> The silver halide color photographic material of above <A-4>, wherein the chromaticity in the non-exposed portion satisfies, after being color developed, the following condition [B]

Condition [B]

$$93 \leqq L^* \leqq 96,\ 0.3 \leqq a^* \leqq 1.6,\ -8.0 \leqq b^* \leqq -4.8.$$

<A-6> A silver halide color photographic material comprising at least one yellow-coloring photosensitive silver halide emulsion layer, at least one magenta-coloring photosensitive silver halide emulsion layer, at least one cyan-coloring photosensitive silver halide emulsion layer, and at least one non-photosensitive non-coloring hydrophilic colloid layer on a reflective support; wherein, after being exposed to light to which the yellow-coloring photosensitive silver halide emulsion layer is sensitive, and then color developed, the yellow reflection density of the material satisfies the relation of the following formula and the mean grain size of the silver halide grains in the yellow-coloring photosensitive silver halide emulsion layer in the material is at most 0.70 μm:

$$DS_{0.1} - DS_{0.0001} \leqq 0.3$$

wherein $DS_{0.1}$ indicates the yellow reflection density of the material exposed to light to which the yellow-coloring photosensitive silver halide emulsion is sensitive and of which an intensity of illumination for exposure is larger by 0.5 log E than an intensity of illumination necessary for obtaining an yellow reflection density of 0.7 when the material is exposed to the light for a period of 0.1 seconds and then color developed; and $DS_{0.0001}$ indicates the yellow reflection density of the material exposed to light, to which the yellow-coloring photosensitive silver halide emulsion is sensitive and of which the intensity of illumination for exposure is larger by 0.5 log E than an intensity of illumination necessary for obtaining an yellow reflection density of 0.7 when the material is exposed to the light for a period of 0.0001 seconds and then color developed.

<A-7> The silver halide color photographic material of above <A-6>, wherein, after being color developed, the reflection density A(λ) at a wavelength of λ nm in the non-exposed portion is at most 0.07 at 450 nm, at most 0.09 at 550 nm and at most 0.07 at 650 nm.

<A-8> The silver halide color photographic material of any one of above <A-1> to <A-7>, wherein the mean grain size of the silver halide grains in the yellow-coloring photosensitive silver halide emulsion layer is at most 0.65 μm.

<A-9> The silver halide color photographic material of any one of above <A-1> to <A-7>, wherein the mean grain size of the silver halide grains in the yellow-coloring photosensitive silver halide emulsion layer is at most 0.58 μm.

<A-10> The silver halide color photographic material of any one of above <A-1> to <A-7>, wherein the mean grain size of the silver halide grains in the yellow-coloring photosensitive silver halide emulsion layer is at most 0.48 μm.

<A-11> The silver halide color photographic material of any one of above <A-1> to <A-10>, wherein the amount of silver in the yellow-coloring photosensitive silver halide emulsion layer is from 0.1 g/m$^2$ to 0.23 g/m$^2$.

<A-12> The silver halide color photographic material of any one of above <A-1> to <A-10>, wherein the amount of silver in the yellow-coloring photosensitive silver halide emulsion layer is from 0.1 g/m$^2$ to 0.19 g/m$^2$.

<A-13> The silver halide color photographic material of any one of above <A-1> to <A-12>, wherein the silver halide grains in the yellow-coloring photosensitive silver halide emulsion layer contain at least one metal complex of the following general formula (CI) and have a silver chloride content of at least 90 mol %:

$$[IrX^{I}_{n}L^{I}_{(6-n)}]^{m-} \quad \text{(CI)}$$

in which $X^{I}$ represents a halide ion or a pseudo-halide ion, which is not a cyanate ion; $L^{I}$ represents a ligand, differing from $X^{I}$; n represents 3, 4 or 5, and m represents an integer of from −4 to +1; from 3 to 5 $X^{I}$'s may be the same or different; and two or more $L^{I}$'s, if any, may be the same or different.

<A-14> The silver halide color photographic material of any one of above <A-1> to <A-12>, wherein the silver halide grains in the yellow-coloring photosensitive silver halide emulsion layer contain at least one metal complex of the following general formula (CIA) and have a silver chloride content of at least 90 mol %:

$$[IrX^{IA}_{n}L^{IA}_{(6-n)}]^{m-} \quad \text{(CIA)}$$

in which $X^{IA}$ represents a halide ion or a pseudo-halide ion, which is not a cyanate ion; $L^{IA}$ represents an inorganic ligand, differing from $X^{IA}$; n represents 3, 4 or 5, and m represents an integer of from −4 to +1; from 3 to 5 $X^{IA}$'S may be the same or different; and two or more $L^{IA}$'s, if any, may be the same or different.

<A-15> The silver halide color photographic material of any one of above <A-7> to <A-12>, wherein the silver halide grains in the yellow-coloring photosensitive silver halide emulsion layer contain at least one metal complex of the following general formula (CIB) and have a silver chloride content of at least 90 mol %:

$$[IrX^{IB}_{n}L^{IB}_{(6-n)}]^{m-} \quad \text{(CIB)}$$

in which $X^{IB}$ represents a halide ion or a pseudo-halide ion, which is not a cyanate ion; $L^{IB}$ represents a ligand having a linear or cyclic hydrocarbon skeleton structure of which a part of the carbon or hydrogen atoms may be substituted with any other atom or atomic group; n represents 3, 4 or 5, and m represents an integer of from −4 to +1; from 3 to 5 $X^{IB}$'s may be the same or different; and two or more $L^{IB}$'s, if any, may be the same or different.

<A-16> The silver halide color photographic material of any one of above <A-1> to <A-12>, wherein the silver halide grains in the yellow-coloring photosensitive silver halide emulsion layer contain at least one metal complex of the following general formula (CIC) and have a silver chloride content of at least 90 mol %:

$$[IrX^{IC}_{n}L^{IC}_{(6-n)}]^{m-} \quad \text{(CIC)}$$

in which $X^{IC}$ represents a halide ion or a pseudo-halide ion, which is not a thiocyanate ion; $L^{IC}$ represents a 5-membered ring ligand having at least one nitrogen atom and at least one sulfur atom in its ring skeleton, which may be optionally substituted on the carbon atoms that constitute the ring skeleton; n represents 3, 4 or 5, and m represents an integer of from −4 to +1; from 3 to 5 $X^{IC}$'s may be the same or different; and two or more $L^{IC}$'s, if any, may be the same or different.

<A-17> The silver halide color photographic material of any one of above <A-1> to <A-16>, wherein the silver halide grains in the yellow-coloring photosensitive silver halide emulsion layer contain at least one metal complex of the following general formula (CII) and have a silver chloride content of at least 90 mol %:

$$[MX^{II}_{n}L^{II}_{(6-n)}]^{m-} \quad \text{(CII)}$$

in which M represents Cr, Mo, Re, Fe, Ru, Os, Co, Rh, Pd or Pt; $X^{II}$ represents a halide ion; $L^{II}$ represents a ligand, differing from $X^{II}$; n represents 3, 4, 5 or 6, and m represents an integer of from −4 to +1; from 3 to 6 $X^{II}$'s may be the same or different; and two or more $L^{II}$'s, if any, may be the same or different.

<A-18> The silver halide color photographic material of any one of above <A-1> to <A-16>, wherein the silver halide grains in the yellow-coloring photosensitive silver halide emulsion layer contain at least one metal complex of the following general formula (CIIA) and have a silver chloride content of at least 90 mol %:

$$[M^{IIA}X^{IIA}_{n}L^{IIA}_{(6-n)}]^{m-} \quad \text{(CIIA)}$$

in which $M^{IIA}$ represents Re, Ru, Os or Rh; $X^{IIA}$ represents a halide ion; $L^{IIA}$ represents NO or NS when $M^{IIA}$ is Re, Ru or Os, and represents $H_2O$, OH or O when $M^{IIA}$ is Rh; n represents 3, 4, 5 or 6, and m represents an integer of from −4 to +1; from 3 to 6 $X^{IIA}$'s may be the same or different; and two or more $L^{IIA}$'s, if any, may be the same or different.

<A-19> A method of image formation on the silver halide color photographic material of anyone of above <A-1> to <A-18>, wherein the total processing time from the start of color development to the end of drying is at most 90 seconds.

<B-1> A silver halide color photographic material comprising at least one yellow-coloring photosensitive silver halide emulsion layer, at least one magenta-coloring photosensitive silver halide emulsion layer, at least one cyan-coloring photosensitive silver halide emulsion layer, and at least one non-photosensitive non-coloring hydrophilic colloid layer on a reflective support; wherein, after being color developed, the reflection density A(λ) at a wavelength of λ nm in the non-exposed portion of the material is at most 0.07 at 450 nm, at most 0.09 at 550 nm and at most 0.07 at 650 nm, and the material contains at least one color-sensitizing dye of formula (I) stated in above <1>.

<B-2> A silver halide color photographic material comprising at least one yellow-coloring photosensitive silver halide emulsion layer, at least one magenta-coloring photosensitive silver halide emulsion layer, at least one cyan-coloring photosensitive silver halide emulsion layer, and at least one non-photosensitive non-coloring hydrophilic colloid layer on a reflective support; wherein, after being color developed, the reflection density A(λ) at a wavelength of λ nm in the non-exposed portion of the material is at most 0.07 at 450 nm, at most 0.09 at 550 nm and at most 0.07 at 650 nm, and the material contains at least one color-sensitizing dye of formula (II) stated in above <1>.

<B-3> The silver halide color photographic material of above <B-l>or <B-2>, wherein the reflection density A (λ) at a wavelength of λ nm in the non-exposed portion is, after being color developed, at most 0.06 at 450 nm, at most 0.07 at 550 nm and at most 0.05 at 650 nm.

<B-4> The silver halide color photographic material of any one of above <B-1> to <B-3>, wherein the ratio of the reflection density A(λ) at a wavelength of λ nm in the non-exposed portion, after being color developed, satisfies the following conditions (I) and (II):

$$1.0 \leqq A(550)/A(450) \leqq 1.4 \quad \text{(I)}$$

$$0.6 \leqq A(650)/A(450) \leqq 1.2. \quad \text{(II)}$$

<B-5> A silver halide color photographic material comprising at least one yellow-coloring photosensitive silver halide emulsion layer, at least one magenta-coloring photosensitive silver halide emulsion layer, at least one cyan-coloring photosensitive silver halide emulsion layer, and at least one non-photosensitive non-coloring hydrophilic colloid layer on a reflective support; wherein the chromaticity in the non-exposed portion of the material satisfies, after being color developed, the following condition [A] and the material contains at least one color-sensitizing dye of formula (I) stated in above <1>:

Condition [A]

$$91 \leqq L^* \leqq 96,\ 0.3 \leqq a^* \leqq 1.6,\ -8.0 \leqq b^* \leqq -4.8.$$

<B-6> A silver halide color photographic material comprising at least one yellow-coloring photosensitive silver halide emulsion layer, at least one magenta-coloring photosensitive silver halide emulsion layer, at least one cyan-coloring photosensitive silver halide emulsion layer, and at least one non-photosensitive non-coloring hydrophilic colloid layer on a reflective support; wherein the chromaticity in the non-exposed portion of the material satisfies, after being color developed, the following condition [A] and the material contains at least one color-sensitizing dye of formula (II) stated in above <1>: Condition [A]

$$91 \leqq L^* \leqq 96,\ 0.3 \leqq a^* \leqq 1.6,\ -8.0 \leqq b^* \leqq -4.8.$$

<B-7> The silver halide color photographic material of above <B-5> or <B-6>, wherein the chromaticity in the non-exposed portion satisfies, after being color developed, the following condition [B]:

Condition [B]

$$93 \leqq L^* \leqq 96,\ 0.3 \leqq a^* \leqq 1.6,\ -8.0 \leqq b^* \leqq -4.8.$$

<B-8> A method of image formation on the silver halide color photographic material of any one of above <B-1> to <B-7>, wherein the total processing time from the start of color development to the end of drying is at most 90 seconds.

DETAILED DESCRIPTION OF THE PREFERRED EMBODIMENTS

The silver halide color photographic material of the invention is described in detail.

The silver halide color photographic material of the invention has, on a reflective support, at least one yellow-coloring photosensitive silver halide emulsion layer, at least one magenta-coloring photosensitive silver halide emulsion layer and at least one cyan-coloring photosensitive silver halide emulsion layer and has thereon at least one non-photosensitive non-coloring hydrophilic colloid layer; and in the silver halide color photographic material, the mean grain size of the silver halide grains in the yellow-coloring photosensitive silver halide emulsion layer is at most 0.70 μm, or the material contains at least one color-sensitizing dye selected from those of formulae (I) and (II) mentioned hereinafter.

The silver halide color photographic material satisfies at least one matter that (1) the reflection density A(λ) at a wavelength of λ nm in the non-exposed portion of the material is, after being color developed, at most 0.07 at 450 nm, at most 0.09 at 550 nm and at most 0.07 at 650 nm, (2) the chromaticity in the non-exposed portion of the material is, after being color developed, $91 \leqq L^* \leqq 96$, $0.3 \leqq a^* \leqq 1.6$, and $-8.0 \leqq b^* \leqq -4.8$, or (3) the yellow reflection density of the material satisfies the relation of a formula $DS_{0.1}-DS_{0.0001} \leqq 0.3$ (in which $DS_{0.1}$ and $DS_{0.0001}$ are described hereinafter), after being exposed to light to which the yellow-coloring photosensitive silver halide emulsion layer is sensitive, and then being color developed.

The silver halide color photographic material of the invention is described in more detail.

The first aspect of the silver halide color photographic material of the invention (hereinafter this may be referred to as "the first aspect"), which has, on a reflective support, at least one yellow-coloring photosensitive silver halide emulsion layer, at least one magenta-coloring photosensitive silver halide emulsion layer and at least one cyan-coloring photosensitive silver halide emulsion layer and has thereon at least one non-photosensitive non-coloring hydrophilic colloid layer, wherein the reflection density A(λ) at a wavelength of λ nm in the non-exposed portion of the material is, after being color developed, at most 0.07 at 450 nm, at most 0.09 at 550 nm and at most 0.07 at 650 nm and the mean grain size of the silver halide grains in the yellow-coloring photosensitive silver halide emulsion layer in the material is at most 0.70 μm.

The second aspect of the silver halide color photographic material of the invention (hereinafter this may be referred to as "the second aspect"), which has, on a reflective support, at least one yellow-coloring photosensitive silver halide emulsion layer, at least one magenta-coloring photosensitive silver halide emulsion layer and at least one cyan-coloring photosensitive silver halide emulsion layer and has thereon at least one non-photosensitive non-coloring hydrophilic colloid layer, wherein the chromaticity in the non-exposed portion of the material satisfies, after being color developed, the following condition [A] and the mean grain size of the silver halide grains in the yellow-coloring photosensitive silver halide emulsion layer in the material is at most 0.70 μm:

Condition [A]

$$91 \leqq L^* \leqq 96,\ 0.3 \leqq a^* \leqq 1.6,\ -8.0 \leqq b^* \leqq -4.8.$$

The third aspect of the silver halide color photographic material of the invention (hereinafter this may be referred to as "the third aspect"), which has, on a reflective support, at least one yellow-coloring photosensitive silver halide emulsion layer, at least one magenta-coloring photosensitive silver halide emulsion layer and at least one cyan-coloring photosensitive silver halide emulsion layer and has thereon at least one non-photosensitive non-coloring hydrophilic colloid layer, wherein the reflection density A(λ) at a wavelength of λ nm in the non-exposed portion of the material is, after being color developed, at most 0.07 at 450 nm, at most 0.09 at 550 nm and at most 0.07 at 650 nm and the material contains at least one color-sensitizing dye selected from those of formulae (I) and (II).

In the first to third aspects, the reflection density A(λ) at a wavelength of λ nm in the non-exposed portion of the color-developed material (hereinafter this may be referred to as "reflection density A(λ)") preferably satisfies the conditions mentioned below.

The reflection density A(λ) at 450 nm (hereinafter this may be referred to as "A(450)") is preferably at most 0.06, most preferably at most 0.05. The reflection density A(λ) at 550 nm (hereinafter this may be referred to as "A(550)") is preferably at most 0.07. The reflection density A(λ) at 650 nm (hereinafter this may be referred to as "A(650)") is preferably at most 0.05. It is preferable that the value A(λ) is smaller. However, when the support of the photographic material is a paper support coated with a white pigment-containing polyethylene resin, A(450), A(550) and A(650) are all substantially at least 0.01.

Regarding its appearance, the silver halide color photographic material of the first to third aspects of the invention that looks "white" to humans varies depending on the color balance thereof, for which, therefore, there exist favorable conditions for the density ratio of the reflection density A(λ). Preferably, $1.0 \leqq A(550)/A(450) \leqq 1.4$ and $0.6 \leqq A(650)/A(450) \leqq 1.2$; more preferably, $1.1 \leqq A(550)/A(450) \leqq 1.3$ and $0.6 \leqq A(650)/A(450) \leqq 1.2$; even more preferably, $1.1 \leqq A(550)/A(450) \leqq 1.2$ and $0.8 \leqq A(650)/A(450) \leqq 1.1$.

Regarding its details, the reflection density A(λ) at a wavelength λ in the non-exposed portion of the color-developed material is herein defined as follows:

The reflection density A(λ) is the reflection absorbance of the color-developed material measured at a temperature of 25° C. and a humidity of 60% RH through a slit of 5 nm wide at an integrating sphere aperture ratio of 2% in the site of the material in which the specular light thereon is excluded. One typical example of the reflection-absorption spectrophotometer to be used for the measurement is Hitachi's U-3410 Model Spectrophotometer.

The fourth aspect of the silver halide color photographic material of the invention (hereinafter this may be referred to as "the fourth aspect"), which has, on a reflective support, at least one yellow-coloring photosensitive silver halide emulsion layer, at least one magenta-coloring photosensitive silver halide emulsion layer and at least one cyan-coloring photosensitive silver halide emulsion layer and has thereon at least one non-photosensitive non-coloring hydrophilic colloid layer, wherein the chromaticity in the non-exposed portion of the material satisfies, after being color developed, the following condition [A] and the material contains at least one color-sensitizing dye selected from those of formulae (I) and (II):

Condition [A]

$$91 \leqq L^* \leqq 96,\ 0.3 \leqq a^* \leqq 1.6,\ -8.0 \leqq b^* \leqq -4.8.$$

In the invention, the chromaticity in the non-exposed portion (white background area) of the color-developed material preferably satisfies the condition mentioned below, expressed on the CIE1976L*a*b* color space (hereinafter this may be referred to as CIELAB color space).

L* is from 91 to 96, more preferably from 92 to 96, most preferably from 93 to 96. a* is preferably from 0.3 to 1.6, preferably from 0.5 to 1.3. b* is from −8.0 to −4.8, preferably from −8.0 to −4.0.

Accordingly, the chromaticity in the non-exposed portion (white background area) of the silver halide color photographic material of the invention preferably satisfies, after being color developed, the following condition [A], more preferably the following condition [B] on the CIELAB color space.

Condition [A]

$$91 \leqq L^* \leqq 96,\ 0.3 \leqq a^* \leqq 1.6,\ -8.0 \leqq b^* \leqq -4.8.$$

Condition [B]

$$93 \leqq L^* \leqq 96,\ 0.3 \leqq a^* \leqq 1.6,\ -8.0 < b^* \leqq -4.8.$$

The CIE1976L*a*b* color space is described in detail on page 354 of *Fine Imaging and Color Hard Copies* (edited by the Photographic Society of Japan and the Imaging Society of Japan, published by Corona Publishing in 1999). The tristimulus values on the color space are obtained according to the method described in JIS Z8717 that defines the measurement of tristimulus values of fluorescent reflective substance in chromaticity coordinates X, Y, Z. The chromaticity on the CIE1976L*a*b* color space (hereinafter this is referred to as CIELAB color space) is based on the international chromaticity standard CIED65 (6504K) that indicates the standard chromaticity of white of standard daylight.

Accordingly, for identifying the photographic material of the invention that satisfies the condition [A] or [B], any calorimeter capable of measuring the chromaticity on the CIE1976L*a*b* color space can be used. For example, Hitachi's C-2000 Color Analyzer can be used, in which the standard light source is CIED65 (6504K).

The fifth aspect of the silver halide color photographic material of the invention (hereinafter this may be referred to as "the fifth aspect"), which has, on a reflective support, at least one yellow-coloring photosensitive silver halide emulsion layer, at least one magenta-coloring photosensitive silver halide emulsion layer and at least one cyan-coloring photosensitive silver halide emulsion layer and has thereon at least one non-photosensitive non-coloring hydrophilic colloid layer, wherein its yellow reflection density satisfies the relation of the following formula, after being exposed to light to which the yellow-coloring photosensitive silver halide emulsion layer is sensitive, and then being color developed, and the mean grain size of the silver halide grains in the yellow-coloring photosensitive silver halide emulsion layer in the material is at most 0.70 μm:

$$DS_{0.1} - DS_{0.0001} \leqq 0.3$$

in which $DS_{0.1}$ indicates the yellow reflection density of the material exposed to light to which the yellow-coloring photosensitive silver halide emulsion is sensitive and of which the intensity of illumination for exposure is larger by 0.5 log E than that necessary for obtaining an yellow reflection density of 0.7 when the material is exposed to the light for a period of 0.1 seconds and then being color developed; and $DS_{0.0001}$ indicates the yellow reflection density of the material exposed to light to which the yellow-coloring photosensitive silver halide emulsion is sensitive and of which the intensity of illumination for exposure is larger by 0.5 log E than that necessary for obtaining an yellow reflection density of 0.7 when the material is exposed to the light for a period of 0.0001 seconds and then being color developed.

In the first to fifth aspects of the invention (hereinafter these may be referred to as "the invention" as combined), the method for controlling the background area of the photographic material to fall within the preferred range as above includes two modes. One is to control the degree of whiteness of the support of the photographic material; and the other is to control the hydrophilic colloid layer that forms the photographic constituent layer in the photographic material.

Reflective Substrate:

The reflective support preferred for use in the invention is described in detail below.

Preferably, the reflective support for the photographic material of the invention is coated with a white pigment-containing waterproof resin layer on the side thereof coated with photosensitive layers. The white pigment to be mixed and dispersed in the waterproof resin includes, for example, inorganic pigments such as titanium dioxide, barium sulfate, lithopone, aluminium oxide, calcium carbonate, silicon oxide, antimony trioxide, titanium phosphate, zinc oxide, white lead, zirconium oxide; and organic fine powder of polystyrene, styrene-divinylbenzene copolymer, etc. Of those pigments, titanium dioxide is especially effective. Titanium dioxide may be any of a rutile or anatase type. For higher background whiteness, anatase titanium dioxide is preferred; but for better image sharpness, rutile titanium dioxide is preferred. For higher background whiteness and better image sharpness, anatase and rutile titanium dioxides may be blended. In case where the waterproof resin layer has a multi-layered structure, it is preferable that anatase titanium dioxide is in some layers of the multi-layered structure while rutile titanium dioxide is in the others. These titanium dioxides may be prepared in any method from sulfates or chlorides.

The waterproof resin for the reflective support for use in the invention has a water absorption (% by weight) of at most 0.5, preferably at most 0.1, including, for example, polyolefins such as polyethylene, polypropylene, polyethylenic polymers; vinyl polymers and copolymers (polystyrene, polyacrylates and their copolymers); and polyesters (polyethylene terephthalate, polyethylene isophthalate) and their copolymers. Polyethylene and polyesters are especially preferred. Polyethylene for use herein includes high-density polyethylene, low-density polyethylene, linear low-density polyethylene and their mixtures.

Polyesters for use herein are preferably produced through polycondensation of dicarboxylic acids and diols. Preferred examples of the dicarboxylic acids are terephthalic acid, isophthalic acid, and naphthalenedicarboxylic acid. Preferred examples of the diols are ethylene glycol, butylene glycol, neopentyl glycol, triethylene glycol, butanediol, hexylene glycol, bisphenol A-ethylene oxide adduct (2,2-bis(4-(2-hydroxyethyloxy)phenyl)propane), and 1,4-dihydroxymethylcyclohexane. Various types of polyesters obtained through polycondensation of one or more such dicarboxylic acids with one or more such diols are usable herein. Preferably, at least one dicarboxylic acid for polycondensation is terephthalic acid.

The blend ratio by weight of the waterproof resin to the white pigment may fall between 98/2 and 30/70 (waterproof resin/white pigment), preferably between 95/5 and 50/50, more preferably between 90/10 and 60/40. Preferably, the thickness of the waterproof resin layer to coat the support is from 2 to 200 μm, more preferably from 5 to 80 μm. The thickness of the resin or the resin composition to coat the back surface of the support not to be coated with photosensitive layers is preferably from 5 to 100 μm, more preferably from 10 to 50 μm.

It is often preferable that the reflective support is coated with a multi-layered waterproof resin layer of two or more layers that differ in the white pigment content thereof, on the surface thereof to be coated with photosensitive layers, in view of the production costs and of the productivity of the support. In this case where the waterproof resin layer to coat the support has a multi-layered structure of two or more layers that differ in the white pigment content thereof, it is preferable that the white pigment content of the waterproof resin layer nearest to the support is lower than that of at least one other layer above the layer nearest to the support.

The white pigment content of each layer of the multi-layered waterproof resin layer may be from 0 to 70% by weight, preferably from 0 to 50% by weight, more preferably from 0 to 40% by weight. Of the multi-layered waterproof resin layer, the highest white pigment content of the layer may be from 9 to 70% by weight, preferably from 15 to 50% by weight, more preferably from 20 to 40% by weight.

If desired, the waterproof resin layer may contain a blueing agent capable of controlling the whiteness of the white background area of the photographic material of the invention to fall within the desired range. The blueing agent may be any known one, including, for example, ultramarine, cobalt blue, cobalt oxyphosphate, quinacridone pigments, and their mixtures. The grain size of the blueing agent is not specifically defined, generally falling between 0.3 μm and 10 μm. Having a grain size that falls within the range, the blueing agent is employable herein with no problem. In case where the waterproof resin layer to coat the reflective support for use in the invention has a multi-layered structure, it is preferable that the blueing agent content of the uppermost waterproof resin layer is higher than that of the other lower layers. Preferably, the blueing agent content of the uppermost layer is from 0.2 to 0.5% by weight and that of the lower layers is from 0 to 0.45% by weight.

The substrate of the reflective support for use in the invention may be any of natural pulp paper of essentially natural pulp; composite paper of natural pulp and synthetic fiber; synthetic fiber paper of essentially synthetic fiber; synthetic pseudo-paper of synthetic resin film of, for example, polystyrene or polypropylene; or plastic film such as polyester film of, for example, polyethylene terephthalate or polybutylene terephthalate, cellulose triacetate film, polystyrene film or polyolefin film such as polypropylene film. For the substrate of the photographic support to be coated with waterproof resin, natural pulp paper (hereinafter this is referred to as base paper) is especially advantageous. If desired, dye or fluorescent dye may be added to the substrate so as to control the whiteness of the white background area of the photographic material to fall within the desired range as in the invention.

The thickness of the base paper for the support for use in the invention is not specifically defined. Preferably, the unit weight of the base paper is from 50 g/m$^2$ to 250 g/m$^2$; and the thickness thereof is from 50 μm to 250 μm.

More preferably, the reflective support for use in the invention has a polyolefin layer having micropores on the surface of the paper substrate to be coated with silver halide emulsion layers. The polyolefin layer may have a multi-layered structure. In case where the polyolefin layer to coat the substrate has a multi-layered structure, it is more preferable that the polyolefin layer adjacent to the gelatin layer on the side to be coated with silver halide emulsion layers is not porous (for example, it is a non-porous polypropylene or polyethylene layer) and the other layers nearer to the paper substrate are porous polyolefin layers (for example, they are porous polypropylene or polyethylene layers). Preferably, the density of one or more these polyolefin layers existing between the paper substrate and the photographic constitutive layers is from 0.40 to 1.0 g/ml, more preferably from 0.50 to 0.70 g/ml. Also preferably, the thickness of one or more these polyolefin layers existing between the paper substrate and the photographic constitutive layers is from 10 to 100 μm, more preferably from 15 to 70 μm. Also preferably, the ratio of the thickness of the polyolefin layer to that of the paper substrate falls between 0.05 and 0.2, more preferably between 0.1 and 0.15.

It is also preferable to provide a polyolefin layer on the side (back surface) of the paper substrate opposite to that to be coated with photographic constitutive layers, for the purpose of increasing the toughness of the reflective support. In this case, it is preferable that the polyolefin layer to be on the back surface of the paper substrate is a matted layer of polyethylene or polypropylene, more preferably polypropylene. Preferably, the thickness of the polyolefin layer on the back surface is from 5 to 50 μm, more preferably from 10 to 30 μm; and also preferably, the density of the layer is from 0.7 to 1.1 g/ml. Preferred examples of the polyolefin layer to be formed on the paper substrate for the reflective support for use in the invention are described in JP-A 10-333277, 10-333278, 11-52513, 11-65024, and EP 0880065, 0880066.

Also preferably, the waterproof resin layer contains a fluorescent brightener. If desired, an additional hydrophilic layer that contains a fluorescent brightener dispersed therein may be formed on the support of the photographic material. For the fluorescent brightener, preferred are benzoxazole compounds, coumarin compounds, and pyrazoline compounds; and more preferred are benzoxazolylnaphthalene compounds and benzoxazolylstilbene compounds. The amount of the fluorescent brightener to be in the layer is not specifically defined, preferably from 1 to 100 mg/m$^2$. In case where the fluorescent brightener is mixed with waterproof resin to be in the resin layer, its amount is preferably from 0.0005 to 3% by weight, more preferably from 0.001 to 0.5% by weight of the resin.

The reflective support may be a transmission support, or may be the above-mentioned reflective support coated with a white pigment-containing hydrophilic colloid layer. The reflective support may also have a metallic surface of mirror reflectivity or type-II diffusive reflectivity.

The method of controlling the whiteness in the white background area of the photographic material by specifically planning the hydrophilic colloid layers to form the photographic constitutive layers on the support is described in detail.

The factors that result from the photographic constitutive layers to lower the whiteness in the white background area of the photographic material are fogging of the silver halide emulsions in the material, retention of sensitizing dyes therein, and adsorption of fatigued processing solutions by the processed photographic material. If the factors are removed, the photographic material can have the whiteness intrinsic to the support thereof. In addition, if the photographic material is specifically so planned that it contains some dye or pigment which is not discolored while it is processed, and is colored by the dye or pigment added thereto, or contains a fluorescent brightener that may remain still in the processed photographic material, the whiteness in the white background area of photographic material can be controlled to fall within the desired range in the invention.

Pigment:

The pigment that is preferably used for coloring the hydrophilic colloid layers of the photographic constitutive layers in the invention is described. In the silver halide photographic material of the invention, at least one of the photosensitive silver halide emulsion layers and non-photosensitive layers formed on the reflective support preferably contains at least one pigment dispersed therein. In the photographic material of the invention, the pigment-containing layer may be the silver halide emulsion-containing layer, or may also be the non-photosensitive layer such as the interlayer existing between the silver halide emulsion layers, or the UV absorbent layer existing above the silver halide emulsion layers, or the gelatin subbing layer. In general, the coating flow rate for the silver halide emulsion layers is varied for controlling the characteristic curve of the photographic material. Therefore, in order that the photographic material may be tinted constantly, the tinting pigment is preferably introduced into the non-photosensitive layers in most cases.

In general, the photographic material is blued for overcoming yellow stains. For blueing it, in general, a satisfactory amount of a blueing pigment that may overcome yellow stains is added to the photographic material. The blueing pigment in the photographic material gives a neutral color, and seemingly the photographic material containing it looks white. In addition, when two or more different types of pigments are added to the photographic material and the blend ratio of the pigments is varied therein, then the photographic material may be free from yellow stains in a broad range. In general, a cyan-shift blue pigment is combined with a magenta-shift red or violet pigment. The pigment combination makes it possible to control the color of the photographic material in a broad range.

Any pigment insoluble in water may be used in the invention. Especially preferred for use herein are those having a high affinity for organic solvents and capable of readily dispersing in organic solvents.

In general, the grain size of the tinting pigment is preferably from 0.01 μm to 5 μm for efficiently tinting the photographic material, more preferably from 0.01 μm to 3 μm.

In the invention, the most preferred method of introducing the pigment into the photographic material is as follows: Like in a process of emulsifying and dispersing a photographic useful substance such as ordinary dye-forming coupler (this is referred to as coupler herein) followed by combining the resulting dispersion with other photographic materials, the pigment to be introduced into the photographic material of the invention is added to a high-boiling-point organic solvent to form a uniform self-dispersion of fine particles of the pigment. The dispersion is then emulsified and dispersed in a hydrophilic colloid, preferably in an aqueous gelatin solution, along with a surfactant dispersant to form a fine emulsion of the pigment particles, by the use of a known device such as ultrasonicator, colloid mill, homogenizer, Manton Gaulin, high-performance dissolver or the like.

The high-boiling-point organic solvent to be used herein is not specifically defined, and may be any ordinary one. For example, those described in U.S. Pat. No. 2,322,027 and JP-A 7-152129 are usable.

Along with the high-boiling-point organic solvent, an auxiliary solvent may be used, if desired. Examples of the auxiliary solvent are lower alcohol acetates such as ethyl acetate, butyl acetate; and ethyl propionate, secondary butyl acetate, methyl ethyl ketone, methyl isobutyl ketone, β-ethoxyethyl acetate, methyl cellosolve acetate, methylcarbitol acetate, and cyclohexanone.

Most preferably, the pigment is added to the organic solvent that dissolves the photographic useful compound such as coupler to be in the photographic material of the invention, and co-emulsified with the compound to form an emulsion that contains both the pigment and the compound.

The invention is described in more detail with reference to some examples thereof mentioned below. Unless otherwise specifically indicated, the invention should not be limited to these examples.

In the invention, any type of pigment may be used with no limitation, so far as it enables the desired color control and it remains in the photographic material not changing at all while the material is processed. Some preferred examples of the pigment for use herein are mentioned below. The blue pigment for use in the invention is meant to indicate those classified in the group of C.I. Pigment Blue in *Color Index* (by the Society of Dyers and Colorists). Similarly, the red pigment for use in the invention is meant to indicate those classified in the group of C.I. Pigment Red therein; and the violet pigment for use in the invention is meant to indicate those classified in the group of C.I. Pigment Violet therein.

The blue pigment for use in the invention may be an organic pigment, including, for example, azo pigments (e.g., C.I. Pigment Blue 25), phthalocyanine pigments (e.g., C.I. Pigment Blue 5:1, 15:3, 15:6, 16, 75), indanthronepigments (e.g., C.I. Pigment Blue 60, 64, 21), triarylcarbonium-type basic dye lake pigments (e.g., C.I. Pigment Blue 1, 2, 9, 10, 14, 62), triarylcarbonium-type acid dye lake pigments (e.g., C.I. Pigment Blue 18, 19, 24:1, 24:x, 56, 61), and indigo pigments (e.g., C.I. Pigment Blue 63, 66). of those, preferred are indanthrone pigments, triarylcarbonium-type basic dye lake pigments and acid dye lake pigments, and indigo pigments in view of their color tone; and most preferred are indanthrone pigments in view of their color fastness.

The blue pigment for use in the invention may also be an inorganic pigment, and ultramarine and cobalt blue are preferred.

The indanthrone pigments for use in the invention are preferably those having a high affinity for organic solvents, and they may be selected from commercial products. For example, usable are Ciba Speciality Chemicals' Blue A3R-KP (trade name) and Blue A3R-K (trade name).

For controlling the color tone of the photographic material of the invention, it is preferable to use red and violet pigments along with the blue pigment as above. Preferred examples of the red pigment are azo pigments (e.g., C.I. Pigment Red 2, 3, 5, 12, 23, 48:2, 48:3, 52:1, 53:1, 57:1, 63:2, 112, 144, 146, 150, 151, 166, 175, 176, 184, 187, 220, 221, 245), quinacridone pigments (e.g., C.I. Pigment Red 122, 192, 202, 206, 207, 209), diketopyrrolopyrole pigments (e.g., C.I. Pigment Red 254, 255, 264, 272), perylene pigments (e.g., C.I. Pigment Red 123, 149, 178, 179, 190, 224), perinone pigments (e.g., C.I. Pigment Red 194), anthraquinonepigments (e.g., C.I. Pigment Red 83:1, 89, 168, 177), benzimidazolone pigments (e.g., C.I. Pigment Red 171, 175, 176, 185, 208), triarylcarbonium-type basic dye lake pigments (e.g., C.I. Pigment Red 81:1, 169), thioindigo pigments (e.g., C.I. Pigment Red 88, 181), pyranthrone pigments (e.g., C.I. Pigment Red 216, 226), pyrazoloquinazolonepigments (e.g., C.I. Pigment Red 251, 252), isoindoline pigments (e.g., C.I. Pigment Red 260). Of those, more preferred are azo pigments, quinacridone pigments, diketopyrrolopyrole pigments and perylene pigments; and even more preferred are azo pigments and diketopyrrolopyrole pigments.

Preferred examples of the violet pigment are azo pigments (e.g., C.I. Pigment Violet 13, 25, 44, 50), dioxazine pigments (e.g., C.I. Pigment Violet 23, 27), quinacridone pigments (e.g., C.I. Pigment Violet 19, 42), triarylcarbonium-type basic dye lake pigments (e.g., C.I. Pigment Violet 1, 2, 3, 27, 39), anthraquinone pigments (e.g., C.I. Pigment Violet 5:1, 33), perylene pigments (e.g., C.I. Pigment Violet 29), isoviolanthrone pigments (e.g., C.I. Pigment Violet 31), benzimidazolone pigments (e.g., C.I. Pigment Violet 32). Of those, preferred are azo pigments, dioxazine pigments, and quinacridone pigments; and more preferred are dioxazine pigments.

The dioxazine pigments for use in the invention are preferably those having a high affinity for organic solvents, and they may be selected from commercial products. For example, usable are Ciba Speciality Chemicals' Violet B-K (trade name) and Violet B-KP (trade name).

For color control in the invention, the above-mentioned pigments may be combined with any other pigments (e.g., those classified in the groups of C.I. Pigment Yellow, C.I. Pigment Orange, C.I. Pigment Brown, C.I. Pigment Green), if desired.

Concrete compounds of the pigments are described in *Color Index* (by the Society of Dyers and Colorists); and W. Herbst & K. Hunger, *Industrial Organic Pigments* (by VCH Verlagsgesellschaft mbH, 1993).

The pigments for use in the invention may be the nude pigments as above, or may be those processed for surface treatment. For their surface treatment, for example, the pigments may be coated with resin or wax; a surfactant may be adhered to the pigments; a reactive substance (e.g., silane coupling agent, epoxy compound, polyisocyanate) may be bonded to the pigment surface; or pigment derivatives (synergists) are used. These are described in some references such as *Properties and Applications of Metal Soap* (by Miyuki Publishing), *Printing Ink Technology* (by CMC Publishing, 1984), *The Latest Pigment Application Techniques* (by CMC Publishing, 1986).

Above all, easily-dispersible pigments, so-called instant pigments that are coated with resin or wax and put on the market (for example, Ciba Speciality Chemicals' Microlith pigments) are especially preferable since they do not require dispersing before introduced into photographic materials and they well disperse in high-boiling-point organic solvents. In this case, the high-boiling-point organic solvent with the pigment dispersed therein may be dispersed in hydrophilic colloid such as gelatin.

In the invention, the pigment may be dispersed in a high-boiling-point organic solvent and then further dispersed in hydrophilic colloid such as gelatin, but alternatively, the pigment may be directly dispersed in hydrophilic colloid. The dispersant to be used in the case may be any one selected depending on the binder and the pigment used. For example, surfactant-type low-molecular dispersants or polymer dispersants may be used. In view of the stability of the pigment dispersions formed, polymer dispersants are more preferred. Examples of the dispersants usable herein are described, for example, in JP-A 3-69949 and EP 549,486.

After dispersed, the pigment particles preferably have a particle size of from 0.01 to 10 μm, more preferably from 0.02 to 1 μm.

For dispersing the pigment in a binder, any known technique of dispersion generally used in ink production or toner production may be employed. The dispersing machine to be used includes, for example, sand mills, attritors, pearl mills, supermills, ball mills, impellers, dispersers, KD mills, colloid mills, Dynatron, three-roll mills, and pressure kneaders. Their details are described in *The Latest Pigment Application Techniques* (by CMC Publishing, 1986).

The preferred range of the total amount of the pigment to be used in the invention is from 0.1 $mg/m^2$ to 10 $mg/m^2$, more preferably from 0.3 $mg/m^2$ to 5 $mg/m^2$. Also preferably, the blue pigment is combined with any other color pigments. In view of the production costs, the method of adding the pigment to the hydrophilic colloid layers to form the photographic constituent layers is preferred to the other method of adding it to the polyolefin resin that coats the support, since the amount of the pigment necessary for tinting the photographic material to a predetermined level may be significantly reduced in the former method.

In the invention, when the blue pigment is combined with the red pigment and/or the violet pigment, the pigments may be dispersed in one and the same hydrophilic colloid layer or in different hydrophilic colloid layers, and the mode of dispersing them is not specifically defined.

In the invention, it is also preferable to add an oil-soluble dye to the photographic constituent layers of the photographic material to thereby control the white background area of the material. Typical examples of the oil-soluble dye usable herein are Compounds 1 to 27 described on pages 8 and 9 of JP-A 2-842.

If desired, a fluorescent brightener may be added to the hydrophilic colloid layers of the photographic material, in which the fluorescent brightener is made to remain in the processed material to act to control the white background area of the processed material. Also if desired, a polymer having the ability to catch the fluorescent brightener, such as polyvinylpyrrolidone, maybe added to the photographic material of the invention.

Grain Size of Silver Halide Grains:

In the invention, the grain size of the silver halide grains is defined as the length of one edge of the cube having the same volume as that of the grain. The mean grain size of the grains is defined as the number average of the grain sizes (in terms of the edge length of the cube having the same volume as that of each grain). In this connection, it is to be noted that the mean grain size should be calculated only for the silver halide grains that are developed to substantially participate in dye formation through reaction with coupler, not including other fine grain emulsions substantially having no sensitivity. In the embodiments of the invention mentioned above, the mean grain size of the silver halide grains in the yellow-coloring photosensitive silver halide emulsion layer is at most 0.70 μm. More preferably, it is at most 0.65 μm, even more preferably at most 0.60 μm. Still more preferably, the mean grain size of the silver halide grains in the yellow-coloring photosensitive silver halide emulsion layer is at most 0.58 μm, most preferably at most 0.4 μm. The lower most limit of the grain size of the yellow-coloring photosensitive silver halide grains is not specifically defined in the invention. However, if the grain size is too small, the sensitivity of the photographic material will be low and the white background area thereof will be stained since the amount of the sensitizing dye to be in the material increases. Therefore, the lowermost limit of the grain size of the silver halide grains shall be defined in any desired manner, not producing the problem. For example, the lowermost limit is preferably 0.15 μm, more preferably 0.20 μm. The mean grain size of the silver halide grains in the magenta-coloring photosensitive silver halide emulsion layer and in the cyan-coloring photosensitive silver halide emulsion layer is preferably at most 0.6 μm, more preferably at most 0.5 μm. The lowermost limit of the mean grain size in these emulsion layers is not also specifically defined, but is preferably at least 0.10 μm. Also preferably, the grain size distribution of the silver halide grains in the invention is as small as possible. Concretely, it is preferable that the silver halide grains are mono-dispersed to have a grain size distribution fluctuation coefficient (this is obtained by dividing the standard deviation of the grain size distribution by the mean grain size) of at most 20%, more preferably at most 15%, even more preferably at most 10%. For broadening the latitude of the photographic material in processing it, it is also preferable that the mono-dispersed emulsions are blended to form one layer, or are layered to from two or more layers.

In the invention, the grain size of the silver halide grains may be measured in any known manner. Preferably, it is measured by observing the silver halide grains with an electronic microscope.

The silver halide color photographic material of the invention, which has, on a reflective support, at least one yellow-coloring photosensitive silver halide emulsion layer, at least one magenta-coloring photosensitive silver halide emulsion layer and at least one cyan-coloring photosensitive silver halide emulsion layer and has thereon at least one non-photosensitive non-coloring hydrophilic colloid layer, wherein the mean grain size of the silver halide grains in the yellow-coloring photosensitive silver halide emulsion layer in the material is at most 0.70 μm, and the yellow reflection density of the material satisfies the relation of the following formula, after being exposed to light to which the yellow-coloring photosensitive silver halide emulsion layer is sensitive, and then being color developed:

$$DS_{0.1}-DS_{0.0001}\leqq 0.3$$

wherein $DS_{0.1}$ indicates the yellow reflection density of the material exposed to light to which the yellow-coloring photosensitive silver halide emulsion is sensitive and of which the intensity of illumination for exposure is larger by 0.5 log E than that necessary for obtaining an yellow reflection density of 0.7 when the material is exposed to the light for a period of 0.1 seconds and then being color developed; and $DS_{0.0001}$ indicates the yellow reflection density of the material exposed to light to which the yellow-coloring photosensitive silver halide emulsion is sensitive and of which the intensity of illumination for exposure is larger by 0.5 log E than that necessary for obtaining an yellow reflection density of 0.7 when the material is exposed to the light for a period of 0.0001 seconds and then being color developed.

The value of $DS_{0.1}-DS_{0.0001}$ indicates the reflection density difference between exposure for 0.1 seconds and exposure for 0.0001 seconds to light of which the intensity of illumination for exposure is larger by 0.5 log E than that at the point at which the processed photographic material has a reflection density of 0.7, when the gradation contrast of the processed photographic material after 0.1 second exposure and the gradation contrast thereof after 0.0001 second exposure are laid to overlap each other at that point; and this value means the substantial shoulder contrast difference in the image gradation in the processed photographic material. When $DS_{0.1}-DS_{0.0001}$ gives a positive value, this means that the shoulder contrast after exposure for 0.0001 seconds is lower than that after exposure for 0.1 seconds; but when it gives a negative value, this means that the shoulder contrast after exposure for 0.0001 seconds is higher than that after exposure for 0.1 seconds. In this embodiment, the mean grain size of the silver halide grains in the yellow-coloring photosensitive silver halide emulsion layer must be at most 0.70 μm, but preferably at most 0.58 μm, more preferably at most 0.48 μm. The lowermost limit of the mean grain size is as described hereinabove.

More preferably, the value of $DS_{0.1}-DS_{0.0001}$ satisfies the relation of the following formula:

$$DS_{0.1}-DS_{0.0001}\leqq 0.15.$$

Also more preferably, $DS_{0.1}-DS_{0.0001}$ gives a negative value, satisfying the relation of the following formula:

$$DS_{0.1}-DS_{0.0001}\leqq 0.$$

The lowermost limit of $DS_{0.1}-DS_{0.0001}$ in these formulae is not specifically defined, but is preferably at least −0.3.

Color-Sensitizing Dye:

The emulsion layers that constitute the photographic material of the invention are spectrally sensitized with color-sensitizing dyes for making the emulsions spectrally sensitive to light in a desired wavelength range.

The color-sensitizing dyes of formulae (I) and (II) that are used in the invention for spectrally sensitization are described below.

General formula (I)

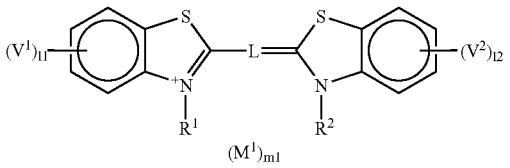

wherein $V^1$ and $V^2$ each independently represent a monovalent substituent, provided that neither $V^1$ nor $V^2$ is an aromatic group and at least two mutually adjacent $V^1$s and mutually adjacent $V^2$s do not bond to each other to form an aromatic or alicyclic ring that forms a condensed ring with a benzene ring, and at least one of $V^1$ and $V^2$ is not a bromine atom; $l_1$ and $l_2$ each independently represent 0, 1, 2, 3 or 4; L represents a methine group; $R^1$ and $R^2$ each independently represent an alkyl group; $M^1$ represents a counter ion; and $m_1$ represents a number of 0 or more necessary to neutralize the charge in the molecule.

$V^1$and $V^2$ may be any monovalent substituent, provided that neither $V^1$ nor $V^2$ is an aromatic group and two or more of them adjacent to each other do not bond to each other to form a condensed aromatic or alicyclic ring, and that at least one of $V^1$ and $V^2$ is not a bromine atom (neither $V^1$ nor $V^2$ is preferably a bromine atom). Referred to as V, the monovalent substituent includes, for example, a halogen atom (e.g., chlorine, iodine, bromine), a mercapto group, a cyano group, a carboxyl group, a phosphoric acid group, a sulfo group, a hydroxyl group, a carbamoyl group having from 1 to 10, preferably from 2 to 8, more preferably from 2 to 5 carbonatoms (e.g., methylcarbamoyl, ethylcarbamoyl, morpholinocarbonyl), a sulfamoyl group having from 0 to 10, preferably from 2 to 8, more preferably from 2 to 5 carbon atoms (e.g., methylsulfamoyl, ethylsulfamoyl), a nitro group, an alkoxy group having from 1 to 20, preferably from 1 to 10, more preferably from 1 to 8 carbon atoms (e.g., methoxy, ethoxy, 2-methoxyethoxy, 2-phenylethoxy), an acyl group having from 1 to 20, preferably from 2 to 12, more preferably from 2 to 8 carbon atoms (e.g., acetyl, benzoyl, trichloroacetyl), an acyloxy group having from 1 to 20, preferably from 2 to 12, more preferably from 2 to 8 carbon atoms (e.g., acetyloxy), an acylamino group having from 1 to 20, preferably from 2 to 12, more preferably from 2 to 8 carbon atoms (e.g., acetylamino), a sulfonyl group having from 1 to 20, preferably from 1 to 10, more preferably from 1 to 8 carbon atoms (e.g., methanesulfonyl, ethanesulfonyl, benzenesulfonyl), a sulfinyl group having from 1 to 20, preferably from 1 to 10, more preferably from 1 to 8 carbon atoms (e.g., methanesulfinyl, benzenesulfinyl), a sulfonylamino group having from 1 to 20, preferably from 1 to 10, more preferably from 1 to 8 carbon atoms (e.g., methanesulfonylamino, ethanesulfonylamino), an amino group, a substituted amino group having from 1 to 20, preferably from 1 to 12, more preferably from 1 to 8 carbon atoms (e.g., methylamino, dimethylamino, benzylamino, anilino), an ammonium group having from 0 to 15, preferably from 3 to 10, more preferably from 3 to 6 carbon atoms (e.g., trimethylammonium, triethylammonium), a hydrazino group having from 0 to 15, preferably from 1 to 10, more preferably from 1 to 6 carbon atoms (e.g., trimethylhydrazino), an ureido group having from 1 to 15, preferably from 1 to 10, more preferably from 1 to 6 carbon atoms (e.g., ureido, N,N-dimethylureido), an imido group having from 1 to 15, preferably from 1 to 10, more preferably from 1 to 6 carbon atoms (e.g., succinimido), an alkyl or arylthio group having from 1 to 20, preferably from 1 to 12, more preferably from 1 to 8 carbon atoms (e.g., methylthio, ethylthio, carboxyethylthio, sulfobutylthio), an alkoxycarbonyl group having from 2 to 20, preferably from 2 to 12, more preferably from 2 to 8 carbon atoms (e.g., methoxycarbonyl, ethoxycarbonyl), an unsubstituted alkyl group having from 1 to 18, preferably from 1 to 10, more preferably from 1 to 5 carbon atoms (e.g., methyl, ethyl, propyl, butyl), a substituted alkyl group having from 1 to 18, preferably from 1 to 10, more preferably from 1 to 5 carbon atoms (e.g., hydroxymethyl, trifluoromethyl, benzyl, carboxyethyl, ethoxycabonylmethyl, acetylaminomethyl—the substituted alkyl group further includes unsaturated hydrocarbon groups preferably having from 2 to 18, more preferably from 3 to 10, even more preferably from 3 to 5 carbon atoms, such as vinyl, ethynyl, 1-cyclohexenyl), and an optionally substituted heterocyclic group having from 1 to 20, preferably from 2 to 10, more preferably from 4 to 6 carbon atoms (e.g., pyridyl, 5-methylpyridyl, thienyl, furyl, morpholino, tetrahydrofurfuryl). These substituents may be further substituted with V.

Preferably, $V^1$ and $V^2$ each are an alkyl group, an alkoxy group, a halogen atom, an acyl group or a cyano group such as those mentioned above, more preferably an alkyl group, an alkoxy group or a halogen atom, even more preferably a methyl group, a methoxy group, a fluorine atom, a chlorine atom, a bromine atom or an iodine atom, most preferably a fluorine atom or a chlorine atom.

Two or more of $V^1$ and $V^2$ adjacent to each other may bond to each other to form a condensed hetero ring. For example, two adjacent groups of $V^1$ and $V^2$ may bond to each other to be a methylenedioxy group to form a hetero ring such as a 1,3-dioxolane ring, a tetrahydrofuran ring, a dioxane ring or a morpholine ring, preferably a 1,3-dioxolane ring. Preferably, however, the groups do not bond to form a condensed ring.

$l_1$ and $l_2$ each independently represent 0, 1, 2, 3 or 4, preferably 0, 1 or 2, more preferably 1 or 2, even more preferably 1. When $l_1$ and $l_2$ each are 2 or more, $V^1$ and $V^2$ are repeated, but these do not need to be the same.

$M^1$ is in the formula to indicate the presence of a cation or an anion therein, when necessary for neutralizing the ion charge of the dye. Typical examples of the cation are inorganic cations such as hydrogen ion ($H^+$), alkali metal ions (e.g., sodium ion, potassium ion, lithium ion), alkaline earth metal ions (e.g., calcium ion); and organic ions such as ammonium ions (e.g., ammonium ion, tetraalkylammonium ion, pyridinium ion, ethylpyridinium ion). The anion may be any of inorganic anions or organic anions, including, for example, halide anions (e.g., fluoride ion, chloride ion, iodide ion), substituted arylsulfonate ions (e.g., p-toluenesulfonate ion, p-chlorobenzenesulfonate ion), aryldisulfonate ions (e.g., 1,3-benzenedisulfonate ion, 1,5-naphthalenedisulfonate ion, 2,6-naphthalenedisulfonate ion), alkylsulfate ions (e.g., methylsulfate ion), sulfate ions, thiocyanate ions, perchlorate ions, tetrafluoroborate ions, picrate ions, acetate ions, and trifluoromethanesulfonate ions. In addition, ionic polymers and other dyes having a counter charge opposite to the charge of the dye may also be used for $M^1$. In case where $CO_2^-$ or $SO_3^-$ for $M^1$ has a hydrogen ion as the counter ion, it may be expressed as $CO_2H$ or $SO_3H$.

$m_1$ represents a number of 0 or more necessary for charge balance. In case where the dye forms an inner salt, $m_1$ is 0. Preferably, $m_1$ is a number of from 0 to 4, more preferably 0 or 1.

$R^1$ and $R^2$ each independently represent an alkyl group, including an unsubstituted alkyl group having from 1 to 18, preferably from 1 to 7, more preferably from 1 to 4 carbon atoms (e.g., methyl, ethyl, propyl, isopropyl, butyl, isobutyl, hexyl, octyl, dodecyl, octadecyl), and a substituted alkyl group having from 1 to 18, preferably from 1 to 7, more preferably from 1 to 4 carbon atoms. The substituent for the substituted alkyl group includes, for example, a monovalent substituent for V mentioned above, and an aryl group. Preferably, the substituents are an alkyl group, analkenyl group, anaryl group, a heterocyclic group, a halogen atom, an alkoxy group, a hydroxyl group, a carboxyl group, an acyloxy group, a carbamoyl group, a sulfamoyl group, a sulfo group, a sulfonylcarbamoyl group, a phosphono group, and a sulfoxy group. Preferred examples of the substituted alkyl group are an aralkyl group (e.g., benzyl, 2-phenylethyl), an unsaturated hydrocarbon group (e.g., allyl), a hydroxyalkyl group (e.g., 2-hydroxyethyl, 3-hydroxypropyl), a carboxyalkyl group (e.g., 2-carboxyethyl, 3-carboxypropyl, 4-carboxybutyl, carboxymethyl), an alkoxyalkyl group (e.g., 2-methoxyethyl, 2-(2-methoxyethoxy)ethyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylcarbamoylmethyl), a sulfoalkyl group (e.g., 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl, 4-sulfo-2-butenyl), a sulfoxyalkyl group (e.g., 2-sulfoxyethyl, 3-sulfoxypropyl, 4-sulfoxybutyl), a hetero ring-substituted alkyl group (e.g., 2-(pyrrolidin-2-one-1-yl)ethyl, tetrahydrofurfuryl), an alkylsulfonylcarbamoylmethyl group (e.g., methanesulfonylcarbamoylmethyl), and a phosphonoalkyl group (e.g., 2-phosphonoethyl, 3-phosphonopropyl, 3-phosphonobutyl, 4-phosphonobutyl).

Also preferred is an alkyl group substituted with an anion such as $—COO^-$, $—OCOO^-$, $—SO_3^-$, $—OSO_3^-$, $—PO_3^-$, $—OPO_3^-$ or $—CON^-SO_2R'$.

Preferably, the alkyl group for $R^1$ and $R^2$ is a carboxyalkyl group, a sulfoalkyl group or an unsubstituted alkyl group such as those mentioned above, more preferably a sulfoalkyl group.

L represents a methine group, which may be substituted. The substituent for the methine group includes, for example, a substituted or unsubstituted alkyl group having from 1 to 15, preferably from 1 to 10, more preferably from 1 to 5 carbon atoms (e.g., methyl, ethyl, 2-carboxyethyl), a substituted or unsubstituted heterocyclic group having from 3 to 20, preferably from 4 to 15, more preferably from 6 to 10 carbon atoms (e.g., N,N-diethylbarbituryl), a halogen atom (e.g., chlorine, bromine, fluorine, iodine), an alkoxy group having from 1 to 15, preferably from 1 to 10, more preferably from 1 to 5 carbon atoms (e.g., methoxy, ethoxy), an alkylthio group having from 1 to 15, preferably from 1 to 10, more preferably from 1 to 5 carbon atoms (e.g., methylthio, ethylthio), and an amino group having from 0 to 15, preferably from 2 to 10, more preferably from 4 to 10 carbon atoms (e.g., N-methylpiperazino). Along with $R^1$ and $R^2$, L may form a ring. Preferably, L is an unsubstituted methine group.

Specific examples of the compounds of formula (I) for use in the invention are mentioned below, to which, however, the invention is not limited.

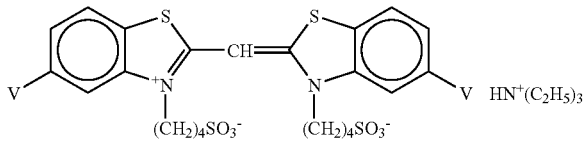

| No. | V |
|---|---|
| I-1 | Cl |
| I-2 | $CO_2CH_3$ |
| I-3 | I |
| I-4 | F |
| I-5 | H |
| I-6 | $CH_3$ |
| I-7 | $OCH_3$ |
| I-8 | $CO_2H$ |
| I-9 | $CO_2C_2H_5$ |

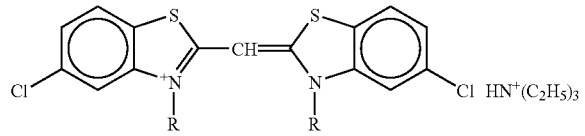

| No. | R |
|---|---|
| I-10 | $(CH_2)_3SO_3^-$ |
| I-11 | $(CH_2)_2CH(CH_3)SO_3^-$ |
| I-12 | $CH_2CO_2^-$ |
| I-13 | $(CH_2)_2SO_3^-$ |
| I-14 | $(CH_2)_2CO_2^-$ |
| I-15 | $(CH_2)_3OSO_3^-$ |
| I-16 | $(CH_2)_2OSO_3^-$ |
| I-17 | $(CH_2)_3PO_3^-$ |

I-18

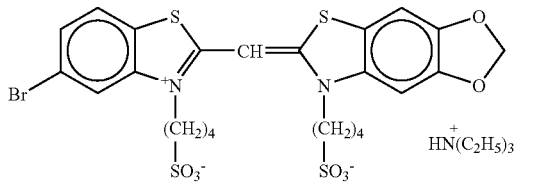

I-19

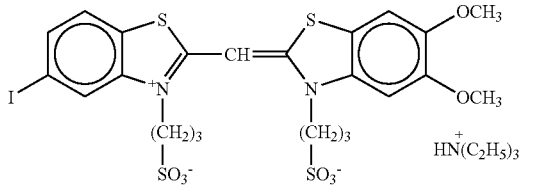

I-20

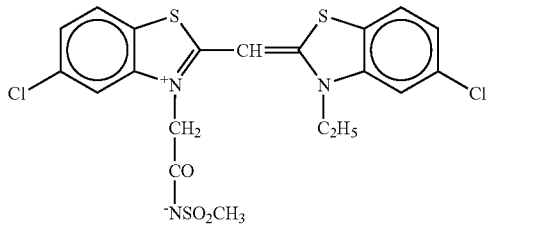

-continued

I-21

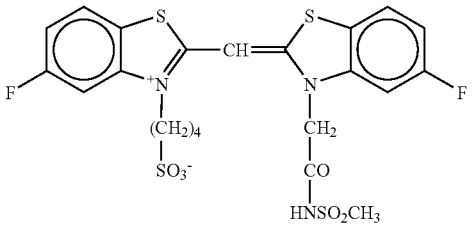

I-22

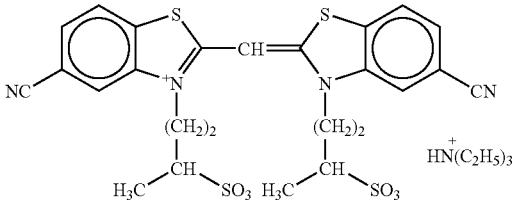

I-23

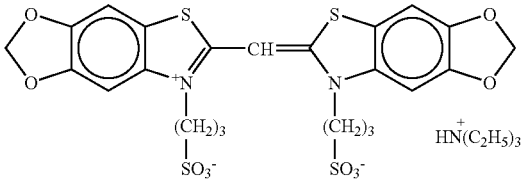

I-24

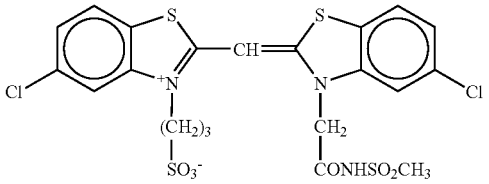

I-25

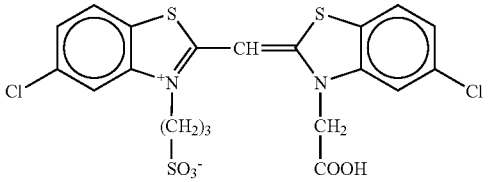

I-26

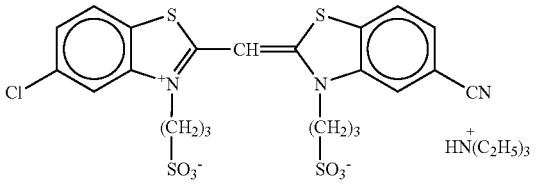

I-27

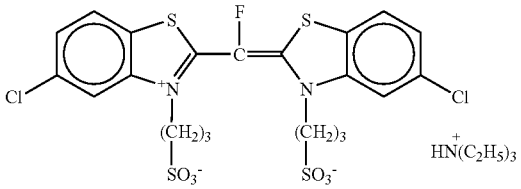

-continued

I-28

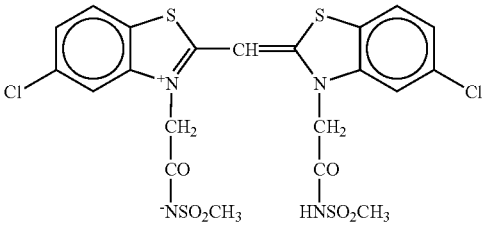

I-29

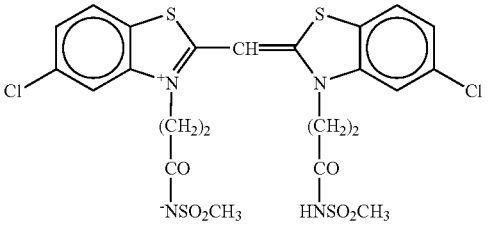

I-30

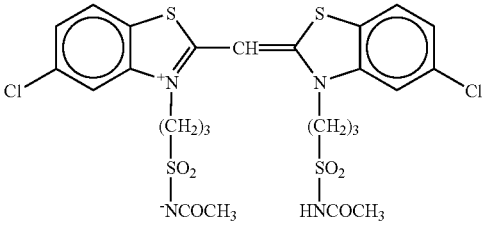

The color-sensitizing dyes of formula (II) are described below.

General Formula (II)

General formula (II)

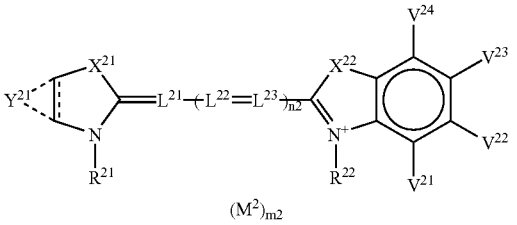

wherein $Y^{21}$ represents an atomic group necessary for forming a pyrrole, furan or thiophene ring, and may be condensed with any other carbon ring or hetero ring and may be substituted; $X^{21}$ and $X^{22}$ each independently represent an oxygen atom, a sulfur atom, a selenium atom or $NR^{23}$; $R^{21}$, $R^{22}$ and $R^{23}$ each independently represent an alkyl group, an aryl group or a heterocyclic group; $V^{21}$, $V^{22}$, $V^{23}$ and $V^{24}$ each independently represent a hydrogen atom or a substituent, provided that two of the substituents $V^{21}$, $V^{22}$, $V^{23}$ and $V^{24}$ adjacent to each other do not bond to each other to form a saturated or unsaturated condensed ring; $L^{21}$, $L^{22}$ and $L^{23}$ each independently represent a methine group; $n_2$ represents 0, 1, 2, 3 or 4; $M^2$ represents a counter ion; and $m_2$ represents a number of 0 or more necessary to neutralize the charge in the molecule.

In formula (II), $Y^{21}$ represents an atomic group necessary for forming a pyrrole, furan or thiophene ring, and the direction in which the ring to be formed by the atomic group of $Y^{21}$ is condensed is not specifically defined. One example of thiophene ring is referred to. This includes three cases. One is thieno[3,2-d]azole in which the sulfur atom of the thiophene ring is on the same side as that of $X^{21}$ relative to the condensed carbon-carbon bond (type (c) of the general formula mentioned below); another is thieno[2,3-d]azole in which the sulfur atom of the thiophene ring is on the opposite side to that of $X^{21}$ relative to the condensed carbon-carbon bond (type (a) of the general formula mentioned below); and still another is thieno[3,4-d]azole condensed at the 3,4-position of the thiophene ring (type (b) of the general formula mentioned below). Of these, the former two are preferred. In case where the sensitizing dye is required to have the ability to spectrally absorb light of long waves, the type (a) is more preferred for it.

(a)

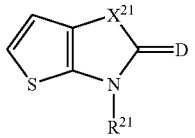

$(M^2)_{m2}$ (b)

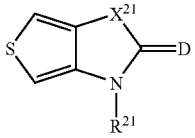

$(M^2)_{m2}$ (c)

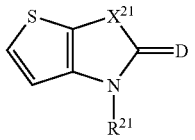

$(M^2)_{m2}$

In formulae (a), (b) and (c), $X^{21}$, $R^{21}$, $M^2$ and $m_2$ have the same meanings as those in formula (II). D indicates a partial structure of the right-side moiety of formula (II) including $L^{21}$.

The ring to be formed by $Y^{21}$ is preferably substituted. Preferred examples of the substituent for it are an alkyl group (e.g., methyl), an aryl group (e.g., phenyl), an aromatic heterocyclic group (e.g., 1-pyrolyl), an alkoxy group (e.g., methoxy), an alkylthio group (e.g., methylthio), a cyano group, and a halogen atom (e.g., fluorine, chlorine, bromine, iodine). More preferably, the substituent is a halogen atom, even more preferably a chlorine atom or a bromine atom.

$X^{21}$ and $X^{22}$ each independently represent an oxygen atom, a sulfur atom, a selenium atom or $NR^{23}$, preferably an oxygen atom, a sulfur atom or $NR^{23}$, more preferably an oxygen atom or a sulfur atom, even more preferably a sulfur atom.

$R^{21}$, $R^{22}$ and $R^{23}$ each independently represent analkyl group, an aryl group or a heterocyclic group. Preferably, $R^{21}$ and $R^{22}$ each are an alkyl group substituted with an acid group or a dissociative proton-having group, more preferably a substituted alkyl group that contains any of a carboxyl group, a sulfo group, or —$CONHSO_2$—, —$SO_2NHSO_2$—, —CONHCO— or —$SO_2NHCO$—, even more preferably a 2-sulfoethyl group, a 3-sulfopropyl group, a 3-sulfobutyl group, a 4-sulfobutyl group, a caboxymethyl group or a methanesulfonylcarbamoylmethyl group. Still more preferably, either one of $R_{21}$ and $R^{22}$ is a 2-sulfoethyl group, a 3-sulfopropyl group, a 3-sulfobutyl group or a 4-sulfobutyl group, and the other is a carboxymethyl group or a methanesulfonylcarbamoylmethyl group.

$R^{23}$ is preferably an unsubstituted alkyl group, more preferably a methyl or ethyl group.

The substituent for $V^{21}$, $V^{22}$, $V^{23}$ and $V^{24}$ may be any substitutable group, but two of these adjacent to each other do not bond to each other to form a saturated or unsaturated condensed ring. Preferably, $V^{21}$ and $V^{24}$ are hydrogen atoms; and $V^{22}$ and $V^{23}$ each are a hydrogen atom, or an alkyl group (e.g., methyl), an aryl group (e.g., phenyl), an aromatic heterocyclic group (e.g., 1-pyrolyl), an alkoxy group (e.g., methoxy), an alkylthio group (e.g., methylthio), a cyano group, or a halogen atom (e.g., fluorine, chlorine, bromine, iodine). More preferably, $V^{23}$ is a hydrogen atom, and $V^{22}$ is a halogen atom, even more preferably a chlorine atom or a bromine atom.

The methine group for $L^{21}$, $L^{22}$ and $L^{23}$ may be unsubstituted or substituted. $n_2$ represents 0, 1, 2, 3 or 4. When $n_2$ is 2 or more, the methine group is repeated, but the repeating methine groups do not need to be the same. Preferably, $n_2$ is 0, 1, 2 or 3, more preferably 0, 1 or 2, even more preferably 0 or 1.

When $n_2$ is 0, $L^{21}$ is preferably an unsubstituted methine group. When $n_2$ is 1, $L^{22}$ is preferably a methine group substituted with an unsubstituted alkyl group and $L^{21}$ and $L^{23}$ are unsubstituted methine groups; more preferably, $L^{22}$ is a methyl-substituted methine group or an ethyl-substituted methine group.

$M^2$ is in the formula to indicate the presence of a cation or an anion therein, when necessary to neutralize the ion charge of the dye. The matter whether dyes are cations or anions or have a net ion charge depends on the substituents in the dyes and on the condition (e.g., pH) of the dyes in solutions. Typical examples of the cation for $M^2$ are inorganic cations such as hydrogen ion ($H^+$), alkali metal ions (e.g., sodium ion, potassium ion, lithium ion), alkaline earth metal ions (e.g., calcium ion); and organic ions such as ammonium ions (e.g., ammonium ion, tetraalkylammonium ion, triethylammonium ion, pyridinium ion, ethylpyridinium ion, 1,8-diazabicyclo[5.4.0]-7-undecenium ion). The anion may be any of inorganic anions or organic anions, including, for example, halide anions (e.g., fluoride ion, chloride ion, bromide ion, iodide ion), substituted arylsulfonate ions (e.g., p-toluenesulfonate ion, p-chlorobenzenesulfonate ion), aryldisulfonate ions (e.g., 1,3-benzenedisulfonate ion, 1,5-naphthalenedisulfonate ion, 2,6-naphthalenedisulfonate ion), alkylsulfateions (e.g., methylsulfateion), sulfate ions, thiocyanate ions, perchlorate ions, tetrafluoroborate ions, picrate ions, acetate ions, and trifluoromethanesulfonate ions. In addition, ionic polymers and other dyes having a counter charge opposite to the charge of the dye may also be used for $M^2$.

Preferred cations for $M^2$ are sodium ion, potassium ion, triethylammonium ion, tetraethylammonium ion, pyridinium ion, ethylpyridinium ion, and methylpyridinium ion. Preferred anions for it are perchlorate ion, iodide ion, bromide ion, and substituted arylsulfonate ions (e.g., p-toluenesulfonate ion).

$m_2$ represents a number of 0 or more necessary for charge balance. In case where the dye forms an inner salt, $m_2$ is 0. Preferably, $m_2$ is a number of from 0 to 4.

Preferred embodiments of the compound of formula (II) which may be in the silver halide emulsions for use in the invention are described more concretely.

In case where the compound is to be in the red-sensitive emulsion layer in the photographic material of the invention, it is preferable that one of $X^{21}$ and $X^{22}$ is an oxygen atom and the other is a sulfur atom, $Y^{21}$ is a halogen-substituted pyrrole, furan or thiophene ring, $R^{21}$ and $R^{22}$ each are a sulfoalkyl group, a carboxyalkyl group or an alkylsulfonylcarbamoylalkyl group, $n_2$ is 1, $L^{21}$ and $L^{23}$ are unsubstituted methine groups, $L^{22}$ is a methyl-substituted or ethyl-substituted methine group, $V^{21}$, $V^{23}$ and $V^{24}$ are hydrogen atoms, $V^{22}$ is an alkyl group (e.g., methyl), an alkoxy group (e.g., methoxy), an alkylthio group (e.g., methylthio), a cyano group, a halogen atom (e.g., fluorine, chlorine, bromine, iodine), more preferably a halogen atom, $M^2$ is an organic or inorganic monovalent cation, and $m_2$ is 0 or 1.

In case where the compound is to be in the green-sensitive emulsion layer, it is preferable that $X^{21}$ and $X^{22}$ are both oxygen atoms, $Y^{21}$ is a chlorine or bromine-substituted pyrrole, furan or thiophene ring, $R^{21}$ and $R^{22}$ each are a sulfoalkyl group, a carboxyalkyl group or an alkylsulfonylcarbamoylalkyl group, $n_2$ is 1, $L^{21}$ and $L^{23}$ are unsubstituted methine groups, $L^{22}$ is a methyl-substituted or ethyl-substituted methine group, $V^{21}$, $V^{23}$ and $V2^4$ are hydrogen atoms, $V^{22}$ is an alkyl group (e.g., methyl), an aryl group (e.g., phenyl), an aromatic heterocyclic group (e.g., 2-thienyl), an alkoxy group (e.g., methoxy), an alkylthio group (e.g., methylthio), a cyano group, a halogen atom (e.g., fluorine, chlorine, bromine, iodine), more preferably a halogen atom, $M^2$ is an organic or inorganic monovalent cation, and $m_2$ is 0 or 1.

In case where the compound is to be in the blue-sensitive emulsion layer, it is preferable that $X^{21}$ and $X^{22}$ are both sulfur atoms, $Y^{21}$ is a halogen-substituted pyrrole ring, $R^{21}$ and $R^{22}$ each are a sulfoalkyl group, a carboxyalkyl group or an alkylsulfonylcarbamoylalkyl group, $n_2$ is 0, $L^{21}$ is an unsubstituted methine group, $V^{21}$, $V^{23}$ and $V^{24}$ are hydrogen atoms, $V^{22}$ is an alkyl group (e.g., methyl), an alkoxy group (e.g., methoxy), an alkylthio group (e.g., methylthio), a cyano group, a halogen atom (e.g., fluorine, chlorine, bromine, iodine), more preferably a halogen atom, even more preferably a chlorine atom or a bromine atom, $M^2$ is an organic or inorganic monovalent cation, and $m_2$ is 0 or 1.

Specific examples of the compounds of formula (II) for use in the invention are mentioned below, which, however, are not intended to restrict the scope of the invention.

In addition to the following, methine dyes S-1 to S-95 described in JP-A No. 2002-23295 are also usable in the invention.

II-1

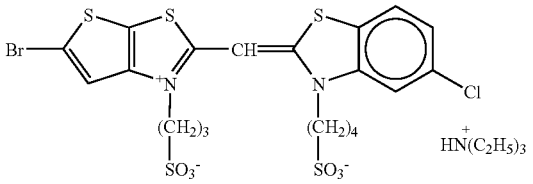

II-2

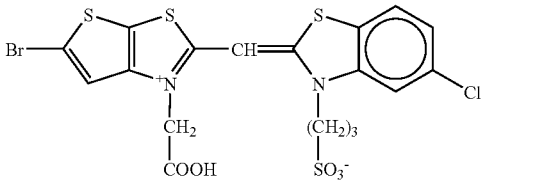

-continued

II-3

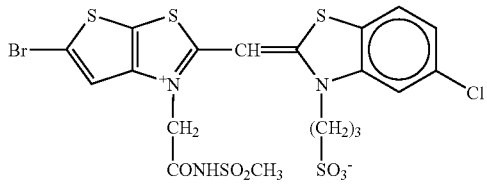

II-4

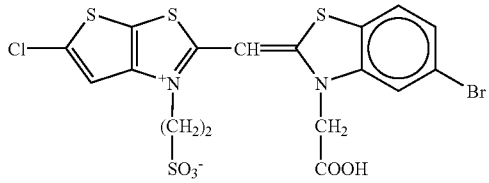

II-5

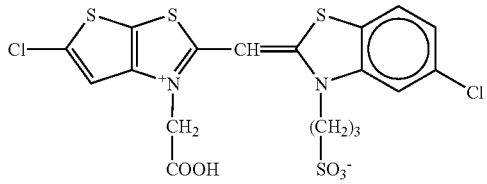

II-6

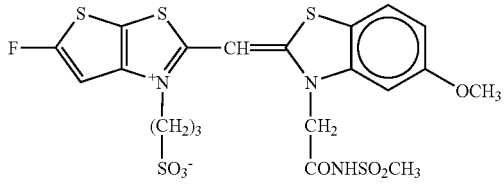

II-7

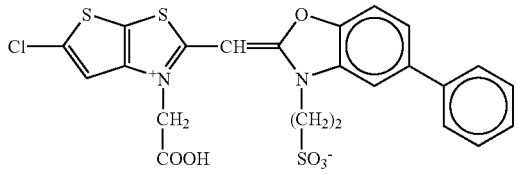

II-8

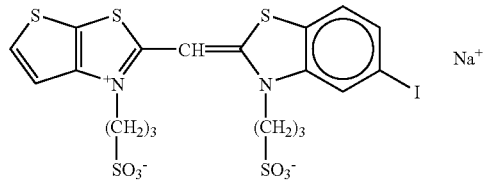

II-9

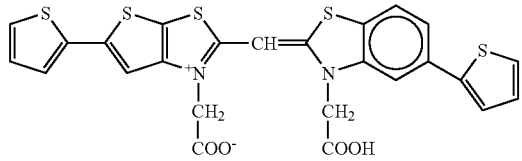

II-10

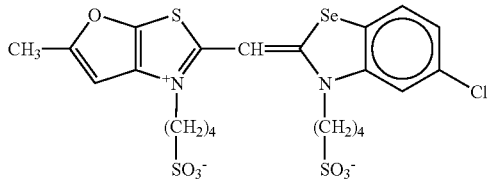

-continued
II-11
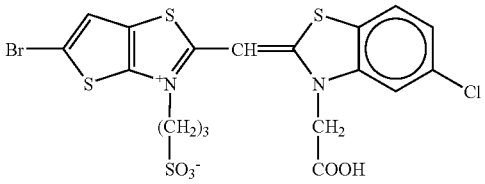
II-12
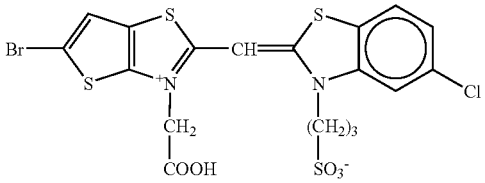
II-13
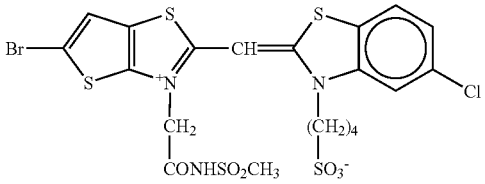
II-14
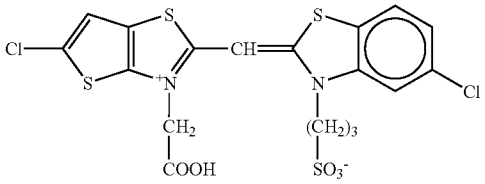
II-15
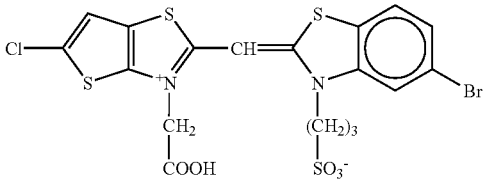
II-16
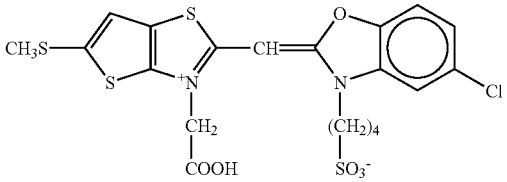
II-17
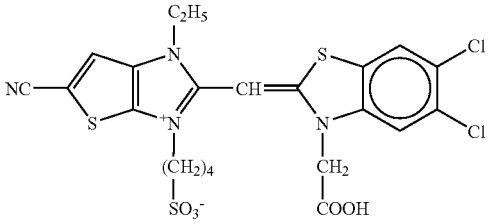
-continued
II-18
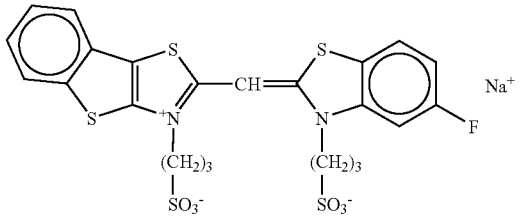
II-19
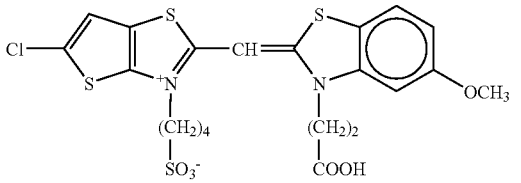
II-20
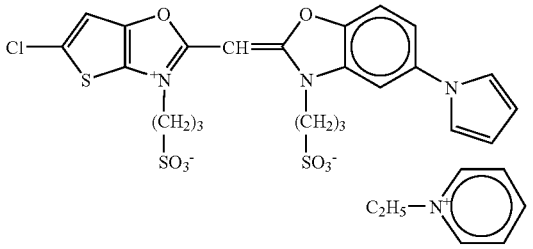
II-21
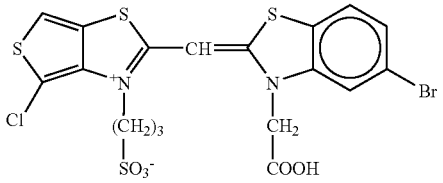
II-22
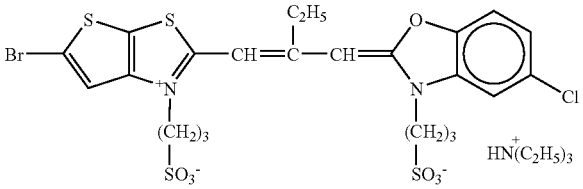
II-23
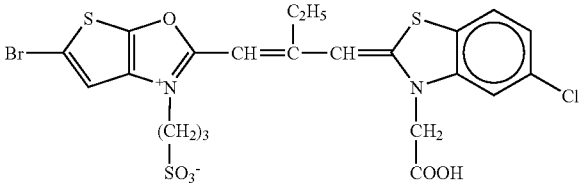
II-24
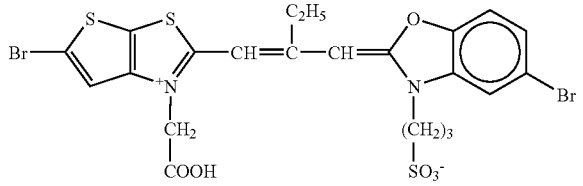

-continued
II-25
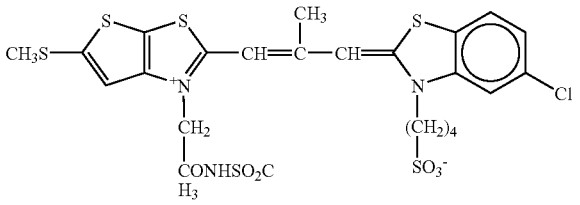
II-26
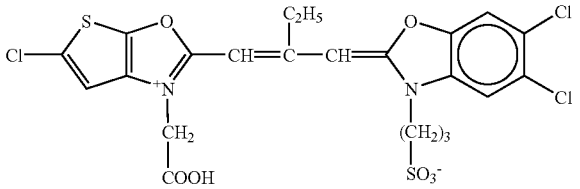
II-27
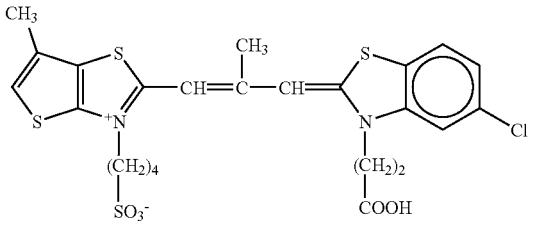
II-28
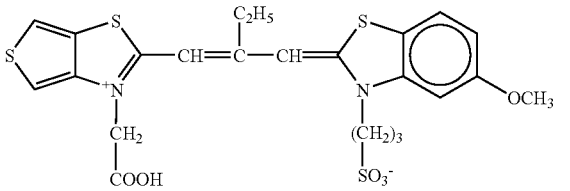
II-29
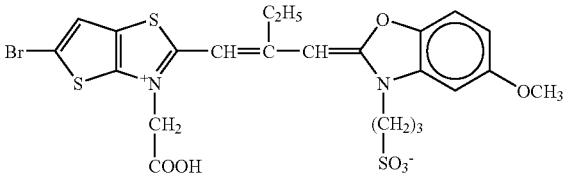
II-30
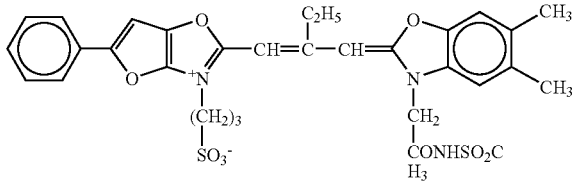
-continued
II-31
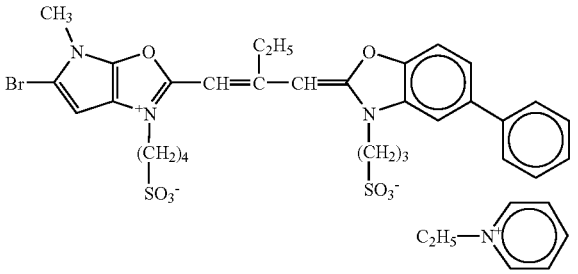
II-32
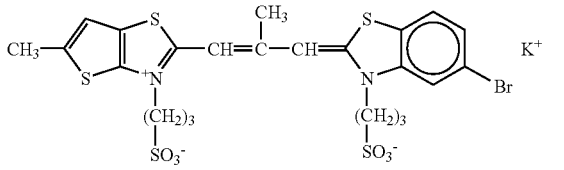
II-33
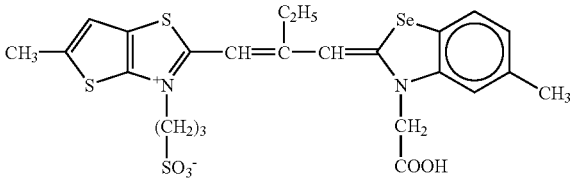
II-34
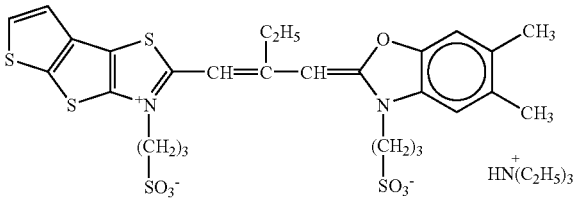
II-35
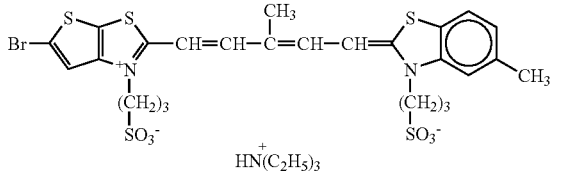
II-36
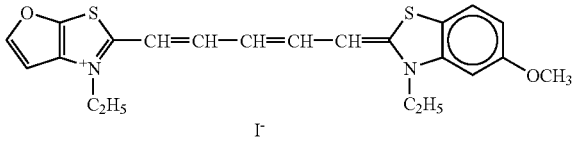
II-37
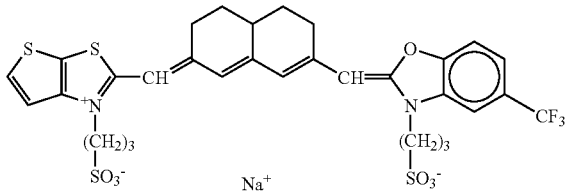

The sensitizing dyes of formulae (I) and (II) are produced according to the methods described in F. M. Hamer, *Heterocyclic Compounds—Cyanine Dyes and Related Compounds*, John Wiley & Sons, New York, London, 1964; D. M. Sturmer, *Heterocyclic Compounds—Special Topics in Heterocyclic Chemistry*, Chap. 18, Sec. 14, pp.482–515, John Wiley & Sons, New York, London, 1977; and *Rodd's Chemistry of Carbon Compound,* 2nd Ed., Vol. IV, Part B, 1977, Chap. 15, pp. 369–422, Elsevier Science Publishing Company, Inc., New York.

Two or more different types of the sensitizing dyes may be in the same emulsion.

The sensitizing dyes of formulae (I) and (II) may be combined with any other sensitizing dyes in the same emulsion. Preferred examples of the additional dyes that may be combined with the sensitizing dyes of formulae (I) and (II) or used in other emulsion layers not containing the sensitizing dyes of formulae (I) and (II) are cyanine dyes, merocyanine dyes, rhodacyanine dyes, trinuclear merocyanine dyes, tetranuclear merocycnine dyes, allopolar dyes, hemicyanine dyes and styryl dyes. More preferred are cyanine dyes, merocyanine dyes and rhodacyanine dyes; and even more preferred are cyanine dyes. The details of these dyes are described in F. M. Hamer, *Heterocyclic Compounds—Cyanine Dyes and Related Compounds*, John Wiley & Sons, New York, London, 1964; D. M. Sturmer, *Heterocyclic Compounds—Special Topics in Heterocyclic Chemistry*, Chap. 18, Sec. 14, pp. 482–515.

Concrete examples of the compounds and spectral sensitization with them which are preferably employed in the invention are described in JP-A 62-215272, from page 22, right upper column to page 38. For red-sensitizing dyes for silver halide emulsion grains having a high silver chloride content, those described in JP-A 3-123340 are especially preferred as they are stable, strongly adsorbed by silver halide grains and depend little on temperature in exposure.

Other preferred dyes for use in the invention are the sensitizing dyes described and exemplified as their general formulae and concrete examples in U.S. Pat. No. 5,994,051, pp. 32–44; U.S. Pat. No. 5,747,236, pp. 30–39.

Still other preferred examples of cyanine dyes, merocyanine dyes and rhodacyanine dyes for use in the invention are those of general formulae (XI), (XII) and (XIII) described in U.S. Pat. No. 5,340,694, columns 21 and 22 (in which the numbers of $n_{12}$, $n_{15}$, $n_{17}$ and $n_{18}$ are not defined and may be integers of 0 or more, but preferably at most 4).

One or more of these sensitizing dyes may be used herein. In case where two or more such sensitizing dyes are used, those effective for supersensitization are preferred. Their typical examples are described in U.S. Pat. Nos. 2,688,545, 2,977,229, 3,397,060, 3,522,052, 3,527,641, 3,617,293, 3,628,964, 3,666,480, 3,672,898, 3,679,428, 3,303,377, 3,769,301, 3,814,609, 3,837,862, 4,026,707; British Patent 1,344,281, 1,507,803; JP-B 43-49336, 53-12375,; and JP-A 52-110618, 52-109925.

Supersensitizers useful for spectral sensitization in the invention (e.g., pyrimidylamino compounds, triazinylamino compounds, azolium compounds, aminostyryl compounds, aromatic organic acid-formaldehyde condensates, azaindene compounds, cadmium salts), and the combination of supersensitizers and sensitizing dyes are described in, for example, U.S. Pat. Nos. 3,511,664, 3,615,613, 3,615,632, 3,615,641, 4,596,767, 4,945,038, 4,965,182, 4,965,182, 2,933,390, 3,635,721, 3,743,510, 617,295, 3,635,721. Regarding the method of using them, preferably referred to are the disclosures in these patent specifications.

The sensitizing dyes may be added to silver halide emulsions in any stage heretofore considered good in the art of emulsion preparation. For example, as in U.S. Pat. Nos. 2,735,766, 3,628,960, 4,183,756, 4,225,666; JP-A 58-184142, 60-196749, they may be added to the emulsions in any stage of silver halide grain formation and/or before desalting, during desalting and/or after desalting but before the start of chemical ripening; or as in JP-A 58-113920, in any stage just before chemical ripening or during chemical ripening, or after chemical ripening but before emulsion coating. As in U.S. Pat. No. 4,225,666 and JP-A 58-7629, one compound or two or more compounds having different structures may be added to emulsions in two or more divided portions, for example, during silver halide grain formation and chemical ripening, or after chemical ripening, or before, during or after chemical ripening. In case where the compounds are added in such divided portions, the type of the compound to be added singly may be varied and the combination of the compounds to be added together may also be varied.

The sensitizing dyes of formulae (I) and (II) may be in any silver halide emulsions, but are preferably in blue-sensitive silver halide emulsions.

Of the sensitizing dyes of formulae (I) and (II), preferred are those of formula (II) for use in the invention.

The amount of the sensitizing dye to be added to emulsions varies depending on the morphology and the size of the silver halide grains in the emulsions. Concretely, it may be from $0.5\times10^{-6}$ mols to $1.0\times10^{-2}$ mols, or from $1\times10^{-6}$ to $8\times10^{-3}$ mols, or from $1.0\times10^{-6}$ mols to $5.0\times10^{-3}$ mols, per mol of the silver halide. For example, when the grain size of the silver halide grains to be sensitized is from 0.2 to 1.3 μm, the amount of the sensitizing dye to be added to the grains is preferably from $2\times10^{-6}$ to $3.5\times10^{-3}$ mols, more preferably from $7.5\times10^{-6}$ to $1.5\times10^{-3}$ mols.

In the invention, the sensitizing dye may be directly dispersed in emulsions. Alternatively, it may be first dissolved in a suitable solvent such as methyl alcohol, ethyl alcohol, methyl cellosolve, acetone, water, pyridine or a mixed solvent of these, and the resulting solution may be added to emulsions. In this case, additives such as base, acid and surfactantmaybe in the solution. If desired, ultrasonic waves may be used for dissolving the dye. For adding the compound to emulsions, for example, employable are a method of dissolving the compound in a volatile organic solvent, dispersing the resulting solution in a hydrophilic colloid, and adding the resulting dispersion to emulsions, as in U.S. Pat. No. 3,469,987; a method of dispersing the compound in a water-soluble solvent, and adding the resulting dispersion to emulsions, as in JP-B 46-24185; a method of dissolving the compound in a surfactant, and adding the resulting solution to emulsions, as in U.S. Pat. No. 3,822,135; a method of dissolving a red-shift compound and adding the resulting solution to emulsions, as in JP-A51-74624; and a method of dissolving the compound in an acid not substantially containing water, and adding the resulting solution to emulsions, as in JP-A 50-80826. In addition, other methods such as those described in U.S. Pat. Nos. 2,912,343, 3,342,605, 2,996,287, 3,429,835 are also employable herein for adding the compound to emulsions.

The organic solvent to be used in the invention to dissolve the sensitizing dyes includes, for example, methyl alcohol, ethyl alcohol, n-propanol, isopropanol, n-butanol, isobutanol, t-butanol, benzyl alcohol, fluorine-containing alcohol, methyl cellosolve, acetone, pyridine, and their mixed solvents.

When the sensitizing dye of the invention is dissolved in water, or in the organic solvent as above, or in their mixed solvent, it is preferable to add a base thereto. The base may be any of organic bases or inorganic bases, including, for example, amine derivatives (e.g., triethylamine, triethanolamine), pyridine derivatives, sodium hydroxide, potassium hydroxide, sodium acetate, and potassium acetate. One preferred method of dissolving the sensitizing dye in such a solvent comprises adding the dye to a mixed solvent of water and methanol followed by adding thereto triethylamine of which the amount is equimolar to that of the dye.

Photosensitive Material:

The silver halide photographic material of the invention may be a monochromatic photographic material or a color photographic material. Preferably, however, the silver halide emulsions defined in the invention are used in silver halide color photographic materials.

Preferably, the silver halide color photographic material (hereinafter this may be abbreviated as "photographic material") has, on a support, at least one silver halide emulsion layer containing an yellow dye-forming coupler, at least one silver halide emulsion layer containing a magenta dye-forming coupler, and at least one silver halide emulsion layer containing a cyan dye-forming coupler.

In the invention, the silver halide emulsion layer containing an yellow dye-forming coupler functions as an yellow-coloring layer, the silver halide emulsion layer containing a magenta dye-forming coupler functions as a magenta-coloring layer, and the silver halide emulsion layer containing a cyan dye-forming coupler functions as a cyan-coloring layer.

Preferably, the silver halide emulsions to form the yellow-coloring layer, the magenta-coloring layer and the cyan-coloring layer differ from each other in that they are sensitive to light in different wavelength ranges (for example, they are differently sensitive to light in a blue range, light in a green range and light in a red range, respectively).

The photographic material of the invention may have, if desired, additional hydrophilic colloid layers, antihalation layers, interlayers and colorant layers, in addition to the above-mentioned yellow-coloring layer, magenta-coloring layer and cyan-coloring layer.

Preferred embodiments of the silver halide photographic material of the invention are described in detail hereinafter.

Preferably, the silver halide grains to be in the silver halide emulsions for use in the invention are cubic crystal grains substantially with {100} planes or 14-hedral crystal grains (their edges may be rounded or may have higher order planes) or 8-hedral crystal grains, or tabular grains with an aspect ratio of at least 2 of which at least 50% of the total projected area is {100} or {111} plane. The aspect ratio is obtained by dividing the diameter of the circle corresponding to the projected area of the grain by the thickness of the grain.

More preferably, the silver halide grains for use in the invention are cubic grains or tabular grains having {100} plane as the main plane, or tabular grains having {111} plane as the main plane.

The silver halide emulsions for use in the invention are silver chloride, silver bromide, silver iodobromide, or silver chloro(iodo)bromide emulsions. From the viewpoint of their rapid processability, silver chloride, silver chlorobromide, silver chloroiodide or silver chlorobromoiodide emulsions having a silver chloride content of at least 90 mol % are preferred; and silver chloride, silver chlorobromide, silver chloroiodide or silver chlorobromoiodide emulsions having a silver chloride content of at least 98 mol % are more preferred. Of those silver halide emulsions, core/shell grains in which from 0.01 to 0.50 mol %, more preferably from 0.05 to 0.40 mol %, per mol of all silver therein, of a silver iodochloride phase is in the shell are preferred as their sensitivity is high and their latitude in high-intensity exposure is broad. Especially preferred are silver halide grains of which the surface has from 0.2 to 5 mol %, more preferably from 0.5 to 3 mol %, per mol of all silver therein, of a silver bromide-localized phase, as their sensitivity is high and their photographic properties are stable.

Also preferably, the emulsions of the invention contain silver iodide. For introducing iodide ions thereinto, an iodide solution alone is added to the emulsions, or an iodide solution may be added thereto along with a silver salt solution and a high chloride solution. In the latter case, the iodide solution and the high chloride solution may be separately added to the emulsions, or a mixture of the two may be added thereto. The iodide to be added to the emulsions is a soluble salt such as an alkali metal or alkaline earth metal iodide. If desired, iodide ions may be released from organic molecules and may be introduced into the emulsions, as in U.S. Pat. No. 5,389,508. As other iodide sources, fine silver iodide grains may be used.

The iodide solution may be added to the emulsions all at a time in one stage of grain formation, or may be gradually added thereto over a certain period of time in grain formation. The site of the high chloride grains into which iodide ions are to be introduced is restricted for obtaining high-sensitivity and fogless emulsions. When iodide ions are introduced into a deeper site of emulsion grains, the sensitivity of the emulsions increases less. Therefore, it is preferable that the iodide solution is added to the outer site of the emulsion grains by at least 50% of the grain volume, more preferably by at least 70% thereof, most preferably by at least 80% thereof. It is also preferable that the addition of the iodide solution is terminated at the inner site of the emulsion grains by at most 98% of the grain volume, most preferably by at most 96% thereof. When the addition of the iodide solution is terminated at the inner site in some degree from the grain surface, fogless emulsions of higher sensitivity can be obtained.

The iodide ion concentration distribution in the direction of the depth of the grains can be determined in a method of etching/TOF-SIMS (time of flight—secondary ion mass spectrometry), for example, using Phi Evans' TRIFT II Model TOF-SIMS. The method of TOF-SIMS is concretely described in *Surface Analysis Technique Selections—Secondary Ion Mass Spectrometry* (edited by the Surface Chemistry Society of Japan, Maruzen Publishing, 1999). Analyzing emulsion grains through etching/TOF-SIMS reveals the presence of iodide ions having moved toward the grain surface even when the iodide addition is terminated inside the grains. In case where the emulsion grains of the invention contain silver iodide and when they are analyzed through etching/TOF-SIMS, it is preferable that the iodide ion concentration maximum is in the surface of the grains and the iodide ion concentration decreases toward the inside of the grains.

Preferably, the emulsions in the photographic material of the invention has a silver bromide localized phase.

In case where the emulsions have a silver bromide localized phase, it is preferable that the silver halide localized phase having a silver bromide content of at least 10 mol % is epitaxially grown on the grain surface. It is also preferable that the grains have an outermost shell layer having a silver bromide content of at least 1 mol %, near the surface layer thereof.

Preferably, the silver bromide content of the silver bromide localized phase is from 1 to 80 mol %, most preferably from 5 to 70 mol %. Also preferably, the silver content of the silver bromide localized phase is from 0.1 to 30 mol % of all silver that constitutes the silver halide grains, more preferably from 0.3 to 20 mol % thereof.

Also preferably, the silver bromide localized phase contains Group VIII metal complex ions such as iridium ion. The amount of the compound to be added to the phase varies in a broad range, depending on the object of the compound, but is preferably from $10^{-9}$ to $10^{-2}$ mols per mol of the silver halide of the emulsion grains.

Also preferably, in the invention, transition metal ions are added to the silver halide grains while the grains are formed and/or grown, to thereby make the metal ions be introduced into the inside and/or the surface of the silver halide grains. The metal ions for the purpose are preferably transition metal ions, and iron, ruthenium, iridium, osmium, lead, cadmium and zinc are especially preferred for the ions. The metal ions are accompanied by ligands, and more preferably, they are 6-coordinate 8-hedral complexes. In case where the ligands are inorganic compounds, they are preferably cyanide ions, halide ions, thiocyan ions, hydroxide ions, peroxide ions, azide ions, sulfite ions, water, ammonia, nitrosyl ions or thionitrosyl ions. It is preferable that the ligands are coordinated with any of metal ions of iron, ruthenium, iridium, osmium, lead, cadmium or zinc mentioned above, and it is also preferable that different ligands are in one complex molecule.

Especially preferably, the silver halide grains for use in the invention have iridium ions with at least one organic ligand for evading high-intensity reciprocity law failure.

Common to all other transition metals, the organic compounds serving as ligands are preferably linear compounds of which the main chain has at most 5 carbon atoms, and/or 5-membered or 6-membered heterocyclic compounds. More preferably, the organic compounds have, in the molecule, a nitrogen, phosphorus, oxygen or sulfur atom that serves as a ligand atom for metals. Most preferably, they are furans, thiophenes, oxazoles, isoxazoles, thiazoles, isothiazoles, imidazoles, pyarzoles, triazoles, furazanes, pyrans, pyridines, pyridazines, pyrimidines and pyrazines, and those having a basic skeleton of these compounds and having a substituent introduced thereinto are also preferred.

Of those, thiazole ligands are preferred for iridium ions, and 5-methylthiazole is more preferred for them.

One preferred example of the combination of metal ions and ligands is a combination of an iron or ruthenium ion and a cyanide ion. In these compounds, it is preferable that the cyanide ion accounts for more than a half of the coordination number to the center metal, iron or ruthenium, and the remaining ligand site is any of thiocyan, ammonia, water, nitrosyl ion, dimetylsulfoxide, pyridine, pyrazine or 4,4-bipyridine. Most preferably, all the six ligand sites of the center metal are occupied by cyanide ions to construct a hexacyano-iron complex or hexacyano-ruthenium complex. Preferably, such a complex coordinated with cyanide ion ligands is added to silver halide grains in an amount of from $1\times10^{-8}$ mols to $1\times10^{-2}$ mols, most preferably from $1\times10^{-6}$ mols to $5\times10^{-4}$ mols, per mol of silver in the grains, while the grains are formed.

The iridium ions may be combined not only with organic ligands but also with fluoride ions, chloride ions, bromide ions, or iodide ions, preferably with chloride ions or bromide ions.

In addition to those with organic ligands mentioned above, other iridium complexes are also usable in the invention. Concretely, they are $[IrCl^6]^{3-}$, $[IrCl_6]^{2-}$, $[IrCl_5(H_2O)]^{2-}$, $[IrCl_5(H_2O)]^{-}$, $[IrCl_4(H_2O)_2]^{-}$, $[IrCl_4(H_2O)_2]^{0}$, $[IrCl_3(H_2O)_3]^{0}$, $[IrCl_3(H_2O)_3]^{+}$, $[IrBr_6]^{3-}$, $[IrBr_6]^{2-}$, $[IrBr_5(H_2O)]^{2-}$, $[IrBr_5(H_2O)]^{-}$, $[IrBr_4(H_2O)_2]^{-}$, $[IrBr_4(H_2O)_2]^{0}$, $[IrBr_3(H_2O)_3]^{0}$, $[IrBr_3(H_2O)_3]^{+}$.

Preferably, the amount of the iridium complex to be added to the silver halide grains during grain formation is from $1\times10^{-10}$ mols to $1\times10^{-3}$ mols, most preferably from $1\times10^{-8}$ mols to $1\times10^{-5}$ mols, per mol of silver in the grains. In complexes with a center metal of ruthenium or osmium, it is also preferable that the center metal is coordinated with ligands of nitrosyl ions, thionitrosyl ions, water molecules or chloride ions. More preferably, pentachloronitrosyl complexes, pentachlorothionitrosyl complexes or pentachloroaqua complexes are formed; and hexachloro complexes are also preferred.

Preferably, the amount of such a complex to be added to the silver halide grains during grain formation is from $1\times10^{-10}$ mols to $1\times10^{-6}$ mols, more preferably from $1\times10^{-9}$ mols to $1\times10^{-6}$ mols, per mol of silver in the grains.

The metal complexes preferred for use in the invention are described in more detail hereinafter.

For the metal complexes for use in the invention, iridium metal complexes of the following general formula (CI) are preferred. Also preferred are metal complexes of a general formula (CII) mentioned hereinafter.

First described are the iridium metal complexes of formula (CI) preferred for use in the invention.

$$[IrX^I_nL^I_{(6-n)}]^{m-} \quad \text{(CI)}$$

wherein $X^I$ represents a halide ion or a pseudo-halide ion except cyanate ions; $L^I$ represents a ligand, differing from $X^I$; n represents 3, 4 or 5, and m represents an integer of from −4 to +1; from 3 to 5 $X^I$'s may be the same or different; and two or more $L^I$'s, if any, may be the same or different.

The pseudo-halide (halogenoid) ions are ions having properties similar to those of halide ions, including, for example, cyanide ion ($CN^-$), thiocyanate ion ($SCN^-$), selenocyanate ion ($SeCN^-$), tellurocyanate ion ($TeCN^-$), azidodithiocarbonate ion ($SCSN_3^-$), cyanate ion ($OCN^-$), fulminate ion ($ONC^-$), and azide ion ($N_3^-$)

$X^I$ is preferably a fluoride, chloride, bromide, iodide, cyanide, isocyanate, thiocyanate, nitrate, nitride orazide ion, more preferably a chloride or bromide ion. Not specifically defined, $L^I$ may be any of inorganic or organic compounds, and maybe charged or not. Preferably, however, $L^I$ is anon-charged, inorganic or organic compound.

Among the metal complexes of formula (CI), those of the following general formula (CIA) are preferred:

$$[IrX^{IA}_nL^{IA}_{(6-n)}]^{m-} \quad \text{(CIA)}$$

wherein $X^{IA}$ has the same meaning as that of $X^I$ in formula (CI), and its preferred examples are also the same as those of $X^I$ in formula (CI); n and m have the same meanings as those in formula (CI); $L^{IA}$ represents an inorganic ligand, differing from $X^{IA}$, preferably water, OCN, ammonia, phosphine or carbonyl, more preferably water; from 3 to 5 $X^{IA}$'s may be the same or different; and two or more $L^{IA}$'s, if any, may be the same or different.

Among the metal complexes of formula (CI), more preferred are those of the following general formula (CIB):

$$[IrX^{IB}_{n}L^{IB}_{(6-n)}]^{m-} \quad \text{(CIB)}$$

wherein $X^{IB}$ has the same meaning as that of $X^{I}$ in formula (CI) and its preferred examples are also the same as those of $X^{I}$ in formula (CI); n and m have the same meanings as those in formula (CI); $L^{IB}$ represents a ligand having a linear or cyclic hydrocarbon skeleton structure of which a part of the carbon or hydrogen atoms may be substituted with any other atom or atomic group, not including cyanide ions, preferably it is a heterocyclic compound ligand, more preferably a 5-membered ring compound ligand, even more preferably a 5-membered ring compound ligand having at least one nitrogen atom and at least one sulfur atom in its 5-membered ring skeleton; from 3 to 5 $X^{IB}$'s may be the same or different; and two or more $L^{IB}$'s, if any, may be the same or different.

Of the metal complexes of formula (CIB), even more preferred are those of the following general formula (CIC):

$$[IrX^{IC}_{n}L^{IC}_{(6-n)}]^{m-} \quad \text{(CIC)}$$

wherein $X^{IC}$ has the same meaning as that of $X^{I}$ in formula (CI), and its preferred examples are also the same as those of $X^{I}$ in formula (CI); n and m have the same meanings as those in formula (CI); $L^{IC}$ represents a 5-membered ring ligand having at least one nitrogen atom and at least one sulfur atom in its ring skeleton, which may be optionally substituted on the carbon atoms that constitute the ring skeleton, the substituent for it preferably has a smaller volume than an n-propyl group, and preferred examples of the substituent are methyl, ethyl, methoxy, ethoxy, cyano, isocyano, cyanato, isocyanato, thiocyanato, isothiocyanato, formyl, thioformyl, hydroxyl, mercapto, amino, hydrazino, azido, nitro, nitroso, hydroxyamino, carboxyl, carbamoyl, fluoro, chloro, bromo and iodo groups; from 3 to 5 $X^{IC}$'s may be the same or different; and two or more $L^{IC}$'s, if any, may be the same or different.

Preferred examples of the complexes of formula (CI) are mentioned below, to which, however, the invention is not limited.

$[IrCl_5(H_2O)]^{2-}$
$[IrCl_4(H_2O)_2]^{-}$
$[IrCl_5(H_2O)]^{-}$
$[IrCl_4(H_2O)_2]^{0}$
$[IrCl_5(OH)]^{3-}$
$[IrCl_4(OH)_2]^{2-}$
$[IrCl_5(OH)]^{2-}$
$[IrCl_4(OH)_2]^{2-}$
$[IrCl_5(O)]^{4-}$
$[IrCl_4(O)_2]^{5-}$
$[IrCl_5(O)]^{3-}$
$[IrCl_4(O)_2]^{4-}$
$[IrBr_5(H_2O)]^{2-}$
$[IrBr_4(H_2O)_2]^{-}$
$[IrBr_5(H_2O)]^{-}$
$[IrBr_4(H_2O)_2]^{0}$
$[IrBr_5(OH)]^{3-}$
$[IrBr_4(OH)_2]^{2-}$
$[IrBr_5(OH)]^{2-}$
$[IrBr_4(OH)_2]^{2-}$
$[IrBr_5(O)]^{4-}$
$[IrBr_4(O)_2]^{5-}$
$[IrBr_5(O)]^{3-}$
$[IrBr_4(O)_2]^{4-}$
$[IrCl_5(OCN)]^{3-}$
$[IrBr_5(OCN)]^{3-}$
$[IrCl_5(thiazole)]^{2-}$
$[IrCl_4(thiazole)_2]^{-}$
$[IrCl_3(thiazole)_3]^{0}$
$[IrBr_5(thiazole)]^{2-}$
$[IrBr_4(thiazole)_2]^{-}$
$[IrBr_3(thiazole)_3]^{0}$
$[IrCl_5(5\text{-methylthiazole})]^{2-}$
$[IrCl_4(5\text{-methylthiazole})_2]^{-}$
$[IrBr_5(5\text{-methylthiazole})]^{2-}$
$[IrBr_4(5\text{-methylthiazole})_2]^{-}$ Of those, especially preferred is $[IrCl_5(5\text{-methylthiazole})]^{2-}$.

Metal complexes of the following general formula (CII) are also preferred for use in the invention, and these are described hereinafter.

$$[MX^{II}_{n}L^{II}_{(6-n)}]^{m-} \quad \text{(CII)}$$

wherein M represents Cr, Mo, Re, Fe, Ru, Os, Co, Rh, Pd or Pt; $X^{II}$ represents a halide ion; $L^{II}$ represents a ligand, differing from $X^{II}$; n represents 3, 4, 5 or 6, and m represents an integer of from −4 to +1; from 3 to 6 $X^{II}$'s may be the same or different; and two or more $L^{II}$'s, if any, may be the same or different.

$X^{II}$ represents a fluoride ion, a chloride ion, a bromide ion or an iodide ion, and is more preferably a chloride ion or bromide ion. $L^{II}$ may be an inorganic or organic compound, and maybe charged or not, but is preferably a non-charged inorganic compound. More preferably, $L^{II}$ is $H_2O$, NO or NS.

Of the metal complexes of formula (CII), preferred are those of the following general formula (CIIA):

$$[M^{IIA}X^{IIA}_{n}L^{IIA}_{(6-n)}]^{m-} \quad \text{(CIIA)}$$

wherein $M^{IIA}$ represents Re, Ru, Os or Rh; $X^{IIA}$ has the same meaning as that of $X^{II}$ in formula (CII), and its preferred examples are also the same as those of $X^{II}$ in formula (CII); $L^{IIA}$ represents NO or NS when $M^{IIA}$ is Re, Ru or Os, and represents $H_2O$, OH or O when $M^{IIA}$ is Rh; n and m have the same meanings as those in formula (CII); from 3 to 6 $X^{IIA}$'s may be the same or different; and two or more $L^{IIA}$'s, if any, may be the same or different.

Preferred examples of the complexes of formula (CII) are mentioned below, to which, however, the invention is not limited.

$[ReCl_6]^{2-}$
$[ReCl_5(NO)]^{2-}$
$[RuCl_6]^{2-}$
$[RuCl_6]^{3-}$
$[RuCl_5(NO)]^{2-}$
$[RuCl_5(NS)]^{2-}$
$[RuBr_5(NS)]^{2-}$
$[OSCl_6]^{4-}$
$[OsCl_5(NO)]^{2-}$
$[OsBr_5(NS)]^{2-}$
$[RhCl_6]^{3-}$
$[RhCl_5(H_2O)]^{2-}$
$[RhCl_4(H_2O)_2]^{-}$
$[RhBr_6]^{3-}$
$[RhBr_5(H_2O)]^{2-}$
$[RhBr_4(H_2O)_2]^{-}$
$[PdCl_6]^{2-}$
$[PtCl_6]^{2-}$

Of those, especially preferred are $[OsCl_5(NO)]^{2-}$ and $[RhBr_6]^{3-}$.

The above-mentioned metal complexes are anions, and when they form salts with cations, it is preferable that the counter cations are readily soluble in water. Concretely, alkali metal ions such as sodium, potassium, rubidium, cesium and lithium ions, and also ammonium ions and alkylammonium ions are preferred. For use in the invention, these metal complexes may be dissolved in water or in a mixed solvent of water and an organic solvent miscible with water (e.g., alcohols, ethers, glycols, ketones, esters, amides).

Preferably, the metal complex of formula (CI) is added to the system of silver halide grain formation, and its amount to be added is from $1\times10^{-10}$ mols to $1\times10^{-3}$ mols, most preferably from $1\times10^{-8}$ mols to $1\times10^{-5}$ mols per mol of silver. Also preferably, the metal complex of formula (CII) is added to the system of silver halide grain formation, and its amount to be added is from $1\times10^{-11}$ mols to $1\times10^{-6}$ mols, most preferably from $1\times10^{-9}$ mols to $1\times10^{-7}$ mols per mol of silver.

Combining the metal complex of formula (CI) with that of formula (CII) for use herein is one preferred embodiment of the invention.

In the invention, it is preferable that the complex is incorporated into the silver halide grains by directing adding it to the reaction solution in which the grains are formed, or by adding it to an aqueous halide solution to form the grains or to other solutions so that the complex is to be in the reaction solution in which the grains are formed. Also preferably, the methods may be combined for introducing the complex into the silver halide grains.

In case where the complex is incorporated into the silver halide grains, it is preferable that the complex is made to uniformly exist in the grains, but it is also preferable that the complex is made to exist only in the surface layer of the grains or, contrary to this, only inside the grains but not in the surface layer thereof, as in JP-A 4-208936, 2-125245, 3-188437. It is also preferable that the surface layer of the grains is modified with fine grains containing the complex inside them, as in U.S. Pat. Nos. 5,252,451, 5,256,530. If desired, these methods may be combined, and different complexes may be incorporated into one silver halide grain. The halogen composition in the site of the grains into which the complex is incorporated is not specifically defined. For example, the complex may be incorporated into any of the silver chloride layer, the silver chlorobromide layer, the silver bromide layer, the silver iodochloride layer or the silver iodobromide layer of the grains.

Preferably, the mean grain size of the silver halide grains of the silver halide emulsions for use in the invention as well as the mean grain size of the silver halide grains that may be combined with the silver halide emulsions in the invention is from 0.01 μm to 2 μm. The grain size corresponds to the diameter of the circle of which the area is equivalent to the projected area of the grain, and the number average of the grain sizes thus actually measured is the mean grain size.

Also preferably, the grain size distribution of the silver halide grains is as small as possible. Concretely, it is preferable that the silver halide grains are mono-dispersed to have a grain size distribution fluctuation coefficient (this is obtained by dividing the standard deviation of the grain size distribution by the mean grain size) of at most 20%, more preferably at most 15%, even more preferably at most, 10%. For broadening the latitude of the photographic material in processing it, it is also preferable that the mono-dispersed emulsions are blended to form one layer, or are layered to from two or more layers.

Various compounds and precursors may be added to the silver halide emulsions for use in the invention, for preventing the photographic material from being fogged during its production, storage and processing and for stabilizing the photographic properties of the material. Concrete examples of the compounds are described in JP-A 62-215272, pp. 39–72, and they are favorably used in the invention. In addition, 5-arylamino-1,2,3,4-thiatriazole compounds (in which the aryl residue has at least one electron-attractive group) described in EP 0447647 are also preferred for use herein.

For improving the storage stability of the silver halide emulsions for use in the invention, preferably used are hydroxamic acid derivatives described in JP-A 11-109576; cyclic ketones having a double bond substituted with an amino group or a hydroxyl group at the both ends adjacent to the carbonyl group, described in JP-A 11-327094 (in particular, compounds of general formula (S1) described in paragraphs 0036 to 0071 are preferably incorporated in the invention); sulfo-substituted catechols and hydroquinones described in JP-A 11-143011 (e.g., 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid and their salts); and water-soluble reducing agents of general formulae (I) to (III) described in JP-A 11-102045.

The silver halide emulsions for use in the invention are generally chemically sensitized. The chemical sensitization includes sulfur sensitization typically with instable sulfur compounds, noble metal sensitization such as gold sensitization, and reduction sensitization, and these may be effected individually or as combined.

For the compounds for chemical sensitization, preferred are those described in JP-A 62-215272, from page 18, right lower column to page 22, right upper column. In particular, gold sensitization is more preferred in the invention. Subjected to gold sensitization, the photographic properties of silver halide emulsions fluctuate little in scanning exposure to lasers.

In gold sensitization of the silver halide emulsions for use in the invention, various inorganic gold compounds, gold(I) complexes having an inorganic ligand, and gold(I) compounds having an organic ligand can be used. For the inorganic gold compounds, for example, preferred are chloroauric acid and its salts; and for the gold(I) complexes having an inorganic ligand, for example, preferred are gold dithiocyanate compounds such as potassium gold(I) dithiocyanate, and gold dithiosulfate compounds such as trisodium gold(I) dithiosulfate.

For the gold(I) compounds having an organic ligand, for example, usable are bisgold(I) mesoionoheterocyclic compounds described in JP-A 4-267249, such as gold(I) tetrafluoroborate bis(1,4,5-trimethyl-1,2,4-triazolium-3-thiolate); organic mercapto-gold(I) complexes described in JP-A 11-218870, such as potassium bis(1-[3-(2-sulfonatobenzamido)phenyl]-5-mercaptotetrazole potassium salt) aurate(I) 5-hydrate; and gold(I) compounds with a nitrogen compound anion ligand described in JP-A 4-268550, such as gold(I) sodium bis(1-methylhydantoinate) 4-hydrate. In addition, also usable herein are gold(I) thiolate compounds described in U.S. Pat. No. 3,503,749; gold compounds described in JP-A 8-69074, 8-69075, 9-269554; and compounds described in U.S. Pat. Nos. 5,620,841, 5,912,112, 5,620,841, 5,939,245, 5,912,111.

The amount of the compound to be added to the silver halide emulsions varies in a broad range in different cases, but is generally from $5\times10^{-7}$ to $5\times10^{-3}$ mols, preferably from $5\times10^{-6}$ to $5\times10^{-4}$ mols per mol of the silver halide.

Colloidal gold sulfide is also usable, and its production is described in Research Disclosure 37154; *Solid State Ionics*, Vol. 79, pp. 60–66, 1995; and *Compt. Rend. Hebt. Seances, Acad. Sci*. Sect. B, Vol. 263, p. 1328, 1996. Colloidal gold sulfide grains of all sizes are usable, and those having a grain size of at most 50 nm can be used.

Its amount to be added to silver halide emulsions varies in a broad range, but is generally from $5\times10^{-7}$ to $5\times10^{-3}$ mols, preferably from $5\times10^{-6}$ to $5\times10^{-4}$ mols in terms of the gold atom, per mol of the silver halide.

In the invention, the gold sensitization may be combined with any other chemical sensitization of, for example, sulfur sensitization, selenium sensitization, tellurium sensitization, reduction sensitization or noble metal sensitization with a noble metal compound except gold compounds.

Preferably, dyes that are decolorable by processing such as those described in EP 0337490A2, pp. 27–76 (especially preferably, oxonole dyes, cyanine dyes) are added to the hydrophilic colloid layers in the photographic material of the invention for anti-irradiation and antihalation and for improving the safety to safelights. In addition, the dyes described in EP 0819977 are also favorable to the invention. Some of these water-soluble dyes will worsen the color separation and the safety to safelights of photographic materials if their amount added increases. Water-soluble dyes described in JP-A 5-127324, 5-127325, 5-216185 are preferred, as they do not worsen the color separation of photographic materials.

In place of the water-soluble dyes or along with them, a colorant layer that is decolorable by processing may be in the photographic material of the invention. The decolorable colorant layer may be directly adjacent to the emulsion layers in the photographic material, or may be adjacent thereto via an interlayer that contains a color mixing preventing agent such as gelatin or hydroquinone. Preferably, the colorant layer is below the emulsion layer that forms a primary color of the same type as that of the color of the colorant (to be nearer to the support than that emulsion layer). The colorant layer or layers of the type may be combined with every emulsion layer that forms the corresponding primary color, or may be combined with any of the emulsion layers in the photographic material. The colorant layer may be so designed that it corresponds to different emulsion layers that form different primary colors. Preferably, the optical reflection density of the colorant layer is from 0.2 to 3.0, more preferably from 0.5 to 2.5, even more preferably from 0.8 to 2.0, at the wavelength at which its optical density is the highest in the wavelength range for exposure (the visible light range of from 400 nm to 700 nm in ordinary printer exposure, or the wavelength range of the scanning exposure light source in scanning exposure).

For forming the colorant layer, any known method is employable. For example, a fine dispersion of solid dye particles is added to a hydrophilic colloid layer, as in JP-A 2-282244, from page 3, right upper column to page 8 or in JP-A 3-7931, from page 3, right upper column to page 11, left lower column; or a cationic polymer is mordanted with an anionic dye; or a dye is adsorbed by fine grains such as fine silver halide grains so as to be fixed in a layer; or colloidal silver is used as in JP-A 1-239544.

For dispersing fine solid dye powder in hydrophilic colloid, for example, a method of dispersing a dye powder that is substantially insoluble in water at a pH of 6 or less but is substantially soluble in water at a pH of 8 or more, in hydrophilic colloid is described in JP-A 2-308244, pp. 4–13. The method of mordanting a cationic polymer with an anionic dye is described in, for example, JP-A 2-84637, pp. 18–26. The method of preparing colloidal silver that serves as a light absorbent is described in U.S. Pat. No. 2,688,601, 3,459,563. Of those methods, the method of dispersing a dye powder in hydrophilic colloid and the method of using colloidal silver are preferred.

The total amount of gelatin in the silver halide color photographic material is preferably from 3 g/m$^2$ to 6 g/m$^2$, more preferably from 3 g/m$^2$ to 5 g/m$^2$. The total thickness of the photographic constituent layers is preferably from 3 μm to 7.5 μm, more preferably from 3 μm to 6.5 μm. The dry film thickness of the photographic material may be measured and evaluated, based on the thickness change before and after the dry film has been peeled away from the support, or by observing and measuring the cross section of the photographic material with an optical microscope or an electronic microscope. Preferably, the swollen film thickness of the photographic material of the invention is from 8 μm to 19 μm, more preferably from 9 μm to 18 μm. For measuring the swollen film thickness, a dry sample of the photographic material is dipped in an aqueous solution at 35° C., and after the sample has been well swollen to reach a state of equilibrium, its thickness is measured according to a multi-point recording method. Preferably, the silver amount in the yellow-coloring photosensitive silver halide emulsion layer in the photographic material of the invention is from 0.1 g/m$^2$ to 0.23 g/m2, more preferably from 0.1 g/m$^2$ to 0.19 g/m$^2$. Also preferably, the total silver amount in the photographic material is from 0.2 g/m$^2$ to 0.5 g/m$^2$, more preferably from 0.2 g/m$^2$ to 0.45 g/m$^2$, most preferably from 0.2 g/m$^2$ to 0.40 g/m$^2$.

Preferably, the color photographic material of the invention has at least one yellow-coloring silver halide emulsion layer, at least one magenta-coloring silver halide emulsion layer, and at least one cyan-coloring silver halide emulsion layer. In general, the yellow-coloring silver halide emulsion layer, the magenta-coloring silver halide emulsion layer and the cyan-coloring silver halide emulsion layer are in that order on the support.

However, the layer constitution is not limited to the above, and may differ from it.

The yellow coupler-containing silver halide emulsion layer may be in any site on the support. However, when the yellow coupler-containing layer contains tabular silver halide grains, it is preferable that the layer is remoter from the support than at least one of the magenta coupler-containing silver halide emulsion layer and the cyan coupler-containing silver halide emulsion layer. For rapid color development and desilvering and for complete decoloration of sensitizing dyes, it is preferable that the yellow coupler-containing silver halide emulsion layer is the remotest of the other silver halide emulsion layers from the support. In addition, for preventing blix (bleaching and fixing) discoloration, the cyan coupler-containing silver halide emulsion layer is preferably in the center of the silver halide emulsion layers; and for preventing discoloration by light, the cyan coupler-containing silver halide emulsion layer is preferably the lowermost of all the layers. Each of the yellow, magenta and cyan-coloring layers may have a two-layered or three-layered structure. It is also preferable that a coupler layer not containing a silver halide emulsion is provided adjacent to the silver halide emulsion layers so that it may acts as a coloring layer, for example, as in JP-A 4-75055, 9-114035, 10-246940, and U.S. Pat. No. 5,576,159.

For the silver halide emulsions and their materials (e.g., additives) to be used in the invention, the photographic constituent layers (e.g., their layer arrangement) in the photographic material of the invention, as well as the methods for processing the photographic material and the additives to be used in the processing methods, for example, those described in JP-A 62-215272, 2-33144, and EP 0355660A2, especially those described in EP 0355660A2 are favorable to the invention. In addition, silver halide color photographic materials and the methods for processing them described in JP-A 5-34889, 4-359249, 4-313753, 4-270344, 5-66527, 4-34548, 4-145433, 2-854, 1-158431, 2-90145, 3-194539, 2-93641, and EP 0520457A2 are also favorable to the invention.

In particular, for the reflective support and the silver halide emulsions, the hetero metal ions to be doped into the silver halide grains, the storage stabilizers and the antifogging agents for the silver halide emulsions, the chemical sensitization methods (sensitizing agents), the spectral sensitization methods (color-sensitizing agents), the cyan, magenta and yellow couplers and the methods for emulsifying and dispersing them, the color image storability improvers (stain inhibitors and anti-fading agents), the dyes (in colorant layers), various gelatins, the layer constitution in photographic materials, and the film pH of photographic materials, those described in patent specifications mentioned below are preferably referred to in carrying out the invention.

For the cyan, magenta and yellow couplers for use in the invention, those described in JP-A 62-215272, from page 91, right upper column, line 4 to page 121, left upper column, line 6; JP-A 2-33144, from page 3, right upper column, line 14 to page 18, left upper column, last line, and from page 30, right upper column, line 6 to page 35, right lower column, line 11; and EP 0355660A2, page 4, lines 15 to 27, from page 5, line 30 to page 28, last line, page 45, lines 29 to 31, and from page 47, line 23 to page 63, line 50 are also usable.

The compounds of formulae (II) and (III) described in WO-98/33760, and the compounds of formula (D) described in JP-A 10-221825 may also be added to the photographic material of the invention, and adding them thereto is favorable.

For the cyan dye-forming couplers for use in the invention (hereinafter this may be abbreviated as "cyan couplers") preferred are pyrrolotriazole couplers, and especially preferred are couplers of formulae (I) and (II) in JP-A 5-313324, couplers of formula (I) in JP-A 6-347960, and couplers exemplified in these patent specifications.

Also preferred for use herein are phenol and naphthol cyan couplers, for example, cyan couplers of formula (ADF) described in JP-A 10-333297.

TABLE 1

| Elements | JP-A 7-104448 | JP-A 7-77775 | JP-A 7-301895 |
|---|---|---|---|
| Reflective Support | col. 7, line 12 to col. 12, line 19 | col. 35, line 43 to col. 44, line 1 | col. 5, line 40 to col. 9, line 26 |
| Silver Halide Emulsions | col. 72, line 29 to col. 74, line 18 | col. 44, line 36 to col. 46, line 29 | col. 77, line 48 to col. 80, line 28 |
| Hetero Metal Ions | col. 74, lines 19 to 44 | col. 46, line 30 to col. 47, line 5 | col. 80, line 29 to col. 81, line 6 |
| Storage Stabilizers, Anti-fogging Agents | col. 75, lines 9–18 | col. 47, lines 20–29 | col. 18, line 11 to col. 31, line 37 (especially, mercapto-heterocyclic compounds) |
| Chemical Sensitization (Chemical Sensitizers) | col. 74, line 45 to col. 75, line 6 | col. 47, lines 7–17 | col. 81, lines 9–17 |
| Spectral Sensitization (Color Sensitizers) | col. 75, line 19 to col. 76, line 45 | col. 47, line 30 to col. 49, line 6 | col. 81, line 21 to col. 82, line 48 |
| Cyan Couplers | col. 12, line 20 to col. 39, line 49 | col. 62, line 50 to col. 63, line 16 | col. 88, line 49 to col. 89, line 16 |
| Yellow Couplers | col. 87, line 40 to col. 88, line 3 | col. 63, lines 17–30 | col. 89, lines 17 to 30 |
| Magenta Couplers | col. 88, lines 4–18 | col. 63, line 3 to col. 64, line 11 | col. 31, line 34 to col. 77, line 44; col. 88, lines 32–46 |
| Coupler Emulsification and Dispersion | col. 71, line 3 to col. 72, line 11 | col. 61, lines 36–49 | col. 87, lines 35–48 |
| Color Image Storability Improvers (stain inhibitors) | col. 39, line 50 to col. 70, line 9 | col. 61, line 50 to col. 62, line 49 | col. 87, line 49 to col. 88, line 48 |
| Anti-fading Agents | col. 70, line 10 to col. 71, line 2 | | |
| Dyes (colorants) | col. 77, line 42 to col. 78, line 41 | col. 7, line 14 to col. 19, line 42; col. 50, line 3 to col. 51, line 14 | col. 9, line 27 to col. 18, line 10 |
| Gelatins | col. 78, lines 42–48 | col. 51, lines 15–20 | col. 83, lines 13–19 |
| Layer Constitution in Photographic Materials | col. 39, lines 11–26 | col. 44, lines 2–35 | col. 31, line 38 to col. 32, line 33 |
| Film pH of Photographic Materials | col. 72, lines 12–28 | | |
| Scanning Exposure | col. 76, line 6 to col. 77, line 41 | col. 49, line 7 to col. 50, line 2 | col. 82, line 49 to col. 83, line 12 |
| Preservatives in Developers | col. 88, line 19 to col. 89, line 22 | | |

In addition to the cyan couplers mentioned above, also preferred for use herein are pyrroloazole cyan couplers described in EP 0488248 and 0491197A1; 2,5-diacylaminophenol couplers described in U.S. Pat. No. 5,888,716; pyrazoloazole cyan couplers having an electron-attractive group or a hydrogen-bonding group at the 6-position, described in U.S. Pat. Nos. 4,873,183 and 4,916,051; especially pyrazoloazole cyan couplers having a carbamoyl group at the 6-position, described in JP-A 8-171185, 8-311360, 8-339060.

Also usable herein are diphenylimidazole cyan couplers described in JP-A 2-33144; 3-hydroxypyridine cyan couplers described in EP 0333185A1 (especially 2-equivalent couplers derived from a 4-equivalent coupler, Coupler (42), by introducing a chloride-leaving group thereinto, as well as Couplers (6) and (9) exemplified therein); cyclic active methylene cyan couplers described in JP-A 64-32260 (especially Couplers 3, 8 and 34 exemplified therein); pyrrolopyrazole cyan couplers described in EP 0456226A1; and pyrroloimidazole cyan couplers described in EP 0484909.

For cyan couplers for use herein, especially preferred are pyrroloazole cyan couplers of formula (I) described in JP-A 11-282138; and the description in paragraphs 0012 to 0059 in the patent specification including Cyan Couplers (1) to (47) exemplified therein directly applies to the invention and is favorable for a part of the invention.

For the magenta dye-forming couplers for use in the invention (hereinafter this may be abbreviated as "magenta couplers"), usable are 5-pyrazolone magenta couplers and pyrazoloazole magenta couplers such as those referred to in the Table mentioned above. Above all, especially preferred are pyrazolotriazole couplers having a secondary or tertiary alkyl group directly bonding to the 2, 3 or 6-position of the pyrazolotriazole ring, described in JP-A 61-65245; pyrazoloazole couplers having a sulfonamido group in the molecule, described in JP-A 61-65246; pyrazoloazole couplers having an alkoxyphenylsulfonamido ballast group, described in JP-A 61-147254; and pyrazoloazole couplers having a 6-positioned alkoxy or aryloxy group, described in EP 226849A and 294785A, in view of their color hue, image stability and color-forming capability. In particular, for the magenta couplers for use herein, preferred are pyrazoloazole couplers of formula (M-1) described in JP-A 8-122984; and the description in paragraphs 0009 to 0026 in the patent specification directly applies to the invention, and it may be a part of the specification of the invention. In addition, pyrazoloazole couplers having a steric hindrance group at both the 3- and 6-positions, described in EP 854384 and 884640, are also preferred for use in the invention.

For the yellow dye-forming couplers for use in the invention (hereinafter this may be abbreviated as "yellow couplers"), preferred are acylacetamide yellow couplers having a 3- to 5-membered, cyclic acyl group, described in EP 0447969A1; malondianilide yellow couplers having a cyclic structure, described in EP 0482552A1; pyrrol-2 or 3-yl or indol-2 or 3-ylcarbonylacetanilide couplers described in EP 953870A1, 953871A1, 953872A1, 953873A1, 953874A1, 953875A1; dioxane structure-having acylacetamide yellow couplers described in U.S. Pat. No. 5,118,599, in addition to the compounds referred to in the above-mentioned Table. Above all, acylacetamide yellow couplers in which the acyl group is a 1-alkylcyclopropane-1-carbonyl group; and malondianilide yellow couplers in which one anilide forms an indoline ring are especially preferred. These couplers may be used singly or as combined.

Preferably, the coupler is infiltrated into a loadable latex-polymer (for example, as in U.S. Pat. No. 4,203,716) in the presence (or absence) of the high-boiling-point organic solvent described in the above-mentioned Table, or dissolved therein along with a water-insoluble and organic solvent-soluble polymer, and emulsified and dispersed in an aqueous hydrophilic colloid solution. For the water-insoluble and organic solvent-soluble polymer, preferred are homopolymers and copolymers described in U.S. Pat. No. 4,857,449, columns 7–15, and WO88/00723, pp. 12–30. More preferred are methacrylate or acrylamide polymers, especially acrylamide polymers, in view of their color image stability.

In the invention, any known color mixing preventing agents are usable. In particular, those described in the patent specifications mentioned below are preferable for use herein.

For example, herein usable are high-molecular redox compounds described in JP-A 5-333501; phenidone and hydrazine compounds described in U.S. Pat. No. 4,923,787 and WO 98/33760; and white couplers described in JP-A 5-249637, 10-282615 and German Patent 19629142A1. In case where the pH of the developer used is increased for development acceleration, preferred are redox compounds described in GP 19618786A1, EP 839623A1, 842975A1, GP 19806846A1, and French Patent 2760460A1.

For the UV absorbent for use in the invention, preferred are compounds having a triazine skeleton and having a high molar absorption coefficient. For example, the compounds described in the patent specifications mentioned below are usable. Preferably, these are added to the photosensitive layers and/or non-photosensitive layers. For example, the compounds are described in JP-A 46-3335, 55-152776, 5-197074, 5-232630, 5-307232, 6-211813, 8-53427, 8-234364, 8-239368, 9-31067, 10-115898, 10-147577, 10-182621, GP 19739797A, EP 711804A, and International Patent Publication No. 8-501291.

For the binder and the protective colloid for the photographic material of the invention, gelatin is preferred. Any other hydrophilic colloid except gelatin may also be used alone or combined with gelatin. Preferably, gelatin for use herein contains few heavy metal impurities such as iron, copper, zinc and manganese, and the heavy metal content thereof is preferably at most 5 ppm, more preferably at most 3 ppm. The calcium content of the photographic material is preferably at most 20 mg/m$^2$, more preferably at most 10 mg/m$^2$, most preferably at most 5 mg/m$^2$.

Preferably, an antibacterial and antifungal agent such as those described in JP-A 63-271247 is added to the hydrophilic colloid layers of the photographic material of the invention for preventing various fungi and bacteria from growing in the layers to worsen the quality of the images formed. Also preferably, the film pH of the photographic material is from 4.0 to 7.0, more preferably from 4.0 to 6.5.

In the invention, a surfactant may be added to the photographic material for improving the stability in layer coating, for preventing the material from being statically charged and for controlling the charging degree of the material. The surfactant may be any of anionic surfactants, cationic surfactants, betaine surfactants and nonionic surfactants, and those described in JP-A 5-333492 may be used. Fluorine-containing surfactants are preferred for use in the invention. Fluorine-containing surfactants may be used alone or combined with any other known surfactants, but preferably they are combined with other known surfactant. The amount of the surfactant to be added to the photographic material is not specifically defined, but is generally from $1\times10^{-5}$ to 1 g/m$^2$, preferably from $1\times10^{-4}$ to $1\times10^{-1}$ g/m$^2$, more preferably from $1\times10^{-3}$ to $1\times10^{-2}$ g/m$^2$.

Method of Image Formation:

An image may be formed on the photographic material of the invention in a process that comprises an exposure step of exposing the material to light in accordance with image information and a developing step of developing the thus-exposed material.

The method of forming an image on the silver halide color photographic material of the invention is characterized in that the entire process from the start of color development to the end of drying takes at most 90 seconds.

The photographic material of the invention is used not only in a print system using an ordinary negative printer but also in a scanning exposure system using a cathode ray tube (CRT) The cathode ray tube exposure device is simple, compact and inexpensive, as compared with other devices using laser. In this, in addition, the optical axis and the color are easy to control. The cathode ray tube for image exposure is optionally equipped with various emitters of emitting light in different spectral ranges. For example, one or more of red emitters, green emitters and blue emitters are incorporated in the cathode ray tube. The spectral ranges are not limited to red, green and blue, and phosphors capable of emitting yellow, orange, violet or infrared light may be incorporated in the cathode ray tube. In particular, cathode ray tubes having these emitters as combined to emit white light are often used.

In case where the photographic material has different photosensitive layers having different spectral sensitivity distributions and where the cathode ray tube used is equipped with different phosphors capable of emitting light in different spectral ranges, the different photosensitive layers of the material may be exposed all at a time to form the intended colors, for which different color image signals are inputted into the cathode ray tube to emit light in different spectral ranges. Alternatively to this, different color image signals may be inputted one after another into the cathode ray tube to emit the respective color lights in order, to which the photographic material is exposed via a color filter that cuts off the other color lights (sequential exposure). In general, the system of sequential exposure is preferred for obtaining high-quality images, since high-resolution cathode ray tubes can be used therein.

For exposing the photographic material of the invention, preferably used is a digital scanning exposure system that uses monochromatic high-density light from a gas laser, a light-emitting diode, a semiconductor laser, or a secondary harmonic generator (SHG) comprising a combination of a semiconductor laser or a solid laser with a semiconductor laser serving as an exciting light source, and anon-linear optical crystal. For compact and inexpensive systems, preferred are a semiconductor layer, or a secondary harmonic generator (SHG) that comprises a combination of a semiconductor laser or a solid laser and a non-linear optical crystal. For planning more compact, more inexpensive and more stable devices having a longer life, especially preferred is a semiconductor laser. In particular, it is preferable that at least one exposure light source is a semiconductor laser.

In case where the scanning exposure light source of the type is used, the spectral sensitivity maximum wavelength of the photographic material of the invention can be defined in any desired manner depending on the wavelength of the scanning exposure light source used. In the SHG light source that comprises a combination of a solid laser with a semiconductor laser serving as an exciting light source or a semiconductor laser itself and a non-linear optical crystal, the laser oscillation wavelength may be halved, and therefore the SHG light source gives blue light and green light. Accordingly, the spectral sensitivity maximum of the photographic material to be exposed to such a SHG light source may be in ordinary three wavelength ranges of blue, green and red. The exposure time in such scanning exposure, which is defined as the time of exposure to give a pixel density of 400 dpi, is preferably not longer than $10^{-4}$ seconds, more preferably not longer than $10^{-6}$ seconds.

One photographic layer may be exposed plural times, preferably at least three times. More preferably, the exposure time is from $10^{-8}$ to $10^{-4}$ seconds. When the exposure time is from $10^{-8}$to $10^{-5}$ seconds, it is preferable that one photographic layer is exposed at least 8 times. The light source may be any of a gas laser, a solid laser (LD), LED (inorganic or organic), or an Xe source with a reduced spot. Especially preferred are a solid layer and LED. The light source must be spectrally divided into the sensitive wavelength ranges for the respective color-forming layers, for which a suitable color filter (containing dye therein or having dye deposited thereon) may be used or the oscillation wavelength range of LD or LED may be selected. In addition, the two may be combined. The spot diameter of the light source is not specifically defined, but is preferably from 5 to 250 μm in terms of the half-value width of the light intensity, more preferably from 10 to 100 μm. The shape of the spot may be any of circular, oval or rectangular forms. The light quantity distribution in one spot may be a Gauss distribution, or may also be trapezoidal having a relatively constant light intensity. In particular, one light source may be used, or an array of light sources may also be used.

In general, the photographic material of the invention is exposed in a mode of scanning exposure, for which the light source may be scanned or the photographic material may be scanned, or both the two may be scanned. One exposure time is defined by the following formula:

Exposure Time=Spot Diameter/Moving Speed of Light Source (or Moving Speed of Photographic Material)

In this, the spot diameter is the diameter (half-value width, unit: μm) of the spot in the direction in which the light source used for scanning exposure moves during exposure. the moving speed of the light source is the speed (unit: μm/sec) at which the light source used for scanning exposure moves in a unit time. In general, the spot diameter does not need to be the same as the pixel diameter, and may be larger or smaller than it. The exposure frequency referred to in the invention is meant to indicate the number of exposure times for which one photosensitive color-forming layer for one point (pixel) on the photographic material is exposed to light to which the layer is sensitive. In case where the photographic material is exposed plural times, the exposure frequency of the material indicates the exposure times for which the material is exposed to light having an intensity of at least ⅕ of the maximum exposure light intensity. Accordingly, the light having an intensity of smaller than ⅕ of the maximum exposure light intensity, the stray light and the overlapping spot light shall be excluded from the exposure frequency.

In processing it, the silver halide color photographic material of the invention is preferably combined with the exposing and developing systems described in known references mentioned below. The developing systems applicable to the photographic material of the invention are automatic printing and developing systems described in JP-A 10-333253; photographic material conveying devices described in JP-A 2000-10206; recording systems including image-reading devices described in JP-A 11-215312; exposing systems for color image recording described in JP-A 11-88619 and 10-202950; digital photoprinting systems including remote medical diagnosis described in JP-A 10-210206; and photoprinting systems including image-recording devices described in Japanese Patent Application No. 10-159187.

The scanning exposure systems preferably applicable to the invention are described in detail in the patent specifications listed in the above-mentioned Table 1.

In case where the photographic material of the invention is exposed to light in printers, a band stop filter such as that described in U.S. Pat. No. 4,880,726 is preferably used. This removes light mixture and significantly improves the color reproducibility of the photographic material.

Before image information is imparted thereto, the photographic material of the invention may be pre-exposed through an yellow micro-dot pattern for copy guard, as in EP 0789270A1 and 0789480A1.

Process of Development:

Next described is the process of developing the photographic material of the invention.

For processing the photographic material of the invention, the processing materials and the processing methods described in JP-A 2-207250, from page 26, right lower column, line 1 to page 34, right upper column, line 9; and JP-A 4-97355, from page 5, left upper column, line 17 to page 18, right lower column, line 20 are preferably employed.

After being exposed to light, the photographic material of the invention may be developed, for example, as follows: This may be processed in a wet system, for example, by developing it with a conventional developer containing an alkali agent and a developing agent, or by incorporating a developing agent into the photographic material and developing it with an activator such as an alkali solution not containing a developing agent. It may also be processed in a thermal system not using a processing solution. In particular, the activator method is preferable since the processing solution to be used therein does not contain a developing agent and is therefore easy to manage and handle. In addition, since the load for treating the waste therein is reduced, the activator method is favorable for environmental protection.

In the activator method, the developing agent or its precursor to be incorporated into the photographic material is preferably a hydrazine compound such as those described in JP-A 8-234388, 9-152686, 9-152693, 9-211814, 9-160193.

A developing method of using hydrogen peroxide for image amplification (intensification) is also preferred, as the silver amount in the photographic material to be processed in the method may be reduced. In particular, it is preferable to combine this method with the activator method. Concretely, the image formation method using a hydrogen peroxide-containing activator solution described in JP-A 8-297354 and 9-152695 is preferred. In the activator method, the photographic material is, after processed with an activator solution, generally desilvered. However, in the image amplification method of processing low-silver photographic materials, the desilvering step may be omitted, and the processed photographic materials may be simply rinsed in water or stabilized. In a system of reading the image information from photographic materials with a scanner, the desilvering step may also be omitted even when high-silver photographic materials such as those for picture-taking are processed.

The processing materials such as activator solutions, desilvering solutions (bleaching/fixing solutions) and rinsing and stabilizing solutions, and the processing methods for the photographic material of the invention may be any known ones. Preferably, those described in Research Disclosure Item 36544 (September, 1994), pp. 536–541, and JP-A 8-234388 are employed in the invention.

In case where the developer and the development replenisher for use in the invention contains a color-developing agent, preferred examples of the color-developing agent therein are known aromatic primary amine color developing agents, especially p-phenylenediamine derivatives. Typical examples of the developing agent are mentioned below, to which, however, the invention is not limited.

1) N,N-diethyl-p-phenylenediamine
2) 4-amino-3-methyl-N,N-diethylaniline
3) 4-amino-N-(β-hydroxyethyl)-N-methylaniline
4) 4-amino-N-ethyl-N-(β-hydroxyethyl)aniline
5) 4-amino-3-methyl-N-ethyl-N-(β-hydroxyethyl)aniline
6) 4-amino-3-methyl-N-ethyl-N-(3-hydroxypropyl)aniline
7) 4-amino-3-methyl-N-ethyl-N-(4-hydroxybutyl)aniline
8) 4-amino-3-methyl-N-ethyl-N-(β-methanesulfonamidoethyl)aniline
9) 4-amino-N,N-diethyl-3-(β-hydroxyethyl)aniline
10) 4-amino-3-methyl-N-ethyl-N-(β-methoxyethyl)aniline
11) 4-amino-3-methyl-N-(β-ethoxyethyl)-N-ethylaniline
12) 4-amino-3-methyl-N-(3-carbamoylpropyl)-N-n-propylaniline
13) 4-amino-3-methyl-N-(4-carbamoylbutyl)-N-n-propylaniline
14) N-(4-amino-3-methylphenyl)-3-hydroxypyrrolidine
15) N-(4-amino-3-methylphenyl)-3-(hydroxymethyl)pyrrolidine
16) N-(4-amino-3-methylphenyl)-3-pyrrolidinecarboxamide Of the p-phenylenediamine derivatives mentioned above, especially preferred are Compounds 5), 6), 7), 8) and 12); and more preferred are Compounds 5) and 8). When solid, the p-phenylenediamine derivatives are generally in the form of their salts such as sulfates, hydrochlorides, sulfites, naphthalenedisulfonates, or p-toluenesulfonates. The concentration of the aromatic primary amine developing agent in developers and replenishers is preferably from 2 mmols to 200 mmols, more preferably from 12 mmols to 200 mmols, even more preferably from 12 mmols to 150 mmols per liter of developer. Replenishers are planned so that the concentration of the developing agent therein is higher than that in developers for compensating the consumption of the developing agent during development. Therefore, the concentration of the developing agent in replenishers is determined in consideration of the balance between the supply of the developing agent through replenishment and the consumption thereof during development, the carryover to the next bath, and the overflow loss, so that the concentration of the developing agent in developer baths is kept constant all the time during development. Accordingly, in one preferred embodiment of low-replenishment in the invention, the concentration of the developing agent in the replenisher is kept high in order that a small amount of the replenisher can be enough for the necessary replenisher supply.

Depending on the type of the photographic material to be processed in the invention, the developer may contain a small amount of sulfite ions, or may not substantially contain them. This is because sulfite ions have a significant preservative effect, but on the contrary, they often have some negative influences on the photographic properties of some photographic materials during development. Hydroxylamines may also be in the developer or may not therein, depending on the type of the photographic material to be processed. This is because hydroxylamines have a function as a preservative for developers, but they are active for silver development by themselves and often have some negative influences on the photographic properties of some photographic materials during development.

Preferably, the color developer for use in the invention contains an inorganic preservative or an organic preservative such as hydroxylamines or sulfite ions mentioned above. The organic preservative broadly includes organic compounds which, when added to the processing solutions for photographic materials, act to prevent the aromatic primary amine color developing agents in the processing solutions from being degraded. In other words, the organic compounds for preservatives have the function of preventing aerial oxidation of color developing agents. Especially effective organic preservatives are hydroxylamine derivatives, hydroxamic acids, hydrazides, phenols, α-hydroxyketones, α-aminoketones, saccharides, monoamines, diamines, polyamines, quaternary ammonium salts, nitroxy radicals, alcohols, oximes, diamide compounds, and condensed cyclic amines. These are described in, for example, JP-A 63-4235, 63-30845, 63-21647, 63-44655, 63-53551, 63-43140, 63-56654, 63-58346, 63-43138, 63-146041, 63-44657, 63-44656; U.S. Pat. Nos. 3,615,503, 2,494,903; JP-A 52-143020, JP-B 48-30496.

Preferred preservatives for developers are also described in the patent specifications listed in the above-mentioned Table.

Other preservatives also usable herein are various metal compounds described in JP-A 57-44148, 57-53749; salicylicacids described in JP-A 59-180588; alkanolamines described in JP-A 54-3532; polyethyleneimines described in JP-A 56-94349; aromatic polyhydroxy compounds described in U.S. Pat. No. 3,746,544. Of those, alkanolamines are effective for enhancing the storage stability of developers and replenishers themselves or their thick stocks to be supplied as processing agents.

Alkanolamines especially effective for enhancing the storage stability of developers, replenishers and their thick stocks are triisopropanolamine, diisopropanolamine, monoisopropanolamine and diethanolamine; and triisopropanolamine is especially preferred. Apart from them, triethanolamines are also preferred. The amount of the alkanolamine to be added to processing solutions may be from 0.01 to 1 mol, preferably from 0.02 to 0.2 mols per mol of the processing solution.

In addition, hydroxylamine derivatives, for example, substituted or unsubstituted dialkylhydroxylamines such as disulfoethylhydroxylamine or diethylhydroxylamine, as well as aromatic polyhydroxy compounds are also preferred for preservatives. Of the organic preservatives mentioned above, hydroxylamine derivatives are especially preferred, and their details are described in JP-A 1-97953, 1-186939, 1-186940, 1-187557. In particular, combining hydroxylamine derivatives and amines is preferred for improving the stability of color developers, especially for improving the stability thereof in continuous processing. Other amines also usable for preservatives are cyclic amines described in JP-A 63-239447; amines described in JP-A63-128340; and amines described in JP-A 1-186939, 1-187557.

If desired, chloride ions may be added to developers. Many color developers (especially developers for color print materials) generally contain from $3.5\times10^{-2}$ to $1.5\times10^{-1}$ mols/liter of chloride ions. In general, however, since chloride ions are released in developers as side products in development, adding them to replenishers is unnecessary in most cases. The chloride ion content of replenishers is so defined that the chloride ion concentration in developer baths could be on the level as above when the running developer in the bath has reached a state of equilibrium. If the chloride ion concentration in developers is higher than $1.5\times10^{-1}$ mols/liter, it is unfavorable since the development is retarded and could not be effected rapidly and, in addition, the color density of the images formed is low. On the other hand, if the chloride ion concentration in developers is lower than $3.5\times10^{-2}$ mols/liter, it is also unfavorable in most cases since the photographic materials processed are fogged.

The same as that for the chloride ions may apply also to bromide ions to be in developers. The bromide ion content of color developers for picture-taking photographic materials is preferably from 1 to $5\times10^{-3}$ mols/liter, and that for print materials is preferably at most $1.0\times10^{-3}$ mols/liter. The lowermost limit of the bromide ion content is on the level of such that the developers do not substantially contain bromide ions except those released from the photographic material being processed. If desired, bromide ions may be added to replenishers in order that the bromide ion concentration in developers may fall within the range. In case where developers and optionally replenishers are made to contain chloride ions, the chloride ion donor substance may be any of sodium chloride, potassium chloride, ammonium chloride, lithium chloride, nickel chloride, magnesium chloride, manganese chloride and calcium chloride. of those, preferred are sodium chloride and potassium chloride. Bromide ion donor substances are, for example, sodium bromide, potassium bromide, ammonium bromide, lithiumbromide, calciumbromide, magnesiumbromide, manganese bromide, nickel bromide, cerium bromide and thallium bromide. of those, preferred are potassium bromide and sodium bromide.

Color developers may contain known or commercially-available diaminostilbene fluorescent brighteners. Known bistriazinyldiaminostilbene-disulfonic acid compounds are usable, and those described in JP-A 6-329936, 7-140625, 10-104809 are preferred. Commercial products of fluorescent brighteners are described in, for example, Dyeing Note, 19th Ed. (by Shikisen-sha), pp. 165–168. Of the products listed therein, preferred are Blankophor UWliq, Blankophor REU, and Hakkol BRK.

When the photographic material to be developed is color print paper, one important factor thereof is that the non-image background area thereof is as white as possible. For it, therefore, it is preferable to add a stilbene fluorescent brightener, especially a di(triazylamino)stilbene or 4,4'-diamino-2,2'-diaminodisulfostilbene fluorescent brightener to the color developer. Above all, compounds of the following general formula (F) are especially preferred stilbene fluorescent brighteners. General formula(F)

General formula (F)

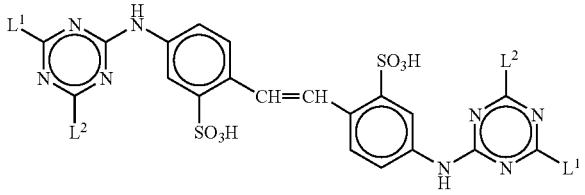

In formula (F), $L^1$ and $L^2$ may be the same or different and each represents —$OR^1$ or —N—$R^2(R^3)$, and the four substituents $L^1$ and $L^2$ in formula (F) have at least four functional groups in all, selected from the following functional groups (FA). These four or more functional groups maybe the same or different, and all of $L^1$ and $L^2$ may have the functional group, or any one of them may have it. $R^1$ and $R^2$ each represent a hydrogen atom, an alkyl group, or an alkyl group having any of the following functional groups (FA); and $R^3$ represents an alkyl group, or an alkyl group having any of the following functional groups (FA).

Functional Groups (FA):

—$SO_2M$, —$OSO_2M$, —COOM, —$N(R)_3X$

In the functional groups (FA), X represents a halogen atom; and R represents an alkyl group. In formula (F) and the functional groups (FA), M represents a hydrogen atom, an alkali metal atom, a tetraalkylammonium group, or a pyridinium group.

Compounds of formula (F) are described in more detail. When $R^1$, $R^2$ and $R^3$ in $L^1$ and $L^2$ each are alkyl groups, they may be the same or different. The alkyl group may be a linear or branched alkyl group, in which the hydrogen atom may be substituted with any other substituent. Preferably, the substituent substitutable for the hydrogen atom is a hydrophilic group. Especially in the invention, $R^1$, $R^2$ or $R^3$ is preferably an alkyl group having a strong hydrophilic functional group selected from the functional groups (FA) When R in $R^1$, $R^2$, $R^3$ and the functional groups (FA) is an alkyl group, it preferably has from 1 to 4 carbon atoms, more preferably 1 or 2 carbon atoms. Table 2 below shows typical examples of the compound of formula (F) in which the alkyl group for R is sulfoethyl. However, the alkyl group for R may be sulfopropyl or sulfobutyl. In the compound of formula (F) for use in the invention, four substituents L's have at least 4 functional groups in all selected from the functional groups (FA). Preferably, the number of the functional groups (FA) to be in the compound is an even number, more preferably at most 8, even more preferably at most 6. Table 2 and Table 3 below show diaminostilbene compounds, indicating the concrete structures of the substituents of formula (F). The details of the compound of formula (F) are described in JP-A 6-329936.

The stilbene fluorescent brightener may be added not only to color developers but also any of desilvering solutions and photographic materials. In case where the brightener is added to color developers, its preferred concentration is from $1\times10^{-4}$ to $5\times10^{-2}$ mols/liter, more preferably from $2\times10^{-4}$ to $1\times10^{-2}$ mols/liter. The processing agent compositions for use in the invention are so designed that the fluorescent brightener concentration in the running developer is on the level as above.

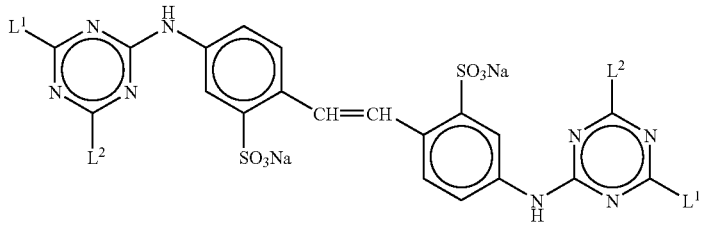

| Compound No. | $L^1$ | $L^2$ |
|---|---|---|
| F-1 | —$OC_2H_4SO_3Na$ | —$OC_2H_4SO_3Na$ |
| F-2 | —$OC_2H_4OSO_3Na$ | —$OC_2H_4OSO_3Na$ |
| F-3 | —N($C_2H_4OSO_3Na$)($C_2H_4OSO_3Na$) | —N($C_2H_4OSO_3Na$)($C_2H_4OSO_3Na$) |
| F-4 | —$OC_2H_4SO_3H$ | —$OC_2H_4SO_3H$ |
| F-5 | —$NHC_2H_4SO_3H$ | —$NHC_2H_4SO_3H$ |
| F-6 | —$NHC_2H_4SO_3(NH_4)$ | —$NHC_2H_4SO_3(NH_4)$ |
| F-7 | —$NHC_2H_4COOH$ | —$NHC_2H_4COOH$ |
| F-8 | —$NHC_2H_4COOH$ | —$NHC_2H_4SO_3Na$ |
| F-9 | —$NHC_2H_4COONa$ | —$NHC_2H_4COONa$ |
| F-10 | —$NHC_2H_4COONa$ | —$NHC_2H_4SO_3Na$ |
| F-11 | —$N(CH_3)_3Cl$ | —$N(CH_3)_3Cl$ |
| F-12 | —$OC_2H_4OSO_3Na$ | —$OC_2H_4SO_3Na$ |
| F-13 | —$NHC_2H_4SO_3Na$ | —$NHC_2H_4SO_3Na$ |

-continued

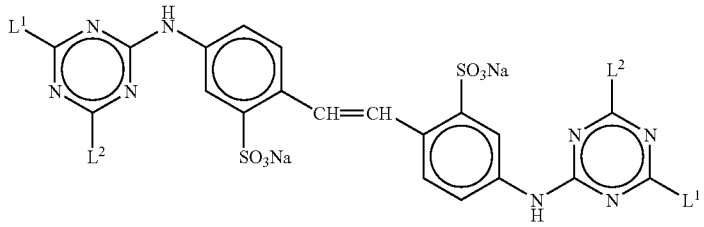

| Compound No. | $L^1$ | $L^2$ |
|---|---|---|
| F-14 | $-N(CH_3)(C_2H_4SO_3Na)$ | $-N(CH_3)(C_2H_4SO_3Na)$ |
| F-15 | $-N(C_2H_5)(C_2H_4SO_3Na)$ | $-N(C_2H_5)(C_2H_4SO_3Na)$ |
| F-16 | $-N(C_2H_4SO_3Na)(C_2H_4SO_3Na)$ | $-N(C_2H_4SO_3Na)(C_2H_4SO_3Na)$ |
| F-17 | $-N(C_2H_4SO_3Na)(C_2H_4SO_3Na)$ | $-OCH_3$ |
| F-18 | $-N(C_2H_4SO_3Na)(C_2H_4SO_3Na)$ | $-OC_2H_5$ |
| F-19 | $-N(C_2H_4SO_3Na)(C_2H_4SO_3Na)$ | $-OC_2H_4OH$ |
| F-20 | $-N(C_2H_4SO_3Na)(C_2H_4SO_3Na)$ | $-N(C_2H_5)(C_2H_5)$ |
| F-21 | $-N(C_2H_4SO_3Na)(C_2H_4SO_3Na)$ | $-NHC_2H_4OH$ |
| F-22 | $-N(C_2H_4SO_3Na)(C_2H_4SO_3Na)$ | $-OC_2H_4NH_2$ |
| F-23 | $-N(C_2H_4SO_3Na)(C_2H_4SO_3Na)$ | $-NHC_2H_4N(CH_3)(CH_3)$ |
| F-24 | $-NHC_2H_4SO_3Na$ | $-OC_2H_4SO_3Na$ |
| F-25 | $-NHC_2H_4SO_3Na$ | $-N(CH_3)(C_2H_4SO_3Na)$ |

-continued

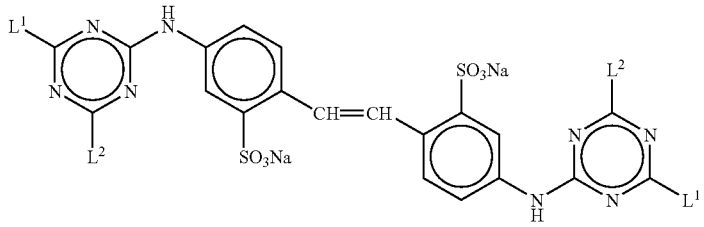

| Compound No. | $L^1$ | $L^2$ |
|---|---|---|
| F-26 | $—NHC_2H_4SO_3Na$ | $—N(C_2H_4OSO_3Na)_2$ |
| F-27 | $—NHC_2H_4SO_3Na$ | $—NHC_2H_4COONa$ |

Compounds (FL-1) to (FL-3) mentioned below are also preferred for use in the invention. In addition, SR-1 mentioned below is effective as a decoloring agent, and is favorably used herein.

The pH of the color developer and the replenisher for use herein is preferably from 9.5 to 13.0, more preferably from 9.8 to 12.5. To make them have the pH value falling within the range, various buffers are preferably added to them. The

FL-1

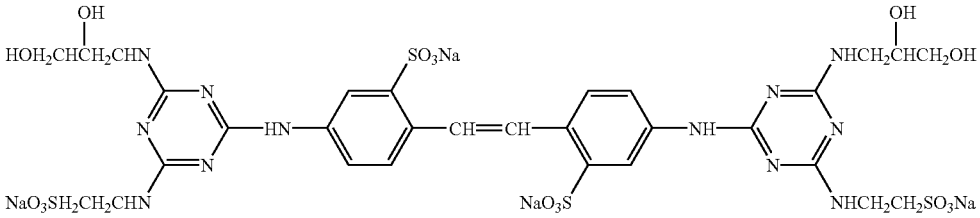

FL-2

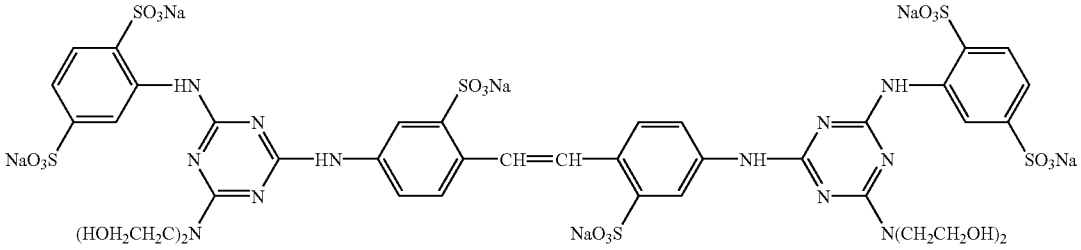

FL-3

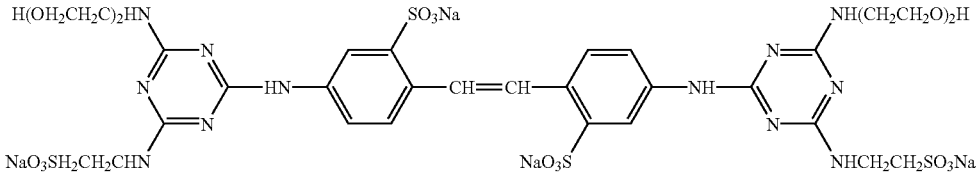

SR-1

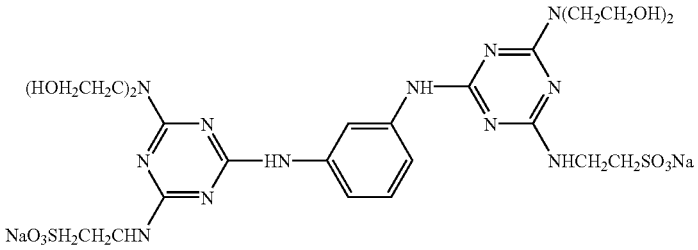

buffers are, for example, potassium carbonate and sodium carbonate mentioned above, as well as other carbonates, phosphates, borates, tetraborates, hydroxybenzoates, glycine salts, N,N-dimethylglycine salts, leucine salts, norleucine salts, guanine salts, 3,4-dihydoxyphenylalanine salts, alanine salts, aminobutyrates, 2-amino-2-methyl-1,3-propanediol salts, valine salts, proline salts, trishydroxyaminomethane salts, and lysine salts. In particular, carbonates, phosphates, tetraborates and hydroxybenzoates are advantageous in that their buffering ability in a high pH range of 9.0 or more is good, they have no negative influence on the photographic properties of photographic materials (for example, they do not fog photographic materials) even when added to color developers, and they are inexpensive. Therefore, these buffers are especially favorable.

Examples of the buffers are sodium carbonate, potassium carbonate, as well as sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate, (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfosalicylate). However, the invention is not limited to these compounds. The amount of the buffer to be in the color development replenisher may be from 0.04 to 2.0 mols/liter, preferably from 0.1 mols/liter to 0.4 mols/liter in total.

The color developer for use in the invention may contain any other components, for example, various chelating agents that serve as a calcium or magnesium precipitation inhibitor or a color developer stability improver. For example, the chelating agents include nitrilotriacetic acid, diethylenetriamine-pentaacetic acid, ethylenediamine-tetraacetic acid, N,N,N-trimethylenephosponic acid, ethylenediamine-N,N,N',N'-tetramethylenesulfonic acid, ethylenediamine-N,N-disuccinic acid, N,N-di(carboxylato)-L-aspartic acid, β-alanine-disuccinic acid, ethylenediamine-N,N,N',N'-tetramethylenesulfonic acid, transcyclohexanediamine-teraacetic acid, 1,2-diaminopropane-tetraacetic acid, glycol ether-diamine-tetraacetic acid, ethylenediamine-orthohydroxyphenylacetic acid, 2-phosphonobutane-1,2,4-tricarboxylic acid, 1-hydroxyethylidene-1,1-diphosphonic acid, N,N'-bis(2-hydroxybenzyl) ethylenediamine-N,N'-diacetic acid, 1,2-dihydroxybenzene-4,6-disulfonic acid. If desired, two or more these chelating agents may be used as combined. The amount of the chelating agent to be in the color developer may be enough to sequester the metal ions in the developer. In general, the amount may be from 0.1 g to 10 g per liter of the developer or replenisher.

Also if desired, the developer and the replenisher may contain any development promoter. The development promoters optionally usable herein are, for example, thioether compounds described in JP-B 37-16088, 37-5987, 38-7826, 44-12380, 45-9019, and U.S. Pat. No. 3,813,247; p-phenylenediamine compounds described in JP-A52-49829,50-15554; quaternary ammonium salts described in JP-A 50-137726, JP-B 44-30074, JP-A 56-156826, 52-43429; amine compounds described in U.S. Pat. Nos. 2,494,903, 3,128,182, 4,230,796, 3,253,919, JP-B41-11431, U.S. Pat. Nos. 2,482,546, 2,596,926, 3,582,346; polyalkylene oxides described in JP-B 37-16088, 42-25201, U.S. Pat. No. 3,128,183, JP-B 41-11431, 42-23883, U.S. Pat. No. 3,532,501; 1-phenl-3-pyrazolidones, and imidazoles.

Still if desired, any antifoggant may be added to the developer and the replenisher. The antifoggant includes, for example, alkali metal halides mentioned above, such as sodium chloride, potassium bromide, potassium iodide, and organic antifoggants. Nitrogen-containing heterocyclic compounds are typical examples of organic antifoggants, including benzotriazole, 6-nitrobenzimidazole, 5-nitroisoindazole, 5-methylbenzotriazole, 5-nitrobenzotriazole, 5-chloro-benzotriazole, 2-thiazolyl-benzimidazole, 2-thiazolylmethyl-benzimidazole, indazole, hydroxyazaindolidine, adenine. Apart from the surfactants mentioned above, other various surfactants may also be added to the developer and the replenisher, including, for example, alkylsulfonic acids, arylsulfonic acids, aliphatic carboxylic acids and aromatic carboxylic acids.

The temperature at which the photographic material of the invention is processed for color development may fall between 30 and 55° C., preferably between 35 and 55° C., more preferably between 38 and 53° C., when the photographic material is a color print material. The time for development may be from 3 to 50 seconds, preferably from 3 to 20 seconds. In particular, the photographic material of the invention is suitable to extremely rapid development within 3 to 14 seconds. The amount of the replenisher is as small as possible, for example, from 20 to 600 ml per $m^2$ of the photographic material, preferably from 30 to 120 ml, more preferably from 15 to 60 ml. On the other hand, when the photographic material is a color reversal film or color reversal paper, the temperature at which it is developed falls between 20 and 55° C., preferably between 30 and 55° C., more preferably between 38 and 45° C. The time for development may be from 10 seconds to 6 minutes. Also in this case, the amount of the replenisher is as small as possible, for example, from 20 to 500 ml per $m^2$ of the photographic material, preferably from 30 to 200 ml, more preferably from 50 to 160 ml. The color developer and the replenisher for use in the invention have been described in detail hereinabove.

One laboratory processor for color-developing the photographic material of the invention to define the color of the images formed and the whiteness in the background area is Fuji Photo Film's MINILABO PP350, in which a chemical of CP48S is used as the processing agent. A sample of photographic material is imagewise exposed through a negative film having an average density, and this is continuously processed in the processor until the volume of the replenisher reaches two times the developer bath volume.

The chemical for the processing agent may also be Fuji Photo Film's CP45X or CP47L, or Eastman Kodak's RA-100 or RA-4.

In carrying out the invention, the photographic material is developed with a color developer and then desilvered by further processing it with a bleaching solution or a blix solution. In case where the photographic material is for color prints, the processing solutions may also contain a suitable fluorescent brightener, preferably a stilbene fluorescent brightener. In this case, the fluorescent brighteners of formula (S) mentioned above are preferred. The preferred range of the amount of the fluorescent brightener to be added to the processing solutions may be the same as that of the amount thereof to be added to the color developer. For the preferred examples of the fluorescent brightener to the processing solutions, referred to are the same as those mentioned hereinabove to the color developer.

The bleaching agent to be in the bleaching solution and the blix solution may be any known one. Especially preferred are organic iron(III) complexes (e.g., aminopolycarboxylato-iron(III) complexes), as well as organic acids such as citric acid, tartaric acid, malic acid, and persulfates and hydrogen peroxide. Of those, organic iron(III) complexes are especially preferred, as they ensure rapid processing and prevent environmental pollution. Examples of aminopolycarboxylic acids and their salts to form organic iron(III) complexes are biodegradable ethylenediamine-disuccinic acid (SS form), N-(2-carboxylatoethyl)-L-aspartic acid, β-alanine-diacetic acid, methyliminodiacetic acid, as well as ethylenediamine-tetraacetic acid, diethylenetriamine-pentaacetic acid, 1,3-diaminopropane-tetraacetic acid, propylenediamine-tetraacetic acid, nitrilotriacetic acid, cyclohexanediamine-tetraacetic acid, iminodiacetic acid, glycol ether-diamine-tetraacetic acid, and compounds of formulae (I) and (II) described in EP0789257. These compounds may be in any form of sodium, potassium, lithium or ammonium salts. Of those compounds, especially preferred are ethylenediamine-disuccinic acid (SS form), N-(2-carboxylatoethyl)-L-aspartic acid, β-alanine-diacetic acid, ethylenediamine-tetraacetic acid, 1,3-diaminopropane-tetraacetic acid, methyliminodiacetic acid, since their iron(III) complexes enable the photographic materials processed with them to have good photographic properties. The ferric complexes may be used as they are or may be formed in the processing solutions from ferric salts, such as ferric sulfate, ferric chloride, ferric nitrate, ammonium ferric sulfate or ferric phosphate, and a chelating agent such as aminopolycarboxylic acids. In the latter case, the chelating agent may be excess over that necessary for forming the ferric complexes. The iron complexes are preferably aminopolycarboxylato-iron complexes. The amount of the complex to be added to the processing solutions may be from 0.01 to 1.0 mol/liter, preferably from 0.05 to 0.50 mols/liter, more preferably from 0.10 to 0.50 mols/liter, even more preferably from 0.15 to 0.40 mols/liter. The bleaching time may be generally from 10 seconds to 6.5 minutes, preferably from 15 seconds to 2 minutes.

The fixing agent to be in the blix solution or the fixing solution for use herein may be any known one. For example, it is a water-soluble, silver halide-dissolving agent, including thiosulfates such as sodium thiosulfate, ammonium thiosulfate; thiocyanates such as sodium thiocyanate, ammonium thiocyanate; thioether compounds such as ethylenebisthioglycolic acid, 3,6-dithia-1,8-octanediol; and thioureas. One or more such compounds may be used singly or as combined. In addition, special blix solutions comprising a combination of a fixing agent and a large amount of a halide such as potassium iodide, such as those described in JP-A 55-155354, are also usable herein. In the invention, thiosulfates, especially ammonium thiosulfate are preferably used. The amount of the fixing agent to be in the blix or fixing solution is preferably from 0.3 to 2 mols, more preferably from 0.5 to 1.0 mol per liter of the solution.

The pH range of the blix or fixing solution for use in the invention is preferably from 3 to 8, more preferably from 4 to 7. If the pH of the processing solution is lower than the range, the desilvering ability of the solution increases but the solution will be readily degraded and the cyan dye in the photographic material will be readily leucoated. On the contrary, if the pH of the processing solution is higher than the range, the photographic material could not be desilvered rapidly and will be stained. The pH range of the bleaching solution for use in the invention is at most 8, preferably from 2 to 7, more preferably from 2 to 6. If the pH of the bleaching solution is lower than the range, the solution will be readily degraded and the cyan dye in the photographic material will be readily leucoated; but if higher than the range, the photographic material could not be desilvered rapidly and will be stained. For controlling the pH of the processing solutions, if desired, any of hydrochloric acid, sulfuric acid, nitric acid, bicarbonates, ammonia, potassium hydroxide, sodium hydroxide, sodium carbonate or potassium carbonate may be added to the solutions.

The blix solution may contain any other fluorescent brighteners, defoaming agents, surfactants, and organic solvents such as polyvinylpyrrolidone or methanol. The blix solution and the fixing solution preferably contain a preservative. The preservative includes, for example, sulfite ion-releasing compounds such as sulfites (e.g., sodium sulfite, potassium sulfite, ammonium sulfite), bisulfites (e.g., ammonium bisulfite, sodium bisulfite, potassium bisulfite), metabisulfites (e.g., potassium metabisulfite, sodium metabisulfite, ammonium metabisulfite); and arylsulfinic acids such as p-toluenesulfinic acid, m-carboxybenzenesulfinic acid. Preferably, the amount of the preservative compound to be in the processing solutions is from 0.02 to 1.0 mol/liter in terms of the sulfite or sulfinate ion.

Apart from those mentioned above, the preservative further includes ascorbic acid, carbonyl-bisulfate adducts and carbonyl compounds. In addition, the processing solutions may further contain a buffer, a fluorescent brightener, a chelating agent, a defoaming agent and an antifungal agent, if desired. In the invention, the blix time may be from 5 to 240 seconds, preferably from 10 to 60 seconds. The blix temperature may fall between 25° C. and 60C., preferably between 30° C. and 50° C. The amount of the processing solution to be replenished to the processing system may be from 20 ml to 250 ml, preferably from 30 ml to 100 ml, more preferably from 15 ml to 60 ml per $m^2$ of the photographic material being processed.

After being desilverd through such fixation or blix treatment, the photographic material is generally rinsed in water and/or stabilized. The amount of water in the rinsing step may be defined in a broad range, depending on the characteristics and the use of the photographic material (for example, the components such as couplers therein), the temperature of the rinsing water, the number of the rinsing baths (rinsing stages), and other various conditions. The relationship between the number of the rinsing baths and the water amount in a multi-stage countercurrent rinsing system may be obtained according to the method described in *Journal of the Society of Motion Picture and Television Engineers*, Vol. 64, pp. 248–253 (May, 1955). In general, in a multi-stage countercurrent rinsing system, the number of the rinsing stages is preferably from 3 to 15, more preferably from 3 to 10.

In such a multi-stage countercurrent rinsing system, the amount of rinsing water may be significantly reduced. In this, however, since the water residence time in the baths increases, there occurs a problem in that bacteria grow in the baths and the resulting flocculates adhere to the photographic material being rinsed. To solve the problem, the method of reducing calcium and magnesium in the baths described in JP-A 62-288838 is extremely effective in the invention. In addition, isothiazolone compounds and thiabendazoles described in JP-A 57-8542; chlorine-containing bactericides such as sodium chloroisocyanurate described in JP-A 61-120145; benzotriazoles described in JP-A 61-267761; copper ions; benzotriazoles described in JP-A 61-267761; copper ions; as well as other bactericides described in *Antibacetrial and Antifungal Chemistry* (by Hiroshi Horiguchi, Sankyo Publishing, 1986), *Bacteriostatic, Bactericidal and Antifungal Technology* (by the Society of Sanitary Technology of Japan, 1982), and *Dictionary of Antibacterial and Antifungal Agents* (by the Antibacterial and Antifungal Society of Japan, 1986) may also be used.

Aldehydes such as formaldehyde, acetaldehyde, pyruvic aldehyde that are to inactivate the residual magenta couplers in the processed photographic materials to prevent color fading and stain formation; methylol compounds and hexamethylenetetramines described in U.S. Pat. No. 4,786,583; hexahydrotriazines described in JP-A 2-153348; formaldehyde-bisulfiteadducts described in U.S. Pat. No. 4,921,779; and azolylmethylamines described in EP 504609, 519190 may also be added to the rinsing water.

A surfactant serving as a dewatering agent, and a chelating agent such as typically EDTA that serves as a water softener may also be added to the rinsing water. After having been rinsed as in the above or directly not rinsed, the photographic material may be processed with a stabilizer. The stabilizer contains a compound having the function of stabilizing images, for example, an aldehyde compound such as typically formalin, or a buffer having the ability to control the film pH suitable for image stabilization, or an ammonium compound. In addition, for preventing the growth of bacteria in the stabilizer used and for making the processed photographic material resistant to fungi, various bactericides and antifungal agents such as those mentioned hereinabove may also be added to the stabilizer.

Further, surfactants, fluorescent brighteners and hardening agents may also be added to the stabilizer. For directly stabilizing the processed photographic material of the invention without rinsing it in water, all known methods such as those described in JP-A 57-8543, 58-14834, 60-220345 may be employed. In addition, using chelating agents such as 1-hydroxyethylidene-1,1-diphosphonic acid or ethylenediamine-tetramethylenephosphonic acid, or magnesium or bismuth compounds in stabilizing the photographic material is one preferred embodiment of the invention.

A rinsing solution may also be used for the rinsing water or stabilizer for the desilvered photographic material. The pH in the rinsing step or the stabilizing step is preferably from 4 to 10, more preferably from 5 to 8. The temperature in the step may be suitably defined, depending on the use and the characteristics of the photographic material, but generally falls between 20° C. and 50° C., preferably between 25° C. and 45° C. After being rinsed in water and/or stabilized, the photographic material is dried. For reducing the amount of carryover water into the image film, the photographic material may be squeezed with a squeeze roller or cloth to remove water from it, immediately after taken out of the rinsing bath. Thus squeezed, the photographic material may be rapidly dried. Naturally for improving the drier for drying the photographic material, the drier temperature may be elevated or the blow nozzle may be modified to reinforce the power of the drying air through the nozzle, whereby the photographic material may be more rapidly dried in the drier. In addition, as in JP-A 3-157650, the angle of the drying air to the photographic material may be suitably adjusted or the exhaust air may be forcedly expelled out of the drier to thereby more rapidly dry the photographic material.

The photographic material of the invention may be processed in an automatic processor. One preferred embodiment of the automatic processor to be used for processing the photographic material of the invention is described. Preferably, the linear travel speed in the automatic processor is at most 5000 mm/min, more preferably from 200 mm/min to 4500 mm/min, even more preferably from 500 to 3000 mm/min. In the processing baths and the replenisher baths, the area in which the processing solution or the replenisher is contacted with air (open area) is as small as possible. For example, the aperture obtained by dividing the open area ($cm^2$) by the liquid volume ($cm^3$) in the processing bath is preferably at most 0.01 ($cm^{-1}$), more preferably at most 0.005, most preferably at most 0.001.

For reducing the open area in which the processing solution or the replenisher is contacted with air, it is preferable that the processing baths and the replenisher baths are provided with a floating solid or liquid air blocker. Concretely, a plastic float is made to float in the processing solution or the replenisher, or the surface of the processing solution or the replenisher is covered with a liquid that does not mix with or does not react with the processing solution or the replenisher. Preferred example of the immiscible or inactive liquid are liquid paraffin and liquid saturated hydrocarbons.

For rapidly processing the photographic material of the invention, the crossover time for which the photographic material moves from one processing solution to another is preferably as short as possible. For example, the crossover time is preferably at most 10 seconds, more preferably at most 7 seconds, even more preferably at most 5 seconds. For attaining such a short crossover time, a cine-type automatic processor is preferably used in the invention. Especially preferred is a leader conveyor system. The system is, for example, in Fuji Photo Film's automatic processor, FP-560B. For the leader and the photographic material conveyor, for example, preferred are belt conveyor systems such as those described in JP-A 60-191257, 60-191258, 60-191259. For the conveyor mechanism, especially preferred are those described in Japanese Patent Application Nos. 1-265794, 1-266915, 1-266916. For shortening the crossover time and for preventing the processing solutions from mixing together, the crossover rack to be used is preferably provided with a liquid mixing preventing plate, as in Japanese Patent Application No. 1-365795.

Preferably, the processing solutions to be used in the invention are supplied with water that corresponds to their evaporation to compensate the evaporation loss. In particular, water supply to color developers, bleaching solutions and blix solutions is desirable. The concrete method for water supply is not specifically defined. For example, a monitor water bath is provided separately from the bleaching bath, the actual water evaporation from the monitor bath is monitored, the water evaporation from the bleaching bath is calculated from the thus-monitored water evaporation, and water corresponding to the thus-calculated water evaporation is supplied to the bleaching bath, as in JP-A1-254959, 1-254960; or a liquid level sensor or an overflow sensor is provided for evaporation loss compensation, as in Japanese Patent Application Nos. 2-46743, 2-47777, 2-47778, 2-47779, 2-117972. These methods are preferably employed in the invention. However, the most preferred method for evaporation loss compensation is to estimate the amount of water corresponding to evaporation and to add the thus-estimated amount of water to the processing baths. For this, for example, the water supply coefficient is obtained on the basis of the information relating to the running time, the stop time and the temperature-conditioning time of the automatic processor, and the amount of water to be added to the processing baths is calculated by the use of the thus-obtained water supply coefficient, as in Japan Invention Association's Disclosure Bulletin No. 94-49925, from page 1, right column, line 26 to page 3, left column, line 28, or in Japanese Patent Application No. 2-103894.

In addition, it is also necessary to specifically design the processor for reducing the water evaporation from the baths therein. For this, the open area in the baths is reduced or the ventilation through exhaust funs is suitably controlled. For example, the preferred aperture for the color developer is as mentioned hereinabove, and it is also preferable to reduce the open area of the other processing solutions. For reducing the water evaporation it is especially preferable "to control the humidity in the space above the processing baths to be at least 80% RH" as in JP-A 6-110171. For this, for example, it is more preferable to provide an evaporation-preventing rack and an automatic roller-cleaning mechanism in the processor, as in FIGS. 1 and 2 described in the patent specification. In this, the exhaust fan is provided in the processor so as to prevent dew formation therein during temperature control. Preferably, its power for exhaust gas evacuation is from 0.1 $m^3$/min to 1 $m^3$/min, more preferably from 0.2 $m^3$/min to 0.4 $m^3$/min. The drying condition for the photographic material also depends on the evaporation of the processing solutions. For drying the photographic material, preferably used is a ceramic hot-air heater, and the air flow rate in the heater is preferably from 4 $m^3$/min to 20 $m^3$/min, more preferably from 6 $m^3$/min to 10 $m^3$/min. The overheat-preventing thermostat for the ceramic hot-air heater is preferably driven through heat conduction, and the site in which the thermostat is fitted is upwind or downwind via a radiation fin or a heat-transfer device. Preferably, the drying temperature is controlled, depending on the water content of the photographic material being processed. Most suitably, it falls between 45 and 55° C. for 35 mm-wide films, and between 55 and 65° C. for Blowny films. For replenishing the processing solutions, a replenishing pump is used. This is preferably a bellows-shaped replenishing pump. For increasing the replenishment accuracy, it is effective to reduce the diameter of the feed tube toward the replenishing nozzle. This is for preventing the backflow when the pump is stopped. Preferably, the inner diameter of the feed tube is from 1 to 8 mm, more preferably from 2 to 5 mm.

Various materials are used for constructing the parts of the automatic processor. Preferred materials for them are described below. The processing baths and the temperature-controlling baths are preferably made of modified PPO (modified polyphenylene oxide) or modified PPE (modified polyphenylene ether) resin. One example of the modified PPO is Nippon GE Plastics' NORYL; and examples of the modified PPE are Asahi Chemical Industry's ZAILON, and Mitsubishi Gas Chemical's UPIACE. These materials are also suitable for the processing racks and the crossover racks that may be contacted with processing solutions.

For the rollers in the processing zone, suitable are PVC (polyvinyl chloride), PP (polypropylene), PE (polyethylene) and TPX (polymethylpentene) resins. These materials may also be used for the other parts that will be contacted with processing solutions. PE resin may be blow-molded into replenisher baths. For the processing zone parts, the gears, the sprockets and the bearings, suitable are PA (polyamide), PBT (polybutylene terephthalate), UHMPE (ultra-high-molecular polyethylene), PPS (polyphenylene sulfide) and LCP (full-aromatic polyester resin, liquid-crystal polymer) resins. PA (polyamide) resin includes 66-nylon, 12-nylon and 6-nylon, and when reinforced with glass fibers or carbon fibers, it is strong against processing solutions, not swelling, and is favorable.

Polymer moldings and compression moldings of MC nylon can be used as they are, not reinforced with fibers. Non-reinforced NHMPE resin is favorable, including, for example, Mitsui Petrochemical's LUBMA and HIZEX MILLION, Sakushin Industry's NEWLITE, and Asahi Chemical Industry's SUNFINE. The molecular weight of the resin is preferably at least 1,000,000, more preferably from 1,000,000 to 5,000,000. PPS resin is preferably reinforced with glass fibers or carbon fibers. LCP resin includes, for example, ICI Japan's VICTREX, Sumitomo Chemical's ECONOLE, Nippon Oil's ZAIDER, and Polyplastics' VECTRA. For conveyor belts, especially preferred are high-tenacity polyethylene fibers and polyvinylidene fluoride resin described in Japanese Patent Application No. 2-276886. For the soft materials for squeeze rollers, suitable are polyvinyl chloride resin foams, silicone resin foams and polyurethane resin foams. One example of polyurethane resin foams is Toyo Polymer's RUBICEL. For the rubber materials for the joints and sealants for pipe lines and agitation jet pipes, preferred are EPDM rubber, silicone rubber, and Viton rubber.

The drying time is preferably from 30 seconds to 2 minutes, more preferably from 40 seconds to 80 seconds. The above is to describe the continuous process essentially with replenishment, but in the invention, a batch process is also preferably employed in which the photographic material is processed in a predetermined amount of a processing solution with no replenishment thereto, and thereafter all or a part of the processing solution is exchanged with a fresh processing solution, and another lot of photographic material is then processed therein.

In the invention, the processing agent may be fed to the processor as a thick stock of one or more parts of the agent, or may be fed thereto in the form of powder, tablets, granules or paste of the agent. The processing agent to be fed to the processor may also be a ready-mix solution thereof, or may be in any combination of thick stock, powder, tablets, granules, paste and ready-mix solution of the agent.

The single thick stock may be diluted into a replenisher to be fed into the processor. For this, it is preferable that the thick stock is set in the processor, and it is automatically diluted with water in the replenisher bath. The water for diluting the thick stock is preferably from the rinsing water replenisher bath. If desired, the thick stock may be directly fed to the processing baths, and water corresponding to the desired degree of dilution may be directly added thereto. This method is especially favorable for a compact processor not equipped with a replenisher bath.

The same as above may apply also to the thick stock of different parts of processing agents. It is preferable that the thick stock is set in the processor and this is automatically diluted with water in the replenisher baths. Also preferably, the water for diluting the thick stock is from the rinsing water replenisher bath. Every part of the thick stock in different baths may be directly replenished and diluted with water corresponding to the desired degree of dilution.

Like the above, it is also preferable that powdery, tablet, granular or pasty processing agents are directly put into the processing baths, and diluted with water corresponding to the desired degree of dilution. It is also preferable that the processing agents are automatically dissolved and diluted in replenisher baths to be replenishers.

The replenisher cartridges for use in the invention may be made of any materials such as paper, plastics or metals. For these, especially preferred are plastic materials having an oxygen permeation coefficient of at most 50 ml/$m^2$·atm·day. The oxygen permeation coefficient is obtained according to the method described in $O_2$ *Permeation of Plastic Container, Modern Packing* (N.J. Calyan, 1968), December Issue, pp. 143–145. Concretely, the plastic materials preferred for use in the invention are polyvinylidene chloride (PVDC), nylon (NY), polyethylene (PE), polypropylene (PP), polyester (PES), ethylene-vinyl acetate copolymer (EVA), ethylene-vinyl alcohol copolymer (EVAL), polyacrylonitrile (PAN), polyvinyl alcohol (PVA), and polyethylene terephthalate (PET). In the invention, PVDC, NY, PE, EVA, EVAL and PET are preferably used as their oxygen permeation is low.

These materials may be used singly, and shaped. They may be formed into films and the films of different types may be laminated into composite films. Regarding their shape, the containers may have any form of bottles, cubes and pillows. For use in the invention, especially preferred are cubic structures and the like which are flexible and are easy to handle and which can be readily reduced in volume after use.

Preferred structures of the composite films for use in the invention are mentioned below, which, however, are not limitative.

PE/EVAL/PE, PE/aluminium foil/PE, NY/PE/NY, N.Y./PE/EVAL, PE/NY/PE/EVAL/PE, PE/NY/PE/PE/PE/NY/PE, PE/$SiO_2$ film/PE, PE/PVDC/PE, PE/NY/aluminium foil/PE, PE/PP/aluminium foil/PE, NY/PE/PVDC/NY, NY/EVAL/PE/EVAL/NY, NY/PE/EVAL/NY, NY/PE/PVDC/NY/EVAL/PE, PP/EVAL/PE, PP/EVAL/PP, NY/EVAL/PE, NY/aluminium foil/PE, paper/aluminium foil/PE, paper/PE/aluminium foil/PE, PE/PVDC/NY/PE, NY/PE/aluminium foil/PE, PET/EVAL/PE, PET/aluminium foil/PE, PET/aluminium foil/PET/PE.

The thickness of the composite film may be generally from 5 to 1500 μm or so, preferably from 10 to 1000 μm or so. The capacity of the finished container may be from 100 ml to 20 liters, preferably from 500 ml to 10 liters or so. The container (cartridge) may be put in an outer box of corrugated cardboard or plastics or may be integrated with such an outer box. The cartridges of the invention may be filled with various processing solutions. For example, they may be filled with any of a color developer, a black-and-white developer, a bleaching solution, a compensating solution, a reversing solution, a fixing solution, a blix solution and a stabilizer. Preferably, color developers, black-and-white developers, fixing solutions and blix solutions are in cartridges of low oxygen permeability.

Conventional containers for processing solutions, such as one-layered containers of high-density polyethylene (HDPE), polyvinyl chloride resin (PVC) or polyethylene terephthalate (PET), and multi-layered rigid containers of nylon/polyethylene (NY/PE) are also usable herein. Flexible containers for liquid, which can be reduced in volume after the contents have been discharged out and the containers have become empty, or that is, those for which the space can be reduced after use can also be used herein. For use in the invention, such flexible containers are preferred. One example of such flexible containers for liquid comprises a flexible container body and a rigid mouth that extends upward from the body, in which the mouth is sealed with an openable cap. Such a container is molded by integrating its body and mouth, and it has a bellows structure at least partly in the direction of its height (see FIGS. 1 and 2 in JP-A 7-5670).

The invention is favorable also for rapid-processable photographic materials. In one example of rapidly processing photographic materials, the color development time is at most 60 seconds; in another example thereof, the time is from 6 to 50 seconds; in still another example thereof, the time is from 3 to 50 seconds; in still another example thereof, the time is from 6 to 30 seconds; and in still another example thereof, the time is from 3 to 25 seconds. In one example of rapidly processing them, the blix time is at most 60 seconds; in another example thereof, the time is from 6 to 50 seconds; in still another example thereof, the time is from 3 to 45 seconds; in still another example thereof, the time is from 6 to 30 seconds; and in still another example thereof, the time is from 3 to 25 seconds. In one example of rapidly processing them, the rising or stabilizing time is at most 150 seconds; in another example thereof, the time is from 6 to 130 seconds; in still another example thereof, the time is at most 90 seconds; and in still another example thereof, the time is from 3 to 40 seconds. The drying time is preferably at most 30 seconds, more preferably at most 20 seconds, most preferably at most 10 seconds. The bleaching (desilvering), rinsing and stabilization may be effected in any desired manner. The total time for the total process from the start of color development to the end of drying may be at most 90 seconds, preferably from 10 to 90 seconds.

The color development time means the period of time taken by the photographic material being processed just after it has entered the color development bath and before it moves to the next blix bath. For example, in an automatic processor, the color development time is the total of the time for which the photographic material being processed is dipped in a color developer (in-liquid running time) and the time for which the photographic material having gone out of the color developer bath is moving toward the next blix bath (in-air crossover time) The blix time means the time taken by the photographic material just after it has entered the blix bath and before it moves to the next rinsing or stabilization bath. The rinsing or stabilization time means the time taken by the photographic material just after it has entered the rinsing or stabilization bath and before it moves to the next drying zone (in-liquid running time).

The invention is effective also for silver halide color photographic materials for digital direct color proofs (hereinafter referred to as photographic materials for proofs), digital direct color proof systems, and image-forming methods for them.

Photographic materials for proofs are silver halide color photographic materials generally having at least yellow, magenta and cyan-forming silver halide photosensitive layers on a support. These are exposed to light from at least three different light source units that emit light in different wavelength ranges, based on dotted image information having a color hue similar to printing ink, to thereby form an area-modulated image thereon. For good compatibility of black (chromaticity and Dmax) with monochromatic solids (chromaticity and Dmax) for improvement of color reproducibility, and for good discrimination of black prints, a fourth photosensitive layer may be provided in the photographic materials. In this case, three or four exposure light sources that differ in the wavelength of light from them are used. Many exposure light sources have plural (preferably at least 8) light source units for each color, for which LED, LD and other devices may be used. For the exposure light sources, usable are various light sources that emit light of various wavelength ranges including, for example, visible light of blue, green and red and IR light, and they may be combined in any desired manner.

In the invention, a direct digital color proof system and a method of image formation using it are preferred. In the system, a color photographic material to be processed is automatically taken out of a magazine, and cut into sheets. The sheet is wound around an outer exposure drum and rotated, and this is exposed to an exposure array light source by scanning it thereto through dotted image information. The array light source comprises at least 8 light source units combined for each color of at least three different wavelength ranges. Thus exposed, an area-modulated dot image is recorded on the sheet at a resolution of at least 2000 dpi. The thus-exposed color photographic material is then automatically developed in an automatic processor, and a color proof dot image is outputted. In this, the sheet to be processed may have a size of A3 or more (if desired, a size of B1 or more). The application of the invention to color proofs is not limited to the photographic materials for proofs, the systems and the image formation methods mentioned above.

Apart from those mentioned above, the invention is also effectively applicable to any other direct digital color proof systems, image formation methods and photographic materials for proofs that are characterized by one or more characteristics selected from the following: The resolution is at least 2400 dpi, and the exposure beam diameter of one dot is from 0.5 μm to 50 μm in terms of the half-value width; The exposure time taken by at least one exposure light source for one dot exposure is from $10^{-8}$ seconds to $10^{-2}$ seconds; The number of outer drum revolutions is from 100 rpm to 4000 rpm; The wavelength of light from at least one exposure light source is at least 700 nm; At least one exposure light source gives at least two-stage exposure light; The exposure energy of the longest wavelength light source is at least 1.1 times that of the other light sources; After being exposed, the photographic material is released from the outer drum and is conveyed with its exposed surface facing down; In an automatic processor, the photographic material is conveyed in such a manner that its emulsion-coated surface turns down in the color developer bath, the blix bath and the rinsing bath; The time taken by the photographic material being processed after its exposure and before it stop enters the color developer bath is from 20 seconds to 3 minutes; The difference between the time taken by the photographic material being processed after its exposure and before its top enters the color developer bath, and the time taken by it before its end reaches the color developer bath is from 1 minute to 10 minutes, the processing time for color development and blix treatment is from 10 seconds to 100 seconds, and the processing time difference is within 30 seconds; The bath capacity of the color development bath and the blix bath is from 8 liters to 20 liters; The number of the rinsing baths is from 2 to 5; The color developer and the blix solution are fed to the processor through an integrated kit, the amount of the replenisher to the color developer bath is from 50 ml to 300 ml per $m^2$ of the photographic material, the amount of the replenisher to the blix bath is from 30 ml to 250 ml per $m^2$ of the photographic material, the amount of the rinsing water to be replenished to the rinsing bath is from 50 ml to 1000 ml in total of the rinsing water, and the area of the photographic material being processed is automatically monitored for replenishment to each bath; The automatic processor has at least one crossover turn conveyor roller that is automatically washed with water; At least one guide plate that is contacted with the emulsion-coated surface of the photographic material is made of Teflon; The automatic processor has a calibration function of correcting the sensitivity change of the photographic material that may be caused by the lot exchange, the time change, the temperature and humidity change in exposure and the condition change of the processing solutions, by writing a specific image in proof prints and other output prints and measuring the density or the chromaticity of the image, or by visually comparing the aimed image with the specific image, and it can calibrate the image to be written on the photographic material by a continuous image having a lower density than Dmax of the photographic material; from 20 to 80% of the plain dot image formed can be calibrated through visual observation, density measurement or color difference measurement; Photographic materials of the same size can be fed through at least 2 magazines, and when the photographic material from one magazine has been completely fed, then another photographic material can be automatically fed through the other magazine; Photographic materials of at least two different sizes can be simultaneously fed through the respective different magazines, and can be automatically exchanged; The length of photographic material in one roll is from 30 m to 100 m; The time from the start of pulling the photographic material out of the magazine to the end of its pulling out and before the photographic material is exposed to light is from 10 seconds to 100 seconds; The black print image is made of yellow, magenta and cyan; the dot gain difference between the colors to form the dots of the black print is at most 5%; The total thickness of the support of the photographic material is from 50 μm to 150 μm; The thickness of the surface laminate of the support of the photographic material is from 10 μm to 50 μm; The thickness of the back laminate of the support of the photographic material is from 10 μm to 50 μm; The photographic material has a back layer on the back of the support opposite to the face thereof coated with photographic layers, in which the thickness of the back layer is from 0.1 μm to 30 μm; The total film thickness on the face of the photographic material having photosensitive silver halides thereon is from 3 μm to 30 μm; The difference between the total film thickness on the face of the photographic material having photosensitive silver halides thereon and the total film thickness on the back of the photographic material is at most 10 μm; The silver chloride content of the photosensitive silver halides in the photographic material is at least 90%; The photographic material is rolled into a roll with its emulsion-coated surface facing outward; The peak wavelength of the maximum spectral sensitivity of at least one layer of the photographic material is at least 700 nm; The photographic material is cut into sheets by passing it between squeeze rollers, and the sheets are automatically wound around a drum.

The shape of the light spot to which the photographic material is exposed may be any of circular, oval or rectangular forms. The light quantity distribution in one spot may be a Gauss distribution, or may also be trapezoidal having a relatively constant light intensity. In particular, one light source may be used, or an array of light sources may also be used.

Exposure methods and image formation methods using lasers, LED or their arrays as a light source are described in detail in JP-A 10-142752, 11-242315, 2000-147723, 2000-246958, 2000-354174, 2000-206654, and EP 1048976A, and these are favorably employed in the invention.

More concretely, they are as follows:

Preferred embodiments of exposure light sources are described in JP-A 2000-147723, paragraph 0022 and in JP-A 2000-206654, paragraphs 0053, 0059-0061, 0064-0067, and these are favorable to the invention.

Preferred embodiments of beam shapes and arrays of exposure light sources are described in JP-A 2000-147723, paragraphs 0022–0023 and in JP-A 2000-206654, paragraphs 0025–0030, and these are favorable to the invention.

For increasing the productivity in exposure, a method of winding a photographic material around a drum and exposing it to light in a mode of scanning exposure is favorable.

One preferred embodiment of the light source for the method is the LED array described in JP-A 2000-246958, and the image-recording device having the LED array described in JP-A 2000-246958 is favorable to the invention. The method of winding a photographic material around a drum is described in JP-A 2000-206654, paragraphs 0057–0058 and 0062–0063, and it is also favorable to the invention.

The method for stabilizing images through calibration described in EP 1048976A is favorable to the invention.

In forming color proofs in the invention, preferably employed is a method of converting digital image data into image data for exposure. The method is described in JP-A 2000-354174 and 2000-147723, and this may directly apply to the invention. More concretely, FIG. 1 in JP-A 2000-354174 shows a color proof-forming device. Not only FIG. 1 but also FIGS. 2 to 4, as well as the description in paragraphs 0011–0021, the first one sentence in paragraph 0022, and the description in paragraphs 0034–0057 in JP-A 2000-354174 are favorably incorporated in the specification as a part of the invention.

EXAMPLES

The invention is described more concretely with reference to the following Examples, to which, however, the invention is not limited.

Example 1

Preparation of Blue-Sensitive Emulsion A of the Invention:

46.3 ml of 10% NaCl solution was added to 1.06 liters of 5.7 wt. % deionized gelatin-containing, deionized distilled water, and 46.4 ml of $H_2SO_4$ (1 N) was added thereto. Further, 0.012 g of compound X mentioned below was added thereto and the temperature of the resulting liquid mixture was controlled to 60° C. With rapidly stirring it, 0.1 mols of silver nitrate and 0.1 mols of NaCl were immediately added to the reactor over a period of 10 minutes. Subsequently, 1.5 mols of silver nitrate and NaCl solutions were added thereto over a period of 60 minutes in an accelerated flow rate method in which the final addition speed was 4 times the initial addition speed. Next, 0.2 mols of silver nitrate and NaCl solutions were added thereto at a constant addition speed over a period of 6 minutes. The NaCl solution contained $5\times10^{-7}$ mols, relative to the total silver, of $K_3IrCl_5(H_2O)$, and the silver halide grains formed were doped with aquated iridium.

Further, 0.2 mols of silver nitrate, 0.18 mols of NaCl and 0.02 mols of KBr solutions were added over a period of 6 minutes. The halide solutions contained $0.5\times10^{-5}$ mols, relative to the total silver, of $K_4Ru(CN)_6$ and $K_4Fe(CN)_6$, respectively, dissolved therein, so that they were added to the silver halide grains formed.

While the grains were growing in the final stage, 0.001 mols, relative to the total silver, of KI solution was added over a period of 1 minute. The addition was started after the grain formation mounted up to 93%.

Next, a precipitating agent, compound Y mentioned below was added at 40° C., and the pH of the mixture was controlled to be about 3.5. Then, this was desalted and washed with water.

Compound X

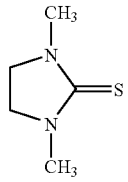

Compound Y

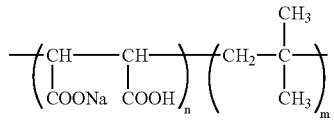

n and m are integers

To the emulsion thus desalted and washed with water, deionized gelatin, NaCl solution and NaOH solution were added, and heated up to 50° C. This was controlled to have a pAg of 7.6 and a pH of 5.6.

The emulsion thus obtained through the process as above contained cubic silver halide grains having a halogen composition of 98.9 mol % silver chloride, 1 mol % silver bromide and 0.1 mol % silver iodide, and having a mean grain size (in terms of the edge length of the same volume cube) of 0.70 μm and a grain size (edge length) fluctuation coefficient of 8%.

The emulsion was kept at 60° C., and $4.5\times10^{-4}$ mols/Ag mol of a spectral sensitizer, color-sensitizing dye A (mixture of color-sensitizing dyes 1 to 4 mentioned below in a molar ratio of 5:3:1:1) was added thereto. Further, $1\times10^{-5}$ mols/Ag mol of thiosulfonate compound-1 mentioned blow was added thereto, and iridium hexachloride-doped, fine emulsion grains of 90 mol % silver bromide and 10 mol % silver chloride having a mean grain size of 0.05 μm were added thereto, and ripened for 10 minutes. Further, fine grains of 40 mol % silverbromide and 60 mol % silver chloride having a mean grain size of 0.05 μm were added thereto, and ripened for 10 minutes. The fine grains were dissolved, and the silver bromide content of the host cubic grains increased up to 1.3 mol %. The amount of iridium hexachloride doped in the grains was $1\times10^{-7}$ mols/Ag mol.

Subsequently, $1\times10^{-5}$ mols/Ag mol of a chemical sensitizer, sodium thiosulfate, and $2\times10^{-5}$ mols/Ag mol of gold sensitizer-1 mentioned below were added. Immediately after the addition, this was heated up to 60° C., then ripened for 40 minutes, and thereafter cooled to 50° C. Immediately after the cooling, mercapto compounds-1 and 2 mentioned below, $6\times10^{-4}$ mols/Ag mol each, were added. After the addition, this was ripened for 10 minutes, and 0.008 mols, relative to silver, of KBr solution was added, ripened for 10 minutes, then cooled, and stored. Emulsion A-1 was prepared in that manner.

In the same manner as in the preparation of Emulsion A-1 except that the temperature in the step of grain formation was varied and the amount of the additives was varied, other emulsions, Emulsion A-2 (mean grain size, 0.60 μm), Emulsion A-3 (mean grain size, 0.65 μm), Emulsion A-4 (mean grain size, 0.75 μm), Emulsion A-5 (mean grain size, 0.80 μm), Emulsion A-6 (mean grain size, 0.50 μm) were obtained. The grain size fluctuation coefficient of these emulsion grains, A-2 to A-6 was 8% all. In preparing the emulsion grains, the amount of the additives, the spectral sensitizer and the chemical sensitizer was so controlled that it was in proportion to the reciprocal of the grain size of each emulsion, based on the Emulsion A-1.

Color-Sensitizing Dye-1

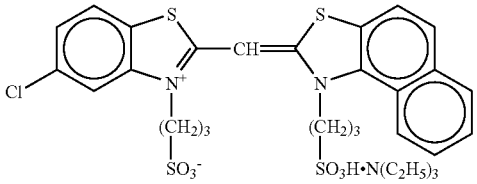

Color-Sensitizing Dye-2

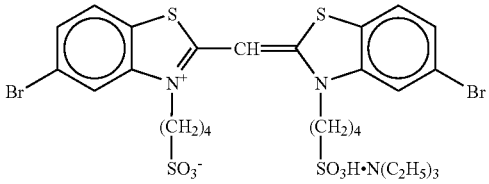

Color-Sensitizing Dye-3

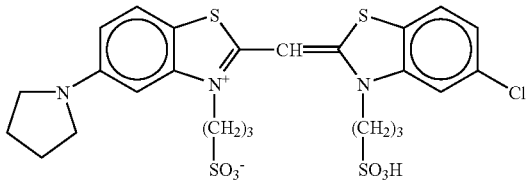

Color-Sensitizing Dye-4

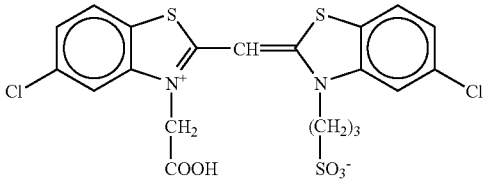

Thiosulfonate Compound-1

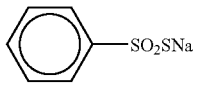

Gold Sensitizer-1

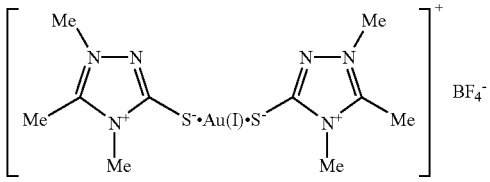

Mercapto Compound-1

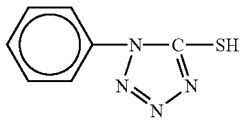

Mercapto Compound-2

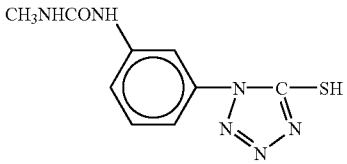

Preparation of Comparative Blue-Sensitive Emulsion B:

Emulsion B-1 was obtained in the same manner as in the preparation of Emulsion A-1, except that color-sensitizing dye B (mixture of color-sensitizing dyes-1, -2, -3 and-5 in a molar ratio of 2:3:1:4) was used in place of color-sensitizing dye A. Emulsion B-2 was obtained in the same manner as in the preparation of Emulsion A-2, except that color-sensitizing dye B was used in place of color-sensitizing dye A.

Color-Sensitizing Dye-5

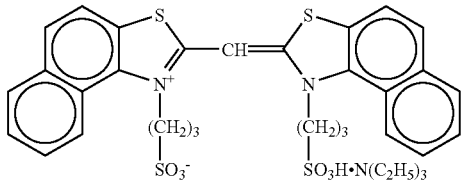

Preparation of Green-Sensitive Emulsion C of the Invention:

High-sensitive Emulsion C-1 and low-sensitive Emulsion C-2 for GL were prepared in the same manner as in the preparation of Emulsions A-1 and 2, except that the temperature in grain formation was lowered and the sensitizing dyes were varied to the following.

Sensitizing Dye D

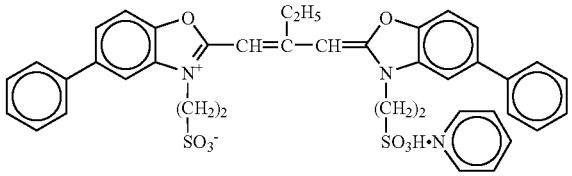

Sensitizing Dye E

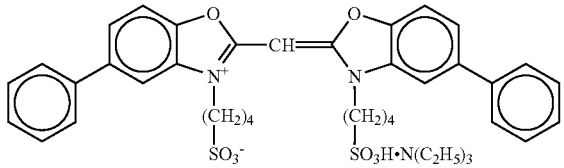

The mean grain size of the high-sensitive grains was 0.40 μm, and that of the low-sensitive grains was 0.30 μm. The grain size fluctuation coefficient of the grains was 8% all.

The amount of Sensitizing Dye D added to the silver halide grains was $3.0\times10^{-4}$ mols per mol of silver halide to the large-size grains and was $3.6\times10^{-4}$ mols to the small-size grains; and the amount of Sensitizing Dye E added to the silver halide grains was $4.0\times10^{-5}$ mols per mol of silver halide to the large-size grains and was $7.0\times10^{-5}$ mols to the small-size grains.

Preparation of Comparative Green-Sensitive Emulsion D:

High-sensitive Emulsion D-1 and low-sensitive Emulsion D-2 for GL were prepared in the same manner as in the preparation of Emulsions B-1 and 2, except that the temperature in grain formation was lowered and the sensitizing dyes were varied to the following.

The mean grain size of the high-sensitive grains was 0.50 μm, and that of the low-sensitive grains was 0.40 μm. The grain size fluctuation coefficient of the grains was 10% all.

The amount of Sensitizing Dye D added to the silver halide grains was $4.0\times10^{-4}$ mols per mol of silver halide to the large-size grains and was $4.5\times10^{-4}$ mols to the small-size grains; and the amount of Sensitizing Dye E added to the silver halide grains was $5.0\times10^{-5}$ mols per mol of silver halide to the large-size grains and was $8.8\times10^{-5}$ mols to the small-size grains.

Preparation of Red-Sensitive Emulsion E of the Invention:

High-sensitive Emulsion E-1 and low-sensitive Emulsion E -2 for RL were prepared in the same manner as in the preparation of Emulsions A-1 and 2, except that the temperature in grain formation was lowered and the sensitizing dyes were varied to the following.

Sensitizing Dye G

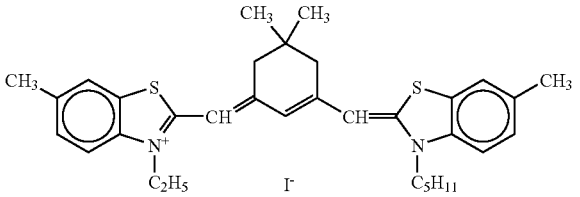

Sensitizing Dye H

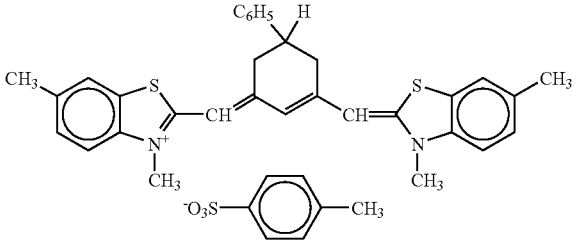

The mean grain size of the high-sensitive grains was 0.38 μm, and that of the low-sensitive grains was 0.32 μm. The grain size fluctuation coefficient of the grains was 9% and 10%, respectively.

Sensitizing Dyes G and H were added to the silver halide grains, each $8.0\times10^{-5}$ mols per mol of silver halide to the large-size grains and $10.7\times10^{-5}$ mols to the small-size grains.

In addition, $3.0\times10^{-3}$ mols, per mol of silver halide, of Compound I mentioned below was added to the red-sensitive emulsions.

Compound I

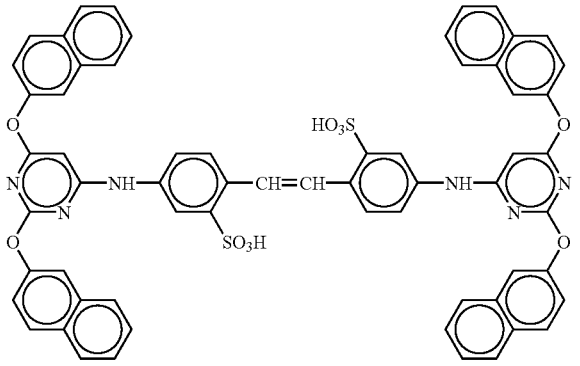

Preparation of Comparative Red-Sensitive Emulsion F:

High-sensitive Emulsion F-1 and low-sensitive Emulsion F-2 for RL were prepared in the same manner as in the preparation of Emulsions B-1 and 2, except that the temperature in grain formation was lowered and the sensitizing dyes were varied to the following.

The mean grain size of the high-sensitive grains was 0.57 μm, and that of the low-sensitive grains was 0.43 μm. The grain size fluctuation coefficient of the grains was 9% and 10%, respectively.

Sensitizing Dyes G and H were added to the silver halide grains, each $1.0\times10^{-4}$ mols per mol of silver halide to the large-size grains and $1.34\times10^{-4}$ mols to the small-size grains.

In addition, $3.0\times10^{-3}$ mols, per mol of silver halide, of Compound I was added to the red-sensitive emulsions.

Preparation of Coating Liquid for First Layer:

57 g of yellow coupler ExY, 7 g of color image stabilizer Cpd-1, 4 g of color image stabilizer Cpd-2, 7 g of color image stabilizer Cpd-3, and 2 g of color image stabilizer Cpd-8 were dissolved in 21 g of solvent Solv-1 and 80 ml of ethyl acetate. The resulting solution was emulsified and dispersed in 220 g of 23.5 wt. % gelatin solution containing 4 g of sodium dodecylbenzenesulfonate, by the use of a high-speed stirring emulsifying machine (dissolver), and water was added thereto to make 900 g of emulsified dispersion A.

Next, the emulsified dispersion A was mixed with the above-mentioned Emulsions A-1 and A-2 to prepare a coating liquid for the first layer having the composition mentioned below. The coating amount of the emulsion is in terms of the silver amount in the emulsion.

Coating liquids for the second to seventh layers were prepared in the same manner as in the preparation of the coating liquid for the first layer. The gelatin hardeners in each layer were 1-hydroxy-3,5-dichloro-s-triazine sodium salt H-1, and H-2, H-3mentioned below. Each layer contained Ab-1, Ab-2, Ab-3 and Ab-4 mentioned below, 15.0 mg/m², 60.0 mg/m², 5.0 mg/m² and 10.0 mg/m², respectively.

Hardener H-1

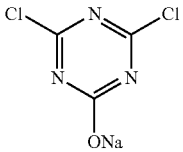

(1.4 wt. % per gelatin)

Hardener H-2

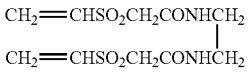

Hardener H-3

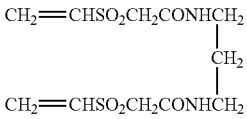

Antiseptic Ab-1

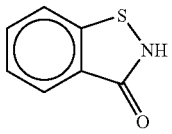

Antiseptic Ab-2

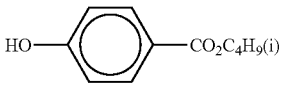

-continued

Antiseptic Ab-3

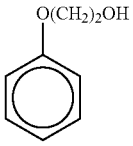

Antiseptic Ab-4

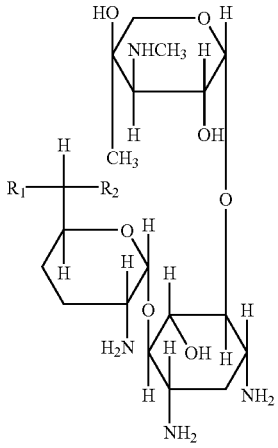

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

1/1/1/1 mixture, by mol, of a, b, c and d 1-(3-Methylureidophenyl)-5-mercaptotetrazole was added to the second, fourth, sixth and seventh layers, 0.2 mg/$m^2$, 0.2 mg/$m^2$, 0.6 mg/$m^2$ and 0.1 mg/$m^2$, respectively.

4-Hydroxy-6-methyl-1,3,3a,7-tetrazaindene was added to the blue-sensitive emulsion layer and the green-sensitive emulsion layer, $1\times10^{-4}$ mols and $2\times10^{-4}$ mols, respectively, per mol of silver halide.

A copolymer latex of methacrylic acid and butyl acrylate (1/1 by weight, having a mean molecular weight of from 200,000 to 400,000) was added to the red-sensitive emulsion layer, 0.05 g/$m^2$.

Disodium catechol-3,5-disulfonate was added to the second, fourth and sixth layers, 6 mg/$m^2$, 6 mg/$m^2$ and 18 mg/$m^2$, respectively.

For anti-irradiation, the following dyes were added to the layers, the coating amount parenthesized.

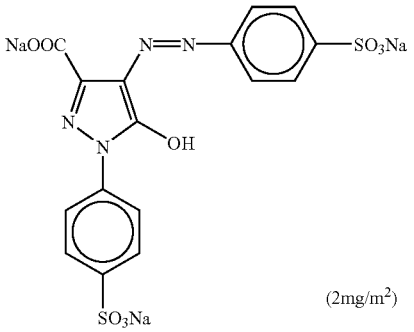

(2mg/$m^2$)

-continued

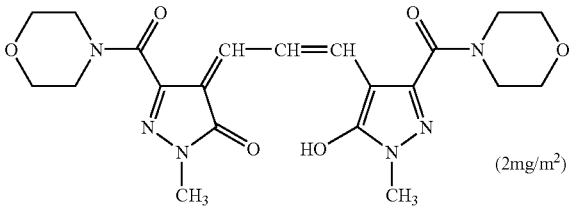

(2mg/$m^2$)

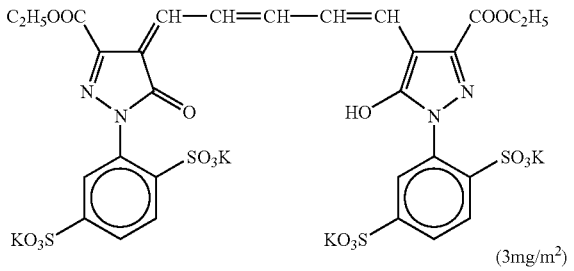

(3mg/$m^2$)

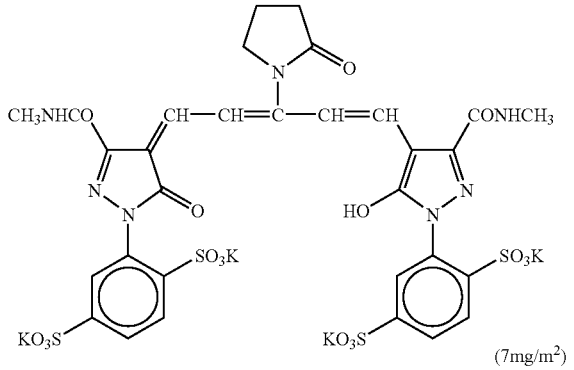

(7mg/$m^2$)

Layer Constitution:

The constitution of each layer in the photographic material produced herein is shown below. The numeral indicates the coating amount (g/$m^2$). The amount of the silver halide emulsion is in terms of the coating amount of silver therein.

<Support>

Polyethylene resin-laminated paper, in which the polyethylene resin on which the first layer is to be formed contains white pigments ($TiO_2$, its content was 16% by weight; ZnO, its content was 4% by weight), a fluorescent brightener (4,4'-bis(5-methylbenzoxazolyl)stilbene, its content was 0.03% by weight), and a blueing dye (ultramarine, its content was 0.33% by weight), and the amount of the polyethylene resin was 29.2 g/$m^2$.

<First Layer (blue-sensitive emulsion layer)>

| | |
|---|---|
| Silver chloride emulsion A-<1> (cubic grains sensitized with gold and sulfur, 4/6 (in terms of silver molar ratio) mixture of Emulsion A-1 and Emulsion A-2, having a mean grain size of 0.64 μm) | 0.24 |
| Gelatin | 1.25 |
| Yellow coupler ExY | 0.57 |
| Color image stabilizer Cpd-1 | 0.07 |
| Color image stabilizer Cpd-2 | 0.04 |
| Color image stabilizer Cpd-3 | 0.07 |
| Color image stabilizer Cpd-8 | 0.02 |
| Solvent Solv-1 | 0.21 |

-continued

| | |
|---|---|
| <Second Layer (color mixing preventing layer)> | |
| Gelatin | 1.15 |
| Color mixing preventing agent Cpd-4 | 0.10 |
| Color image stabilizer Cpd-5 | 0.018 |
| Color image stabilizer Cpd-6 | 0.13 |
| Color image stabilizer Cpd-7 | 0.07 |
| Solvent Solv-1 | 0.04 |
| Solvent Solv-2 | 0.12 |
| Solvent Solv-5 | 0.11 |
| <Third Layer (green-sensitive emulsion layer)> | |
| Silver chlorobromide emulsion C (cubic grains sensitized with gold and sulfur, 1/3 (in terms of silver molar ratio) mixture of large-size Emulsion C-1 and small-size Emulsion C-2) | 0.14 |
| Gelatin | 1.21 |
| Magenta coupler ExM | 0.15 |
| UV absorbent UV-A | 0.14 |
| Color image stabilizer Cpd-2 | 0.003 |
| Color mixing preventing agent Cpd-4 | 0.002 |
| Color image stabilizer Cpd-6 | 0.09 |
| Color image stabilizer Cpd-8 | 0.02 |
| Color image stabilizer Cpd-9 | 0.01 |
| Color image stabilizer Cpd-10 | 0.01 |
| Color image stabilizer Cpd-11 | 0.0001 |
| Solvent Solv-3 | 0.09 |
| Solvent Solv-4 | 0.18 |
| Solvent Solv-5 | 0.17 |
| <Fourth Layer (color mixing preventing layer)> | |
| Gelatin | 0.68 |
| Color mixing preventing agent Cpd-4 | 0.06 |
| Color image stabilizer Cpd-5 | 0.011 |
| Color image stabilizer Cpd-6 | 0.08 |
| Color image stabilizer Cpd-7 | 0.04 |
| Solvent Solv-1 | 0.02 |
| Solvent Solv-2 | 0.07 |
| Solvent Solv-5 | 0.065 |
| <Fifth Layer (red-sensitive emulsion layer)> | |
| Silver chlorobromide emulsion E (cubic grains sensitized with gold and sulfur, 5/5 (in terms of silver molar ratio) mixture of large-size Emulsion E-1 and small-size Emulsion E-2) | 0.16 |
| Gelatin | 0.95 |
| Cyan coupler ExC-1 | 0.023 |
| Cyan coupler ExC-2 | 0.05 |
| Cyan coupler ExC-3 | 0.17 |
| UV absorbent UV-A | 0.055 |
| Color image stabilizer Cpd-1 | 0.22 |
| Color image stabilizer Cpd-7 | 0.003 |
| Color image stabilizer Cpd-9 | 0.01 |
| Color image stabilizer Cpd-12 | 0.01 |
| Solvent Solv-8 | 0.05 |
| <Sixth Layer (UV absorbent layer)> | |
| Gelatin | 0.46 |
| UV absorbent UV-B | 0.35 |
| Compound S1-4 | 0.0015 |
| Solvent Solv-7 | 0.18 |
| <Seventh Layer (protective layer)> | |
| Gelatin | 1.00 |
| Acryl-modified copolymer of polyvinyl alcohol (degree of modification, 17%) | 0.4 |
| Liquid paraffin | 0.02 |
| Surfactant Cpd-13 | 0.02 |

The compounds used in this Example are mentioned below.

Yellow Coupler ExY

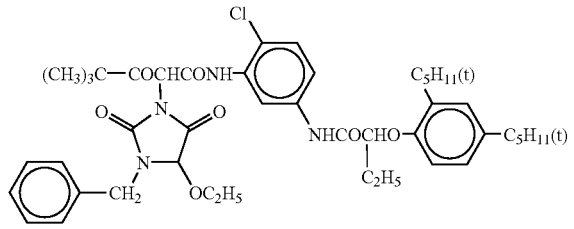

Magenta Coupler ExM

40:40:20 (by mol) mixture of the following:

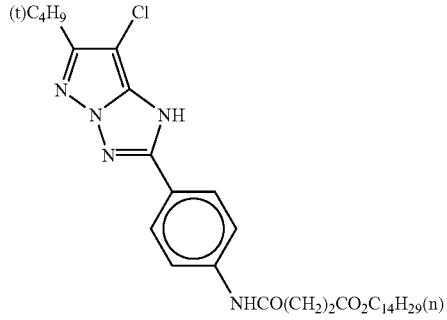

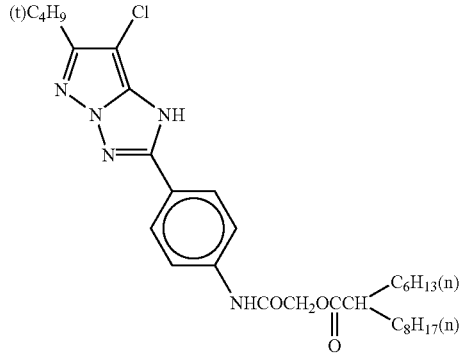

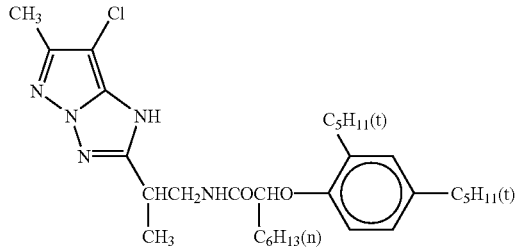

Cyan Coupler ExC-1

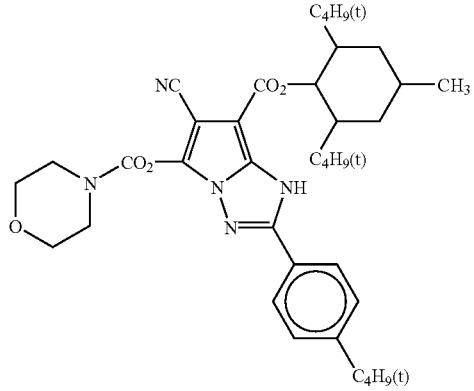

-continued

Cyan Coupler ExC-2

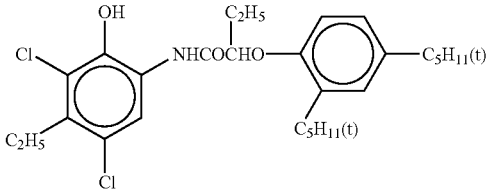

Cyan Coupler ExC-3

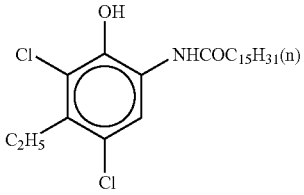

Cyan Coupler ExC-4

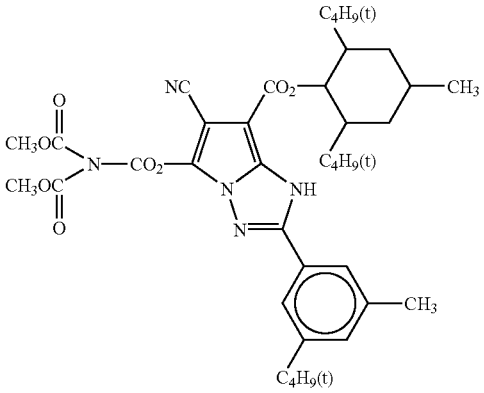

Cyan Coupler ExC-5

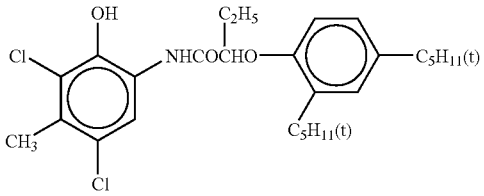

Color Image Stabilizer Cpd-1

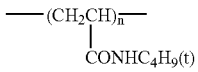

number-average molecular weight, 60,000

Color Image Stabilizer Cpd-2

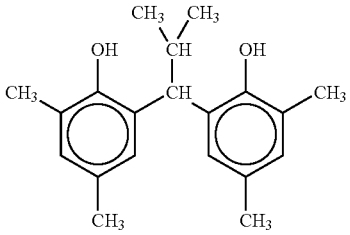

-continued

Color Image Stabilizer Cpd-3

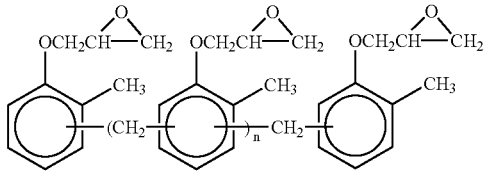

n = 7 to 8 on average

Color Mixing Preventing Agent Cpd-4

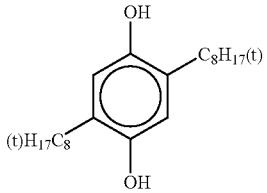

Color Image Stabilizer Cpd-5

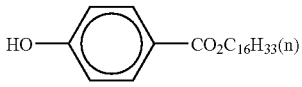

Color Image Stabilizer Cpd-6

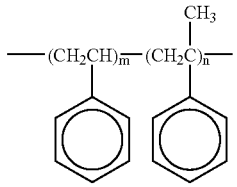

number-average molecular weight, 600 m/n = 10/90

Color Image Stabilizer Cpd-7

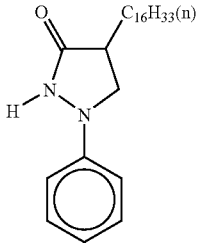

Color Image Stabilizer Cpd-8

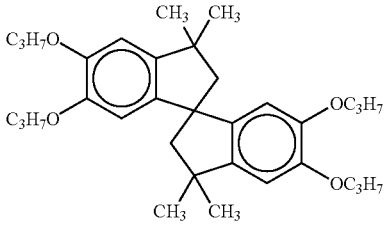

Color Image Stabilizer Cpd-9

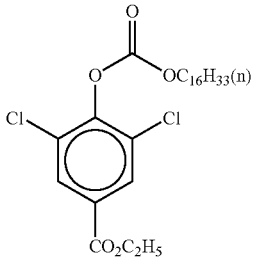

-continued
Color Image Stabilizer Cpd-10
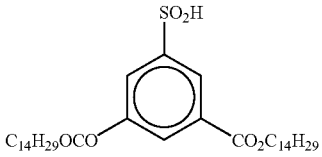
Cpd-11
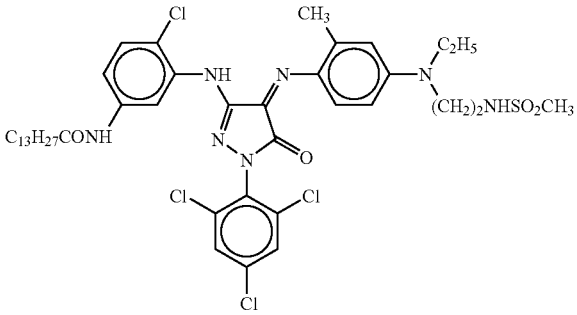
Cpd-12
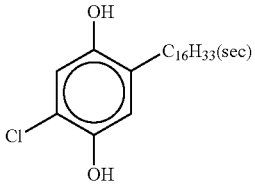
Surfacant Cpd-13
7:3 (by mol) mixture of the following
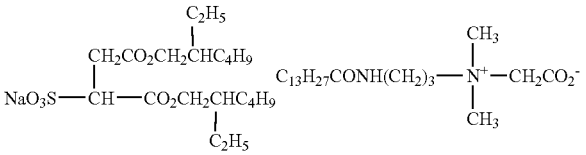
Cpd-14
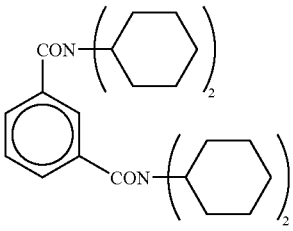
Cpd-15
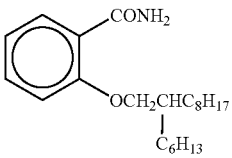
Cpd-16
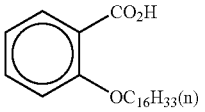
Cpd-17
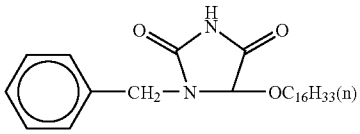
-continued
Cpd-18
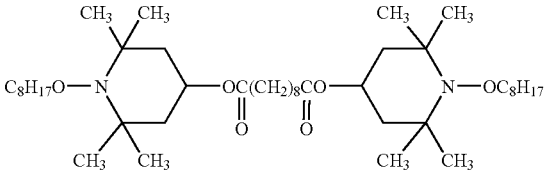
Color Mixing Preventing Agent Cpd-19
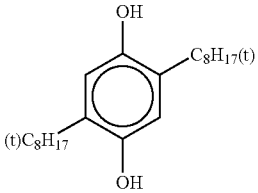
Cpd-20
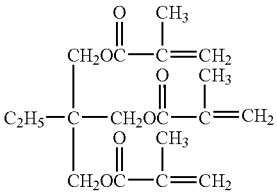
UV Absorbent UV-1
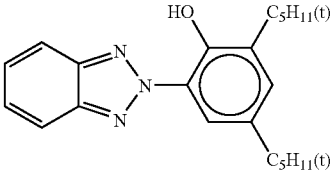
UV Absorbant UV-2
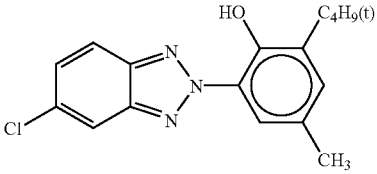
UV Absorbant UV-3
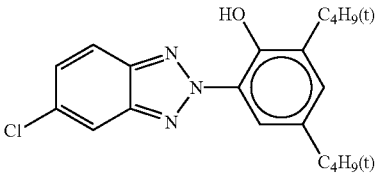
UV Absorbant UV-5
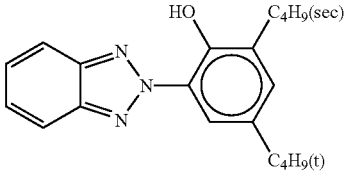
UV Absorbant UV-6
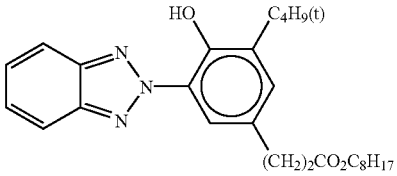

-continued

UV Absorbant UV-7

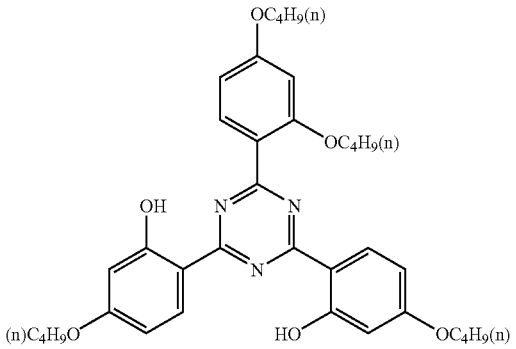

UV-A:mixture of UV-1/UV-2/UV-3=7/2/2 (by weight)

UV-B:mixture of UV-1/UV-2/UV-3/UV-5/UV-6=13/3/3/5/3 (by weight)

UV-C:mixture of UV-1/UV-3=9/1 (by weight)

Solv-1

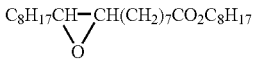

Solv-2

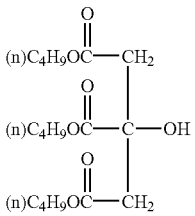

Solv-3

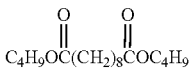

Solv-4

Solv-5

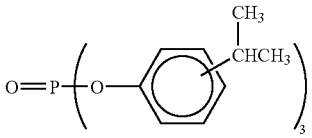

Solv-7

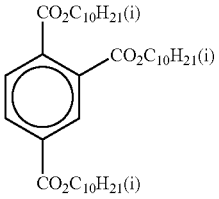

-continued

Solv-8

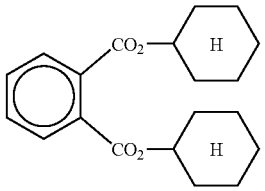

S1-4

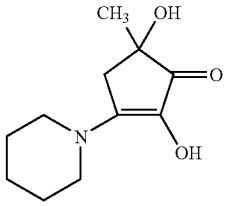

The other samples mentioned below were produced in the same manner as in the production of Sample 101 as above, except the following changes.

The details of the emulsions in the first layer of the following samples are as follows:

Emulsion A-<1>: 4:6 (in terms of silver molar ratio) mixture of Emulsions A-1 and A-2, having a mean grain size of 0.64 μm.

Emulsion A-<2>: 4:6 (in terms of silver molar ratio) mixture of Emulsions A-5 and A-1, having a mean grain size of 0.74 μm.

Emulsion A-<3>: 4:6 (in terms of silver molar ratio) mixture of Emulsions A-4 and A-3, having a mean grain size of 0.69 μm.

Emulsion A-<4>: 4:6 (in terms of silver molar ratio) mixture of Emulsions A-6 and A-2, having a mean grain size of 0.54 μm.

Emulsion B-<1>: 4:6 (in terms of silver molar ratio) mixture of Emulsions B-1 and B-2, having a mean grain size of 0.64 μm.

<Production of Sample 001>

Sample 001 was produced in the same manner as in the production of Sample 101, except that the silver halide emulsions for the first, third and fifth layers were changed to the following.

Silver Halide Emulsion for First Layer:

Silver chloride emulsion B-<1> (cubic grains sensitized with gold and sulfur, 4/6 (in terms of silver molar ratio) mixture of Emulsion B-1 and small-size Emulsion B-2, having a mean grain size of 0.64 μm).

Silver Halide Emulsion for Third Layer:

Silver chlorobromide emulsion D (cubic grains sensitized with gold and sulfur, 1/3 (in terms of silver molar ratio) mixture of large-size Emulsion D-1 and small-size Emulsion D-2).

Silver Halide Emulsion for Fifth Layer:

Silver chlorobromide emulsion F (cubic grains sensitized with gold and sulfur, 5/5 (in terms of silver molar ratio) mixture of large-size Emulsion F-1 and small-size Emulsion F-2).

<Production of Sample 002>

Sample 002 was produced in the same manner as in the production of Sample 101, except that the silver halide emulsion for the first layer, B-<1> in Sample 001 was changed to A-<1>.

<Production of Sample 102>

Sample 102 was produced in the same manner as in the production of Sample 101, except that the amount of ultramarine in the polyethylene resin on the surface of the support to be coated with emulsion layers was reduced to 70%.

<Production of Sample 103>

Sample 103 was produced in the same manner as in the production of Sample 101, except that the amount of ultramarine in the polyethylene resin on the surface of the support to be coated with emulsion layers was reduced to 50%.

<Production of Sample 104>

Sample 104 was produced in the same manner as in the production of Sample 101, except that the coating amount of the sixth layer was reduced to 70%.

<Production of Sample 105>

A support similar to the support used for Sample 101 was prepared, in which, however, ultramarine was removed from the polyethylene resin on the surface to be coated with emulsion layers. Sample 105 was produced in the same manner as in the production of Sample 101, except that Dispersion B prepared by mixing yellow coupler, color image stabilizers, solvent and auxiliary solvent along with pigments, Ciba Speciality Chemicals' Blue A3R-K and Violet B-K followed by uniformly emulsifying and dispersing them was used for the coating liquid for the first layer and the coating liquid was applied to the ultramarine-free support as above. The coating amount of Blue A3R-K was 0.0018 g/m$^2$; and that of Violet B-K was 0.0012 g/m$^2$.

<Production of Sample 111>

Sample 111 was produced in the same manner as in the production of Sample 101, except that the silver halide emulsion in the first layer was changed from A-<1> to A-<2>.

<Production of Sample 121>

Sample 121 was produced in the same manner as in the production of Sample 101, except that the silver halide emulsion in the first layer was changed from A-<1> to A-<3>.

<Production of Sample 131>

Sample 131 was produced in the same manner as in the production of Sample 101, except that the silver halide emulsion in the first layer was changed from A-<1> to A-<4>.

<Production of Sample 112>

Sample 112 was produced in the same manner as in the production of Sample 102, except that the silver halide emulsion in the first layer was changed from A-<1> to A-<2>.

<Production of Sample 113>

Sample 113 was produced in the same manner as in the production of Sample 103, except that the silver halide emulsion in the first layer was changed from A-<1> to A-<2>.

<Production of Sample 114>

Sample 114 was produced in the same manner as in the production of Sample 104, except that the silver halide emulsion in the first layer was changed from A-<1> to A-<2>.

<Production of Sample 115>

Sample 115 was produced in the same manner as in the production of Sample 105, except that the silver halide emulsion in the first layer was changed from A-<1> to A-<2>.

The samples were processed according to the process A for development.

<Development A>

Each photographic material sample was rolled into a roll having a width of 127 mm, and set in Fuji Photo Film's Minilabo Printer Processor PP350, in which the sample was imagewise exposed through a negative film having an average density, and then continuously processed according to the process mentioned below until the amount of the color developer replenisher mounted two times the color developer bath volume (running test) The treatment with the running solution is referred to as Treatment A.

Processing Steps [temperature/time/amount of replenisher]

| | |
|---|---|
| Color development | 38.5° C./45 seconds/45 ml |
| Blix | 38.0° C./45 seconds/35 ml |
| Rinse 1 | 38.0° C./20 seconds/- |
| Rinse 2 | 38.0° C./20 seconds/- |
| Rinse 3 | 38.0° C./20 seconds/- |
| Rinse 4 | 38.0° C./20 seconds/121 ml |
| Drying | 80° C./38 seconds |

In the above process, the "amount of replenisher" is per m$^2$ of the photographic material.

In the process, Fuji Photo Film's Rinse Cleaning System RC50D was set in the zone of rinse 3, and the rinsing solution was taken out of the zone of rinse 3 and fed to a reverse osmosis module RC50D via a pump. The water having passed through the module was fed to the zone of rinse 4, and the remaining concentrate was returned back to the zone of rinse 3. The pump pressure was controlled so that the water passing through the reverse osmosis module could be from 50 to 300 ml/min, and the rinsing solution was circulated for 10 hours/day in that manner. The rinsing system was a four-bath countercurrent system from the rinse bath 1 to the rinse bath 4.

The composition of each processing solution used herein is mentioned below.

Color Developer (bath solution/replenisher):

| | |
|---|---|
| Water | 800 ml/800 ml |
| Fluorescent brightener (FL-1) | 2.2 g/5.1 g |
| Fluorescent brightener (FL-2) | 0.35 g/1.75 g |
| Triisopropanolamine | 8.8 g/8.8 g |
| Polyethylene glycol having a mean molecular weight of 300 | 10.0 g/10.0 g |
| Ethylenediamine-tetraacetic acid | 4.0 g/4.0 g |
| Sodium sulfite | 0.10 g/0.20 g |
| Potassium chloride | 10.0 g/- |
| 4,5-Dihydroxybenzene-1,3-sodium disulfonate | 0.50 g/0.50 g |
| Disodium-N,N-bis(sulfonatoethyl)hydroxylamine | 8.5 g/14.0 g |
| 4-Amino-3-methyl-N-ethyl-N-(β-methanesulfonamidoethyl)-aniline · 3/2 sulfate · monohydrate | 4.8 g/14.0 g |
| Potassium carbonate | 26.3 g/26.3 g |
| Water to make | 1000 ml/1000 ml |
| pH (at 25° C., adjusted with sulfuric acid and KOH) | 10.15/12.50 |

-continued

| Blix Solution (bath solution/replenisher): | |
|---|---|
| Water | 800 ml/800 ml |
| Ammonium thiosulfate (750 g/liter) | 107 ml/214 ml |
| M-carboxybenzenesulfinic acid | 8.3 g/16.5 g |
| Ammonium iron (III) ethylenediaminetetraacetate | 47.0 g/94.0 g |
| Ethylenediamine-tetraacetic acid | 1.4 g/2.8 g |
| Nitric acid (67%) | 16.5 g/33.0 g |
| Imidazole | 14.6 g/29.2 g |
| Ammonium sulfite | 16.0 g/32.0 g |
| Potassium metabisulfite | 23.1 g/46.2 g |
| Water to make | 1000 ml/1000 ml |
| pH (at 25° C., adjusted with nitric acid aqueous ammonia) | 6.5/6.5 |
| Rinsing Solution (bath solution/replenisher) | |
| Sodium chloroisocyanurate | 0.02 g/0.02 g |
| Deionized water (electroconductivity, at most 5 μS/cm) | 000 ml/1000 ml |
| pH (at 25° C.) | 6.5/6.5 |

At a wavelength of 450 nm, 550 nm and 650 nm, the reflection density A(450), A(550) and A(650) of the white background area (non-exposed portion) of each processed sample was measured with a spectrophotometer, Hitachi's U-3410 Model.

To evaluate the whiteness change by natural radiations in each sample during storage, each sample was uniformly exposed to X rays (120 kV, 1/10 seconds), and then processed for the same color development A as above. Thus processed, the whiteness of each sample was measured in the same manner as above. The results are given in Table 2.

<Evaluation of white Background>

50 panelists checked the processed samples under a fluorescent lamp F8 for color evaluation to sensually evaluate the white background (non-exposed portion) thereof according to the criteria (points) mentioned below. The points of each sample given by 50 panelists were averaged. The higher average means that the sample has a higher degree of whiteness.

5: Very good.

4: Good.

3: Average.

2: Relatively bad.

1: Bad.

TABLE 2

| Sample | Grain Size | A(450) | A(550) | A(650) | A(550)/A(450) | A(650)/A(450) | Whiteness (before exposed to X rays) | Whiteness (after exposed to X rays) | Relation to the Invention |
|---|---|---|---|---|---|---|---|---|---|
| 001 | 0.64 (μm) | 0.076 | 0.081 | 0.067 | 1.07 | 0.88 | 2.5 | 2.1 | Comparative Sample |
| 002 | 0.64 (μm) | 0.072 | 0.081 | 0.067 | 1.13 | 0.93 | 2.8 | 2.7 | Comparative Sample |
| 101 | 0.64 (μm) | 0.063 | 0.078 | 0.063 | 1.24 | 1.00 | 4.2 | 4.1 | Sample of the Invention |
| 102 | 0.64 (μm) | 0.061 | 0.065 | 0.050 | 1.07 | 0.82 | 4.6 | 4.4 | Sample of the Invention |
| 103 | 0.64 (μm) | 0.057 | 0.053 | 0.040 | 0.93 | 0.70 | 4.8 | 4.6 | Sample of the Invention |
| 104 | 0.64 (μm) | 0.063 | 0.078 | 0.063 | 1.24 | 1.00 | 4.6 | 4.5 | Sample of the Invention |
| 105 | 0.64 (μm) | 0.059 | 0.067 | 0.053 | 1.14 | 0.90 | 4.6 | 4.5 | Sample of the Invention |
| 111 | 0.74 (μm) | 0.060 | 0.078 | 0.063 | 1.30 | 1.05 | 4.1 | 2.2 | Comparative Sample |
| 121 | 0.69 (μm) | 0.062 | 0.078 | 0.063 | 1.26 | 1.02 | 4.0 | 3.7 | Sample of the Invention |
| 131 | 0.54 (μm) | 0.063 | 0.078 | 0.063 | 1.24 | 1.00 | 3.9 | 3.9 | Sample of the Invention |
| 112 | 0.74 (μm) | 0.057 | 0.065 | 0.050 | 1.14 | 0.88 | 4.3 | 2.3 | Comparative Sample |
| 113 | 0.74 (μm) | 0.055 | 0.053 | 0.040 | 0.96 | 0.73 | 4.8 | 2.2 | Comparative Sample |
| 114 | 0.74 (μm) | 0.061 | 0.078 | 0.063 | 1.28 | 1.03 | 4.7 | 2.2 | Comparative Sample |
| 115 | 0.74 (μm) | 0.059 | 0.067 | 0.053 | 1.14 | 0.90 | 4.5 | 2.4 | Comparative Sample |

Table 2 confirms the effect of the invention. Concretely, the samples of which the reflection density of the white background is within the range of the invention before they are exposed to X rays and which satisfy the requirement of the invention in point of the grain size of the silver halide grains therein still have a high degree of whiteness even after being exposed to X rays; but the whiteness of the samples which do not satisfy the requirement of the invention in point of the grain size of the silver halide grains therein greatly lowered after the samples were exposed to X rays. This means that the samples not satisfying the requirement of the invention are not resistant to natural radiations. On the other hand, the whiteness of the samples not satisfying the requirement of the invention in point of the reflection density of the white background thereof, even though satisfying the requirement of the invention in point of the grain size of the silver halide grains therein, is low before being exposed to X rays, and it further lowers after being exposed to X rays.

Example 2

Samples were produced in the same manner as in Example 1, except that the fifth layer of each sample was changed to the following. The samples produced herein are numbered like those of the samples in Example 1, except that their numbers are "2XXX" in which XXX corresponds to that of the samples in Example 1. The samples were processed according to the process A for development as in Example 1, and the thus-processed samples were sensually evaluated for the whiteness thereof in the same manner as in Example 1. In addition, the values L*a*b* in the non-exposed portion of the processed samples were measured, using a color analyzer, Hitachi's C-2000 Model, and an ordinary xenon light source. D65 is the white point. The results are given in Table 3.

| | |
|---|---|
| <Fifth Layer> | 0.10 |
| Silver chlorobromide emulsion E (cubic grains sensitized with gold and sulfur, 5/5 (in terms of silver molar ratio) mixture of large-size Emulsion E-1 and small-size Emulsion E-2) | |
| Gelatin | 1.11 |
| Cyan coupler ExC-1 | 0.02 |
| Cyan coupler ExC-3 | 0.01 |
| Cyan coupler ExC-4 | 0.11 |
| Cyan coupler ExC-5 | 0.01 |
| Color image stabilizer Cpd-1 | 0.01 |
| Color image stabilizer Cpd-6 | 0.06 |
| Color image stabilizer Cpd-7 | 0.02 |
| Color image stabilizer Cpd-9 | 0.04 |
| Color image stabilizer Cpd-10 | 0.01 |
| Color image stabilizer Cpd-14 | 0.01 |
| Color image stabilizer Cpd-15 | 0.12 |
| Color image stabilizer Cpd-16 | 0.01 |
| Color image stabilizer Cpd-17 | 0.01 |
| Color image stabilizer Cpd-18 | 0.07 |
| Color image stabilizer Cpd-20 | 0.01 |
| UV absorbent UV-7 | 0.01 |
| Solvent Solv-5 | 0.15 |

TABLE 3

| Sample | Grain Size | L* | a* | b* | Whiteness (before exposed to X rays) | Whiteness (after exposed to X rays) | Relation to the Invention |
|---|---|---|---|---|---|---|---|
| 2001 | 0.64 (μm) | 91.0 | 0.9 | -4.0 | 2.6 | 2.5 | Comparative Sample |
| 2002 | 0.64 (μm) | 91.1 | 0.9 | −4.6 | 3.0 | 2.9 | Comparative Sample |
| 2101 | 0.64 (μm) | 91.5 | 1.1 | −6.0 | 4.0 | 3.8 | Sample of the Invention |
| 2102 | 0.64 (μm) | 92.3 | 1.0 | −5.2 | 4.2 | 4.0 | Sample of the Invention |
| 2103 | 0.64 (μm) | 93.2 | 0.9 | −3.2 | 4.8 | 4.6 | Sample of the Invention |
| 2104 | 0.64 (μm) | 92.3 | 1.1 | −6.9 | 4.6 | 4.5 | Sample of the Invention |
| 2105 | 0.64 (μm) | 92.3 | 1.1 | −6.0 | 4.7 | 4.5 | Sample of the Invention |
| 2111 | 0.74 (μm) | 91.7 | 1.1 | −6.2 | 4.1 | 2.3 | Comparative Sample |
| 2121 | 0.69 (μm) | 91.6 | 1.1 | −6.1 | 4.0 | 3.6 | Sample of the Invention |
| 2131 | 0.54 (μm) | 91.6 | 1.1 | −6.2 | 3.9 | 3.9 | Sample of the Invention |
| 2112 | 0.74 (μm) | 92.4 | 1.0 | −5.4 | 4.3 | 2.3 | Comparative Sample |
| 2113 | 0.74 (μm) | 92.8 | 0.9 | −3.4 | 4.7 | 2.4 | Comparative Sample |
| 2114 | 0.74 (μm) | 92.5 | 1.1 | −7.1 | 4.7 | 2.3 | Comparative Sample |
| 2115 | 0.74 (μm) | 92.4 | 1.1 | −6.1 | 4.8 | 2.5 | Comparative Sample |

Table 3 confirms the effect of the invention. Concretely, the samples of which the values L*a*b* of the white background are within the range of the invention before they are exposed to X rays and which satisfy the requirement of the invention in point of the grain size of the silver halide grains therein still have a high degree of whiteness even after being exposed to X rays; but the whiteness of the samples which do not satisfy the requirement of the invention in point of the grain size of the silver halide grains therein greatly lowered after the samples were exposed to X rays. This means that the samples not satisfying the requirement of the invention are not resistant to natural radiations. On the other hand, the whiteness of the samples of which the values L*a*b* of the white background are outside the range of the invention, even though satisfying the requirement of the invention in point of the grain size of the silver halide grains therein, is low before exposed to X rays, and it further lowers after being exposed to X rays.

Example 3

The samples of Example 1 were processed according to the process B for development mentioned below, and not the process A, and the processed samples were evaluated in the same manner as in Example 1. Like those in Example 1, the samples processed herein also confirmed the effect of the invention.

<Development B>

Each photographic material sample was rolled into a roll having a width of 127 mm, and set in a laboratory processor modified from Fuji Photo Film's Minilabo Printer Processor PP350. The laboratory processor was modified from it so that the processing time and the processing temperature could be varied. In this, the sample was imagewise exposed through a negative film having an average density, and then continuously processed according to the process mentioned below until the amount of the color developer replenisher mounted two times the color developer bath volume (running test). The treatment with the running solution is referred to as Treatment B.

Processing Steps [temperature/time/amount of replenisher]

| | |
|---|---|
| Color development | 45.0° C./20 seconds/45 ml |
| Blix | 40.0° C./20 seconds/35 ml |
| Rinse 1 | 40.0° C./8 seconds/- |
| Rinse 2 | 40.0° C./8 seconds/- |
| Rinse 3 | 40.0° C./8 seconds/- |
| Rinse 4 | 38.0° C./8 seconds/121 ml |
| Drying | 80° C./15 seconds |

In the above process, the "amount of replenisher" is per $m^2$ of the photographic material.

In the process, Fuji Photo Film's Rinse Cleaning System RC50D was set in the zone of rinse 3, and the rinsing solution was taken out of the zone of rinse 3 and fed to a reverse osmosis module RC50D via a pump. The water having passed through the module was fed to the zone of rinse 4, and the remaining concentrate was returned back to the zone of rinse 3. The pump pressure was so controlled that the water passing through the reverse osmosis module could be from 50 to 300 ml/min, and the rinsing solution was circulated for 10 hours/day in that manner. The rinsing system was a four-bath countercurrent system from the rinse bath 1 to the rinse bath 4.

The composition of each processing solution used herein is mentioned below.

| Color Developer (bath solution/replenisher): | |
|---|---|
| Water | 800 ml/800 ml |
| Fluorescent brightener (FL-3) | 4.0 g/8.0 g |
| Decoloration promoter (SR-1) | 3.0 g/5.5 g |
| Triisopropanolamine | 8.8 g/8.8 g |
| Sodium p-toluenesulfonate | 10.0 g/10.0 g |
| Ethylenediamine-tetraacetic acid | 4.0 g/4.0 g |
| Sodium sulfite | 0.10 g/0.10 g |
| Potassium chloride | 10.0 g/- |
| Sodium 4,5-Dihydroxybenzene-1,3-disulfonate | 0.50 g/0.50 g |
| Disodium-N,N-bis(sulfonatoethyl)hydroxylamine | 8.5 g/14.0 g |
| 4-Amino-3-methyl-N-ethyl-N-(β-methanesulfonamidoethyl)-aniline · 3/2 sulfate · monohydrate | 7.0 g/19.0 g |
| Potassium carbonate | 26.3 g/26.3 g |
| Water to make | 1000 ml/1000 ml |
| pH (at 25° C., adjusted with sulfuric acid and KOH) | 10.25/12.6 |
| **Blix Solution (bath solution/replenisher):** | |
| Water | 800 ml/800 ml |
| Ammonium thiosulfate (750 g/liter) | 107 ml/214 ml |
| Succinic acid | 29.5 g/59.0 g |
| Ammonium iron (III) ethylenediaminetetraacetate | 47.0 g/94.0 g |
| Ethylenediamine-tetraacetic acid | 1.4 g/2.8 g |
| Nitric acid (67%) | 17.5 g/35.0 g |
| Imidazole | 14.6 g/29.2 g |
| Ammonium sulfite | 16.0 g/32.0 g |
| Potassium metabisulfite | 23.1 g/46.2 g |
| Water to make | 1000 ml/1000 ml |
| pH (at 25° C., adjusted with nitric acid and aqueous ammonia) | 6.00/6.00 |
| **Rinsing Solution (bath solution/replenisher)** | |
| Sodium chloroisocyanurate | 0.02 g/0.02 g |
| Deionized water (electroconductivity, at most 5 μS/cm) | 1000 ml/1000 ml |
| pH (at 25° C.) | 6.5/6.5 |

Example 4

Preparation of Emulsion Ba:

In an ordinary method of mixing silver nitrate and sodium chloride in an aqueous gelatin solution with stirring, an emulsion of cubic high-silver chloride grains having a mean grain size of 0.73 μm and a grain size fluctuation coefficient of 10% was prepared. In this method, however, $Cs_2[OsCl_5(NO)]$ was added to the system in the stage in which from 60% to 80% of silver nitrate was added thereto, and $K_4[Ru(CN)_6]$ was thereto in the stage in which from 80% to 90% of silver nitrate was added to the system. After 90% of silver nitrate had been added, potassium iodide (its amount was 0.1 mol % per mol of finished silver halide) was added to the system. Further, in the stage in which from 92% to 98% of silver nitrate was added, $K_2[Ir(H_2O)Cl_5]$ was added to the system. The resulting emulsion was desalted, and re-dispersed in gelatin added thereto. Sodium thiosulfonate and Color-Sensitizing Dye A were added to the emulsion, which was then optimally ripened with a sulfur sensitizer, sodium thiosulfate 5-hydrate, and a gold sensitizer, bis(1,4,5-trimethyl-1,2,4-triazolium-3-thiolato)aurate(I) tetrafluoroborate added thereto. Further, 1-phenyl-5-mercaptotetrazole and 1-(5-methylureidophenyl)-5-mercaptotetrazole were added to the emulsion. Thus prepared, this was Emulsion Ba.

Preparation of Emulsion Bb:

In the same manner as in the preparation of Emulsion Ba as above, except that the time for which silver nitrate and sodium chloride were added to the system was varied, an emulsion of cubic high-silver chloride grains having a mean grain size of 0.65 μm and a grain size fluctuation coefficient of 10% was prepared. $Cs_2[OsCl_5(NO)]$, $K_4[Ru(CN)_6]$ and $K_2[Ir(H_2O)Cl_5]$ were added to the system in the same manner as above. After 90% of silver nitrate had been added, potassium iodide (its amount was 0.15 mol % per mol of finished silver halide) was added to the system. The resulting emulsion was desalted, and re-dispersedin gelatin added thereto. Like Emulsion Ba, this was also subjected to the same spectral sensitization and chemical sensitization as above. Thus prepared, this was Emulsion Bb.

Preparation of Emulsion Bc:

In the same manner as in the preparation of Emulsion Ba as above, except that the time for which silver nitrate and sodium chloride were added to the system was varied, an emulsion of cubic high-silver chloride grains having a mean grain size of 0.55 μm and a grain size fluctuation coefficient of 10% was prepared. $Cs_2[OsCl_5(NO)]$, $K_4[Ru(CN)_6]$ and $K_2[Ir(H_2O)Cl_5]$ were added to the system in the same manner as above. After 90% of silver nitrate had been added, potassium iodide (its amount was 0.23 mol % per mol of finished silver halide) was added to the system. The resulting emulsion was desalted, and re-dispersed in gelatin added thereto. Like Emulsion Ba, this was also subjected to the same spectral sensitization and chemical sensitization as above. Thus prepared, this was Emulsion Bc.

Preparation of Emulsion Bd:

In the same manner as in the preparation of Emulsion Ba as above, except that the time for which silver nitrate and sodium chloride were added to the system was varied, an emulsion of cubic high-silver chloride grains having a mean grain size of 0.45 μm and a grain size fluctuation coefficient of 10% was prepared. $Cs_2[OsCl_5(NO)]$, $K_4[Ru(CN)_6]$ and $K_2[Ir(H_2O)Cl_5]$ were added to the system in the same manner as above. After 90% of silver nitrate had been added, potassium iodide (its amount was 0.32 mol % per mol of finished silver halide) was added to the system. The resulting emulsion was desalted, and re-dispersed in gelatin added thereto. Like Emulsion Ba, this was also subjected to the same spectral sensitization and chemical sensitization as above. Thus prepared, this was Emulsion Bd.

Preparation of Emulsion Be:

An emulsion was prepared in the same manner as in the preparation of Emulsion Ba as above, except that $K_2[Ir(5\text{-methylthiazole})Cl_5]$ but not $K_2[Ir(H_2O)Cl_5]$ was added to the system in the stage in which from 92% to 98% of silver nitrate was added thereto. This was Emulsion Be.

Preparation of Emulsion Bf:

An emulsion was prepared in the same manner as in the preparation of Emulsion Bb as above, except that $K_2[Ir(5\text{-methylthiazole})\ Cl_5]$ but not $K_2[Ir(H_2O)Cl_5]$ was added to the system in the stage in which from 92% to 98% of silver nitrate was added thereto. This was Emulsion Bf.

Preparation of Emulsion Bg:

An emulsion was prepared in the same manner as in the preparation of Emulsion Bc as above, except that $K_2[Ir(5\text{-methylthiazole})Cl_5]$ but not $K_2[Ir(H_2O)Cl_5]$ was added to the system in the stage in which from 92% to 98% of silver nitrate was added thereto. This was Emulsion Bg.

Preparation of Emulsion Bh:

An emulsion was prepared in the same manner as in the preparation of Emulsion Bd as above, except that $K_2[Ir(5\text{-methylthiazole})Cl_5]$ but not $K_2[Ir(H_2O)Cl_5]$ was added to the system in the stage in which from 92% to 98% of silver nitrate was added thereto. This was Emulsion Bh.

Samples were produced in the same manner as in the production of Sample 101 in Example 1, except that the silver chloride emulsion A-<1> in the blue-sensitive emulsion layer was changed to the emulsion as in Table 4 below.

Using a sensitometer, each sample was exposed for 0.1 seconds and 0.0001 seconds for gradation exposure for yellow sensitometry. Thus exposed samples were processed according to the process for development A in Example 1, and the yellow color density of each sample was measured. The reciprocal of the exposure amount necessary for obtaining a reflection density of 0.7 for exposure for 0.0001 seconds was read, and this indicates the sensitivity of each sample. Based on the sensitivity, 100, of the sample containing Emulsion Ba, the relative sensitivity, S, of each sample was obtained. The samples having a larger value S have a higher sensitivity and are more favorable. $DS_{0.1}$ indicates the reflection density of each sample exposed to light of which the intensity of illumination for exposure is larger by 0.5 log E than that necessary for obtaining a reflection density of 0.7 when the sample is exposed to the light for a period of 0.1 seconds; and $DS_{0.0001}$ indicates the reflection density of each sample exposed to light of which the intensity of illumination for exposure is larger by 0.5 log E than that necessary for obtaining a reflection density of 0.7 when the sample is exposed to the light for a period of 0.0001 seconds. The value of $DS_{0.1}-DS_{0.0001}$ indicates the reflection density difference between exposure for 0.1 seconds and exposure for 0.0001 seconds, and the samples having a smaller value of $DS_{0.1}-DS_{0.0001}$ are better as their shoulder contrast in short-time exposure is lowered little.

Using a spectrophotometer, Hitachi's U-3410 Model, the reflection density A(450), A(550) and A(650) in the white background (non-exposed portion) of each processed sample was measured, like in Example 1.

Apart from this, X rays were applied to each sample before the samples were imagewise exposed to light, like in Example 1, and the fog density increase D in each sample was measured. This is to test how and to what degree the samples are fogged by natural radiations. The samples having a smaller value D are better, as their background whiteness is lowered little by natural radiations.

The results are given in Table 4 below.

TABLE 4

| Sample | Emulsion | Grain Size | S | $DS_{0.1}-DS_{0.0001}$ | D | A(450) | A(550) | A(650) | Remarks |
|---|---|---|---|---|---|---|---|---|---|
| 401 | Ba | 0.73 μm | 100 | 0.38 | 0.09 | 0.063 | 0.067 | 0.048 | Comparative Sample |
| 402 | Bb | 0.65 μm | 103 | 0.48 | 0.07 | 0.058 | 0.067 | 0.048 | Sample of the Invention |
| 403 | Bc | 0.55 μm | 105 | 0.45 | 0.07 | 0.057 | 0.067 | 0.048 | Sample of the Invention |

TABLE 4-continued

| Sample | Emulsion | Grain Size | S | $DS_{0.1}-DS_{0.0001}$ | D | A(450) | A(550) | A(650) | Remarks |
|---|---|---|---|---|---|---|---|---|---|
| 404 | Bd | 0.45 μm | 105 | 0.39 | 0.04 | 0.055 | 0.067 | 0.048 | Sample of the Invention |
| 405 | Be | 0.73 μm | 138 | 0.06 | 0.19 | 0.064 | 0.067 | 0.048 | Comparative Sample |
| 406 | Bf | 0.65 μm | 138 | 0.05 | 0.09 | 0.057 | 0.067 | 0.048 | Sample of the Invention |
| 407 | Bg | 0.55 μm | 134 | 0.06 | 0.07 | 0.054 | 0.067 | 0.048 | Sample of the Invention |
| 408 | Bh | 0.45 μm | 138 | 0.06 | 0.04 | 0.054 | 0.067 | 0.048 | Sample of the Invention |

The results in Table 4 obviously confirm that the samples 402 to 404 and406 to 408 of the invention all have high whiteness after processed, and have high sensitivity, and their shoulder contrast is lowered little in short-time exposure, and, in addition, their whiteness is lowered little by natural radiations. In particular, the samples 406 to 408 of the invention have a value of $DS_{0.1}-DS_{0.0001}$ of not larger than 0.3, and have extremely high sensitivity, and they are very good.

Example 5

Samples were produced in the same manner as in Example 4, except that the emulsion for the blue-sensitive emulsion layer was varied to that as in Table 5 below and the silver amount in the blue-sensitive emulsion layer was varied to that as in Table 5.

TABLE 5

| Sample | Emulsion | Grain Size | Silver Amount | S | $DS_{0.1}-DS_{0.0001}$ | D | Remarks |
|---|---|---|---|---|---|---|---|
| 501 | Bf | 0.65 μm | 0.24 | 138 | 0.05 | 0.09 | Sample of the Invention |
| 502 | Bf | 0.65 μm | 0.22 | 136 | 0.05 | 0.07 | Sample of the Invention |
| 503 | Bf | 0.65 μm | 0.20 | 136 | 0.06 | 0.06 | Sample of the Invention |
| 504 | Bf | 0.65 μm | 0.18 | 134 | 0.05 | 0.04 | Sample of the Invention |
| 505 | Bh | 0.45 μm | 0.24 | 138 | 0.06 | 0.04 | Sample of the Invention |
| 506 | Bh | 0.45 μm | 0.22 | 136 | 0.05 | 0.03 | Sample of the Invention |
| 507 | Bh | 0.45 μm | 0.20 | 134 | 0.06 | 0.03 | Sample of the Invention |
| 508 | Bh | 0.45 μm | 0.18 | 134 | 0.06 | 0.02 | Sample of the Invention |

S, $DS_{0.1}-DS_{0.0001}$ and D of these samples were measured like in Example 4, and the data are given in Table 5. Table 5 obviously confirms that the effect of the invention is more remarkable when the silver amount in the blue-sensitive emulsion layer in the photographic material is reduced.

Example 6

Preparation of Blue-Sensitive Emulsion A' of the Invention:

46.3 ml of 10% NaCl solution was added to 1.06 liters of 5.7 wt. % deionized gelatin-containing, deionized distilled water, and 46.4 ml of $H_2SO_4$ (1 N) was added thereto. Further, 0.012 g of compound X mentioned above was added thereto and the temperature of the resulting liquid mixture was controlled to 60° C. With rapidly stirring it, 0.1 mols of silver nitrate and 0. 1 mols of NaCl were immediately added to the reactor over a period of 10 minutes. Subsequently, 1.5 mols of silver nitrate and NaCl solutions were added thereto over a period of 60 minutes in an accelerated flow rate method in which the final addition speed was 4 times the initial addition speed. Next, 0.2 mols of silver nitrate and NaCl solutions were added thereto at a constant addition speed over a period of 6 minutes. The NaCl solution contained $5\times10^{-7}$ mols, relative to the total silver, of $K_3IrCl_5(H_2O)$, and the silver halide grains formed were doped with aquated iridium.

Further, 0.2 mols of silver nitrate, 0.18 mols of NaCl and 0.02 mols of KBr solutions were added over a period of 6 minutes. The halide solutions contained $0.5\times10^{-5}$ mols, relative to the total silver, of $K_4Ru(CN)_6$ and $K_4Fe(CN)_6$, respectively, dissolved therein, so that they were added to the silver halide grains formed.

While the grains were growing in the final stage, 0.001 mols, relative to the total silver, of KI solution was added over a period of 1 minute. The addition was started after the grain formation mounted up to 93%.

Next, a precipitating agent, compound Y mentioned above was added at 40° C., and the pH of the mixture was controlled to be about 3.5. Then, this was desalted and washed with water.

To the emulsion thus desalted and washed with water, deionized gelatin, NaCl solution and NaOH solution were added, and heated up to 50° C. This was controlled to have a pAg of 7.6 and a pH of 5.6.

The emulsion thus obtained through the process as above contained cubic silver halide grains having a halogen composition of 98.9 mol % silver chloride, 1 mol % silver bromide and 0.1 mol % silver iodide, and having a mean grain size of 0.70 μm and a grain size fluctuation coefficient of 8%.

The emulsion grains obtained was analyzed for the iodide ion concentration distribution therein through etching/TOF-SIMS. It was found that the highest iodide ion concentration was in the surface of the grains, and the ion concentration decreased toward inside the grains. Even when the addition of the iodide solution was terminated inside the grains (93% of silver nitrate addition), the iodide ions bled toward the grain surface. Regarding their morphology, it is believed that the silver chloroiodide grains formed herein were coated with a silver iodide-containing phase to be the outermost layer thereof.

The emulsion was kept at 60° C., and $4.0\times10^{-4}$ mols/Ag mol of color-sensitizing dye-1 mentioned above was added thereto. In addition, $1\times10^{-5}$ mols/Ag mol of thiosulfonate compound-1 mentioned above was added thereto, and iridium hexachloride-doped, fine emulsion grains of 90 mol % silver bromide and 10 mol % silver chloride having a mean grain size of 0.05 μm were added thereto, and ripened for 10 minutes. Further, fine grains of 40 mol % silver bromide and 60 mol % silver chloride having a mean grain size of 0.05 μm were added thereto, and ripened for 10 minutes. The fine grains were dissolved, and the silver bromide content of the host cubic grains increased up to 1.3 mol %. The amount of iridium hexachloride doped in the grains was $1\times10^{-7}$ mols/Ag mol.

Subsequently, $1\times10^{-5}$ mols/Ag mol of sodium thiosulfate, and $2\times10^{-5}$ mols/Ag mol of gold sensitizer-1 mentioned above were added. Immediately after the addition, this was heated up to 60° C., then ripened for 40 minutes, and thereafter cooled to 50° C. Immediately after the cooling, mercapto compounds-1 and 2 mentioned above, $6\times10^{-4}$ mols/Ag mol each, were added. After the addition, this was ripened for 10 minutes, and 0.008 mols, relative to silver, of KBr solution was added, ripened for 10 minutes, then cooled, and stored.

Emulsion A'-1 was prepared in that manner.

In the same manner as in the preparation of Emulsion A'-1 except for the temperature in grain formation, cubic grains having a mean grain size of 0.55 μm and a grain size fluctuation coefficient of 9% were formed. The temperature during the grain formation was 55° C.

The emulsion was spectrally sensitized and chemically sensitized by an amount which was adjusted based on the specific surface area of the grains (grain size ratio, 0.7/0.55=1.27 times). This was low-sensitive emulsion A'-2.

Color-Sensitizing Dye-2'

(I-24)

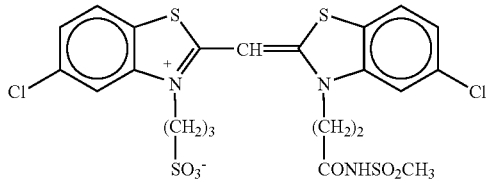

Color-Sensitizing Dye-3'

(I-25)

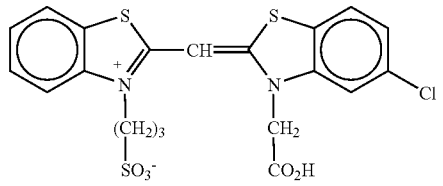

Preparation of Blue-Sensitive Emulsions G' to L' of the Invention:

In the same manner as in the preparation of Emulsion A'-1 except that the color-sensitizing dyes were varied to those shown in Table 6 below, other emulsions G'-1 to L'-1 were prepared.

TABLE 6

| Emulsion | Color-Sensitizing Dye |
|---|---|
| A'-1 | $4.0\times10^{-4}$ mol/Ag mol of Sensitizing Dye-1 |
| G'-1 | $4.0\times10^{-4}$ mol/Ag mol of Sensitizing Dye-2' |
| H'-1 | $4.0\times10^{-4}$ mol/Ag mol of Sensitizing Dye-3' |
| I'-1 | $4.0\times10^{-4}$ mol/Ag mol of Sensitizing Dye (II-12) |
| J'-1 | $4.0\times10^{-4}$ mol/Ag mol of Sensitizing Dye (II-14) |
| K'-1 | $4.0\times10^{-4}$ mol/Ag mol of Sensitizing Dye (II-15) |
| L'-1 | Sensitizing Dye-2' and Sensitizing Dye (II-5), $2.0\times10^{-4}$ mol/Ag mol each |

Sensitizing Dye-2' and 3' are Compounds I-24 and I-25, respectively, mentioned hereinabove for use in the invention.

In the same manner as in the preparation of low-sensitive Emulsion A'-2, other emulsions G'-2 to L'-2 were prepared.

Preparation of Blue-Sensitive Emulsions M' and N' of the invention:

1.2 liters of $H_2O$, 1.0 g of sodium chloride and 2.5 g of in active gelatin were put into a reactor, and kept at 30° C. With strongly stirring the contents, a silver nitrate solution B-1 (having a silver nitrate content of 0.24 g/ml), sodium chloride solution N-1 (having a sodium chloride content of 0.083 g/ml and inactive gelatin content of 0.01 g/ml) were added thereto at a flow rate of 75 ml/min over a period of 1 minute. One minute after the addition, 20 ml of aqueous solution K-1 containing 0.9 mmols of crystal habit improver 1 mentioned below was added thereto. Further after 1 minute, 340 ml of 10% gelatin phthalide solution H-1 and 2.0 g of sodium chloride were added thereto. This was heated up to 55° C. in the next stage of 25 minutes and ripened at 55° C. for 30 minutes. While the grains formed were growing, 516 ml of silver nitrate solution B-2 (having a silver nitrate content of 0.4 g/ml) and 445 ml of sodium chloride solution N-2

(having a sodium chloride content of 0.17 g/ml) were added thereto both at an accelerated flow rate over a period of 27 minutes. The solution N-2 contained $5\times10^{-7}$ mols, relative to the total silver, of $K_3IrCl_5(H_2O)$, and the silver halide grains formed were doped with aquated iridium. In this stage, 280 ml of aqueous solution K-2 containing 2.1 mmols of the crystal habit improver 1 was also added at an accelerated flow rate (in proportion to the addition of silver nitrate). Further, silver nitrate solution B-3 (having a silver nitrate content of 0.4 g/ml) and potassium iodide solution P-6 (having a potassium iodide content of 0.0077 g/ml), 142 ml each, were added at a linearly increasing flow rate of from 10.0 ml/min to 15 ml/min, and simultaneously with them, sodium chloride solution N-3 (having a sodium chloride content of 0.14 g/ml) was also at a linearly increasing flow rate to increase the silver voltage from 80 mV to 105 mM. After this, silver nitrate solution B-4 (having a silver nitrate content of 0.08 g/ml) and potassium bromide solution P-8 (having a potassium bromide content of 0.056 g/ml) were added for 1 minute both at a flow rate of 35.5 ml/min.

Crystal Habit Improver 1

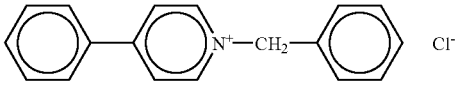

Next, this was precipitated and washed at 30° C., and then desalted. Further, 130 g of inactive gelatin was added thereto, and this was adjusted to have a pH of 6.3 and a pAg of 7.2. In the resulting emulsion M, at least 98.2% of the grains, in terms of the total projected area thereof, were tabular grains having a main plane {111} and having a mean aspect ratio of at least 2. The mean grain size of the grains was 0.92 μm, the mean thickness thereof was 0.139 μm, the mean aspect ratio thereof was 6.9, and the edge length thereof in terms of cubes having the same volume as that of the grains was 0.452 μm. The emulsion was analyzed for the iodide ion concentration distribution through etching/OF-SIMS, which confirmed the presence of the iodide ion concentration maximum in the grain surface and the concentration decreased toward inside the grains.

The emulsion grains were kept at 60° C., and $8.0\times10^{-4}$ mols/Ag mol of color-sensitizing dye I-15 was added thereto. Further, $2\times10^{-5}$ mols/Ag mol of Thiosulfonate Compound-1 was added thereto, and $2\times10^{-5}$ mols/Ag mol of sodium thiosulfate and $4\times10^{-5}$ mols/Ag mol of Gold Sensitize-1 mentioned above were added thereto. Immediately after the addition, this was heated up to 60° C., then ripened for 40 minutes, and cooled to 50° C. Immediately after the cooling, Mercapto Compounds-1 and -2 mentioned above were added thereto, $6\times10^{-4}$ mols/Ag mol each. Next, this was ripened for 10 minutes, and 0.0008 mols/Ag mol of KBr solution was added thereto, ripened for 10 minutes, cooled, and stored.

In that manner, high-sensitive Emulsion M'-1 was prepared.

In the same manner as above except for the temperature in grain formation, tabular grains were formed, having a mean grain size of 0.70 μm, a mean grain thickness of 0.106 μm, a mean aspect ratio of 6.9 and an edge length, in terms of cubes having the same volume as that of the grains, of 0.34 μm. The temperature in the stage of grain formation was 25° C.

The emulsion was spectrally sensitized and chemically sensitized by an amount which was adjusted based on the specific surface area of the grains (surface area ratio=1.31 times) This was low-sensitive emulsion M'-2.

Next, high-sensitive emulsion N'-1 was prepared in the same manner as the preparation of high-sensitive emulsion M'-1 except that sensitizing dye-2' and Compound I-15, $4.0\times10^{-4}$ mols/Ag mol each, were used; and low-sensitive emulsion N'-2 was prepared in the same manner as the preparation of low-sensitive emulsion M'-2.

Preparation of Comparative Blue-Sensitive Emulsion B':

In the process of preparing Emulsion A-1, the temperature in grain formation was changed to 68° C., and the grains having a mean grain size of 0.85 μm were formed. The grain size fluctuation coefficient of the grains was 12%. In addition, in the final stage of grain formation, iodide ions were not added, but Cl ions were added. Accordingly, the halogen composition of the grains in the final stage of the grain formation was 99 mol % of silver chloride and 1 mol % of silver bromide.

The amount of the color-sensitizing dye-1 added to the grains was 1.25 times that in preparing the Emulsion A-1'. the amount of the thiosulfonate compound-1 added was the same.

The chemical sensitization was varied as follows.

Fine grain emulsions of 90 ml % silver bromide and 10 mol % silver chloride having a mean grain size of 0.05 μm and doped with iridium hexachloride were added, and ripened for 10 minutes. Further, fine grains of 40 mol % silver bromide and 60 mol % silver chloride having a mean grain size of 0.05 μm were added, and ripened for 10 minutes. The fine grains were dissolved, and the silver bromide content of the cubic host grains increased to 2.0 mol %. The amount of iridium hexachloride doped to the host grains was $2\times10^{-7}$ mols/Ag mol.

Subsequently, $1\times10^{-5}$ mols/Ag mol of sodium thiosulfate was added, immediately heated up to 55° C., ripened for 70 minutes, and then cooled to 50° C. No gold sensitizer was added. Immediately after the cooling, Mercapto Compounds-1 and -2 were added, $4\times10^{-4}$ mols/Ag mol each. After the addition, this was ripened for 10 minutes, and 0.010 mols/Ag mol of KBr solution was added, ripened for 10 minutes, then cooled, and stored.

In that manner, comparative high-sensitive emulsion B'-1 for BL was prepared.

Like B'-1, the silver halide grains having a mean grain size of 0.68 μm and a grain size fluctuation coefficient of 12% were prepared, for which the temperature in grain formation was lowered.

In consideration of the surface area ratio of the grains formed herein, the amount of the color-sensitizing dye and that of the chemical sensitizer added to the grains were both 1.25 times those to the grains of the emulsion B'-1.

Preparation of Green-Sensitive Emulsion C':

High-sensitive emulsion C'-1 and low-sensitive emulsion C'-2 for GL were prepared in the same manner as in the preparation of Emulsions A'-1 and 2, except that the temperature in grain formation was lowered and Sensitizing Dyes D and E mentioned above were used.

The high-sensitive emulsion grains had a mean grain size of 0.40 μm, and the low-sensitive emulsion grains had a mean grain size of 0.30 μm. Both had a grain size distribution of 8%.

The amount of the Sensitizing Dye D added to the large-size grain emulsion and to the small-size grain emulsion was $3.0\times10^{-4}$ mols and $3.0\times10^{-4}$ mols, respectively, per mol of silver halide; and the amount of the Sensitizing Dye E added to the large-size grain emulsion and to the small-size grain emulsion was $4.0\times10^{-5}$ mols and $7.0\times10^{-5}$ mols, respectively, per mol of silver halide.

Preparation of Green-Sensitive Emulsion D':

High-sensitive emulsion D'-1 and low-sensitive emulsion D'-2 for GL were prepared in the same manner as in the preparation of Emulsions B'-1 and 2, except that the temperature in grain formation was lowered and Sensitizing Dyes D and E mentioned above were used.

The high-sensitive emulsion grains had a mean grain size of 0.50 μm, and the low-sensitive emulsion grains had a mean grain size of 0.40 μm. Both had a grain size distribution of 10%.

The amount of the Sensitizing Dye D added to the large-size grain emulsion and to the small-size grain emulsion was $4.0\times10^{-4}$ mols and $4.5\times10^{-4}$ mols, respectively, per mol of silver halide; and the amount of the Sensitizing Dye E added to the large-size grain emulsion and to the small-size grain emulsion was $5.0\times10^{-5}$ mols and $8.8\times10^{5}$ mols, respectively, per mol of silver halide.

Preparation of Red-Sensitive Emulsion E':

High-sensitive emulsion E'-1 and low-sensitive emulsion E'-2 for RL were prepared in the same manner as in the preparation of Emulsions A'-1 and 2, except that the temperature in grain formation was lowered and Sensitizing Dyes G and H mentioned above were used.

The high-sensitive emulsion grains had a mean grain size of 0.38 μm, and the low-sensitive emulsion grains had a mean grain size of 0.32 μm. The former had a grain size distribution of 9%, and the latter had 10%.

The amount of the Sensitizing Dyes G and H added to the large-size grain emulsion was $8.0\times10^{-5}$ mols each, per mol of silver halide, and that to the small-size grain emulsion was $10.7\times10^{-5}$ mols each.

In addition, $3.0\times10^{-3}$ mols, per mol of silver halide, of Compound I mentioned above was added to the red-sensitive emulsions.

Preparation of Red-Sensitive Emulsion F':

High-sensitive emulsion F'-1 and low-sensitive emulsion F'-2 for RL were prepared in the same manner as in the preparation of Emulsions B'-1 and 2, except that the temperature in grain formation was lowered and Sensitizing Dyes G and H mentioned above were used.

The high-sensitive emulsion grains had a mean grain size of 0.57 μm, and the low-sensitive emulsion grains had a mean grain size of 0.43 μm. The former had a grain size distribution of 9%, and the latter had 10%.

The amount of the Sensitizing Dyes G and H added to the large-size grain emulsion was $1.0\times10^{-4}$ mols each, per mol of silver halide, and that to the small-size grain emulsion was $1.34\times10^{-4}$ mols each.

In addition, $3.0\times10^{-3}$ mols, per mol of silver halide, of Compound I was added to the red-sensitive emulsions.

Preparation of Coating Liquid for First Layer:

57 g of yellow coupler ExY, 7 g of color image stabilizer Cpd-1, 4 g of color image stabilizer Cpd-2, 7 g of color image stabilizer Cpd-3, and 2 g of color image stabilizer Cpd-8 were dissolved in 21 g of solvent Solv-1 and 80 ml of ethyl acetate. The resulting solution was emulsified and dispersed in 220 g of 23.5 wt. % gelatin solution containing 4 g of sodium dodecylbenzenesulfonate, by the use of a high-speed stirring emulsifying machine (dissolver), and water was added thereto to make 900 g of emulsified dispersion A'.

Next, the emulsified dispersion A' was mixed with the above-mentioned Emulsions A'-1 and A'-2 to prepare a coating liquid for the first layer having the composition mentioned below. The coating amount of the emulsion is in terms of the silver amount in the emulsion.

Coating liquids for the second to seventh layers were prepared in the same manner as in the preparation of the coating liquid for the first layer. The gelatin hardeners in each layer were 1-hydroxy-3,5-dichloro-s-triazine sodium salt H-1, and H-2, H-3 mentioned above. Each layer contained antibacterial agents, Ab-1, Ab-2, Ab-3 and Ab-4 mentioned above, 15.0 mg/m$^2$, 60.0 mg/m$^2$, 5.0 mg/m$^2$ and 10.0 mg/m$^2$, respectively.

1-(3-Methylureidophenyl)-5-mercaptotetrazole was added to the second, fourth, sixth and seventh layers, 0.2 mg/m$^2$, 0.2 mg/m$^2$, 0.6 mg/m$^2$ and 0.1 mg/m$^2$, respectively.

4-Hydroxy-6-methyl-1,3,3a, 7-tetrazaindene was added to the blue-sensitive emulsion layer and the green-sensitive emulsion layer, $1\times10^{-4}$ mols and $2\times10^{-4}$ mols, respectively, per mol of silver halide.

A copolymer latex of methacrylic acid and butyl acrylate (1/1 by weight, having a mean molecular weight of from 200,000 to 400,000) was added to the red-sensitive emulsion layer, 0.05 g/m$^2$.

Disodium catechol-3,5-disulfonate was added to the second, fourth and sixth layers, 6 mg/m$^2$, 6 mg/m$^2$ and 18 mg/m$^2$, respectively.

For anti-irradiation, the following dyes were added to the layers, the coating amount parenthesized.

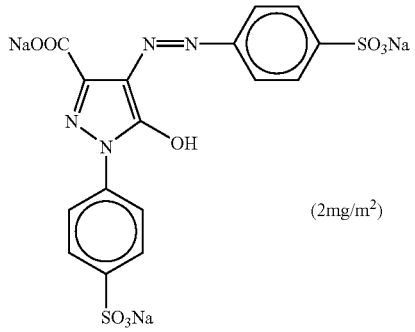

(2mg/m$^2$)

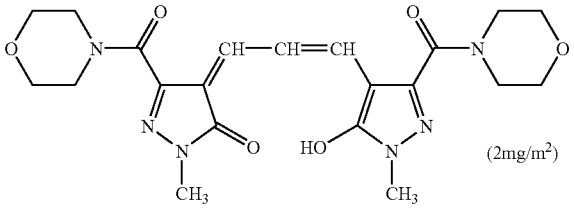

(2mg/m$^2$)

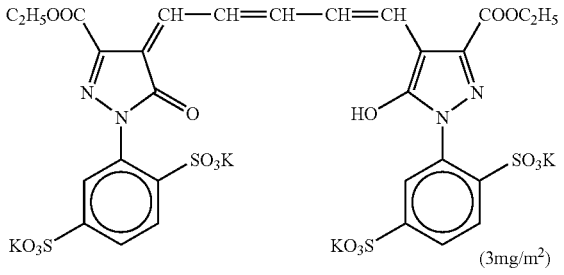

(3mg/m$^2$)

-continued

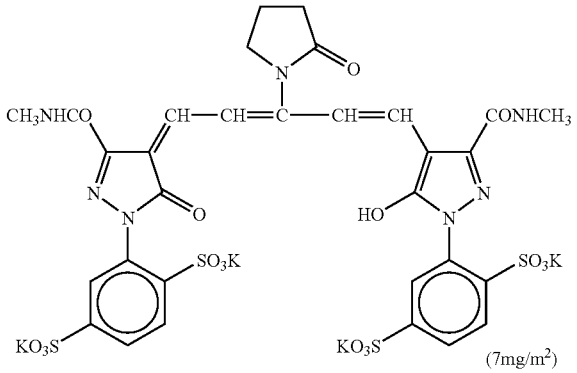

Layer Constitution:

The constitution of each layer in the photographic material produced herein is shown below. The numeral indicates the coating amount (g/m$^2$) The amount of the silver halide emulsion is in terms of the coating amount of silver therein.

<Support>

Polyethylene resin-laminated paper, in which the polyethylene resin on which the first layer is to be formed contains white pigments ($TiO_2$, its content was 16% by weight; ZnO, its content was 4% by weight), a fluorescent brightener (4,4'-bis(5-methylbenzoxazolyl)stilbene, its content was 0.03% by weight), and a blueing dye (ultramarine, its content was 0.33% by weight), and the amount of the polyethylene resin was 29.2 g/m$^2$.

| | |
|---|---|
| <First Layer (blue-sensitive emulsion layer)> | |
| Silver chloride emulsion A' (cubic grains sensitized with gold and sulfur, 3/7 (in terms of silver molar ratio) mixture of Emulsion A'-1 and Emulsion A'-2) | 0.24 |
| Gelatin | 1.25 |
| Yellow coupler ExY | 0.57 |
| Color image stabilizer Cpd-1 | 0.07 |
| Color image stabilizer Cpd-2 | 0.04 |
| Color image stabilizer Cpd-3 | 0.07 |
| Color image stabilizer Cpd-8 | 0.02 |
| Solvent Solv-1 | 0.21 |
| <Second Layer (color mixing preventing layer)> | |
| Gelatin | 1.15 |
| Color mixing preventing agent Cpd-4 | 0.10 |
| Color image stabilizer Cpd-5 | 0.018 |
| Color image stabilizer Cpd-6 | 0.13 |
| Color image stabilizer Cpd-7 | 0.07 |
| Solvent Solv-1 | 0.04 |
| Solvent Solv-2 | 0.12 |
| Solvent Solv-5 | 0.11 |
| <Third Layer (green-sensitive emulsion layer)> | |
| Silver chlorobromide emulsion C' (cubic grains sensitized with gold and sulfur, 1/3 (in terms of silver molar ratio) mixture of large-size Emulsion C'-1 and small-size Emulsion C'-2) | 0.14 |
| Gelatin | 0.46 |
| Magenta coupler ExM | 0.15 |
| UV absorbent UV-A | 0.14 |
| Color image stabilizer Cpd-2 | 0.003 |
| Color mixing preventing agent Cpd-4 | 0.002 |
| Color image stabilizer Cpd-6 | 0.09 |
| Color image stabilizer Cpd-8 | 0.02 |
| Color image stabilizer Cpd-9 | 0.01 |
| Color image stabilizer Cpd-10 | 0.01 |
| Color image stabilizer Cpd-11 | 0.0001 |

-continued

| | |
|---|---|
| Solvent Solv-3 | 0.09 |
| Solvent Solv-4 | 0.18 |
| Solvent Solv-5 | 0.17 |
| <Fourth Layer (color mixing preventing layer)> | |
| Gelatin | 0.68 |
| Color mixing preventing agent Cpd-4 | 0.06 |
| Color image stabilizer Cpd-5 | 0.011 |
| Color image stabilizer Cpd-6 | 0.08 |
| Color image stabilizer Cpd-7 | 0.04 |
| Solvent Solv-1 | 0.02 |
| Solvent Solv-2 | 0.07 |
| Solvent Solv-5 | 0.065 |
| <Fifth Layer (red-sensitive emulsion layer)> | |
| Silver chlorobromide emulsion E' (cubic grains sensitized with gold and sulfur, 5/5 (in terms of silver molar ratio) mixture of large-size Emulsion E'-1 and small-size Emulsion E'-2) | 0.16 |
| Gelatin | 0.95 |
| Cyan coupler ExC-1 | 0.023 |
| Cyan coupler ExC-2 | 0.05 |
| Cyan coupler ExC-3 | 0.17 |
| UV absorbent UV-A | 0.055 |
| Color image stabilizer Cpd-1 | 0.22 |
| Color image stabilizer Cpd-7 | 0.003 |
| Color image stabilizer Cpd-9 | 0.01 |
| Color image stabilizer Cpd-12 | 0.01 |
| Solvent Solv-8 | 0.05 |
| <Sixth Layer (UV absorbent layer)> | |
| Gelatin | 0.46 |
| UV absorbent UV-B | 0.35 |
| Compound S1-4 | 0.0015 |
| Solvent Solv-7 | 0.18 |
| <Seventh Layer (protective layer)> | |
| Gelatin | 1.00 |
| Acryl-modified copolymer of polyvinyl alcohol (degree of modification, 17%) | 0.4 |
| Liquid paraffin | 0.02 |
| Surfactant Cpd-13 | 0.02 |

The other samples mentioned below were produced in the same manner as in the production of Sample 601 as above, except the following changes.

<Production of Sample 701>

Sample 701 was produced in the same manner as in the production of Sample 601, except that the silver halide emulsions for the first, third and fifth layers were changed to the following.

Silver Halide Emulsion for First Layer:

Silver chloride emulsion B' (sulfur-sensitized cubic grains, 3/7 (in terms of silver molar ratio) mixture of large-size Emulsion B'-1 and small-size Emulsion B'-2).

Silver Halide Emulsion for Third Layer:

Silver chlorobromide emulsion D' (cubic grains sensitized with gold and sulfur, 1/3 (in terms of silver molar ratio) mixture of large-size Emulsion D'-1 and small-size Emulsion D'-2).

Silver Halide Emulsion for Fifth Layer:

Silver chlorobromide emulsion F' (cubic grains sensitized with gold and sulfur, 5/5 (in terms of silver molar ratio) mixture of large-size Emulsion F'-1 and small-size Emulsion F'-2).

<Production of Samples 602 to 609>

Samples 602 to 609 was produced in the same manner as in the production of Sample 601, except that the emulsion for the first layer was changed as in Table 7 below.

<Production of Samples 801 to 809>

Samples 801 to 809 differ from Samples 601 to 609, respectively, in that the amount of ultramarine in the support of the former was reduced to 60%.

The samples were processed according to the process A for development mentioned above, except that different processing solutions were used.

The composition of each processing solution used herein is mentioned below.

| Color Developer (bath solution/replenisher): | |
|---|---|
| Water | 800 ml/800 ml |
| Fluorescent brightener (FL-1) | 2.2 g/5.2 g |
| Fluorescent brightener (FL-2) | 0.35 g/1.85 g |
| Triisopropanolamine | 8.8 g/8.8 g |
| Polyethylene glycol having a mean molecular weight of 300 | 10.0 g/10.0 g |
| Ethylenediamine-tetraacetic acid | 4.0 g/4.0 g |
| Sodium sulfite | 0.10 g/0.20 g |
| Potassium chloride | 10.0 g/- |
| Sodium 4,5-Dihydroxybenzene-1,3-disulfonate | 0.50 g/0.50 g |
| Disodium-N,N-bis(sulfonatoethyl)hydroxylamine | 8.5 g/4.0 g |
| 4-Amino-3-methyl-N-ethyl-N-(β-methanesulfonamidoethyl)-aniline · 3/2 sulfate · monohydrate | 4.8 g/14.0 g |
| Potassium carbonate | 26.3 g/26.3 g |
| Water to make | 1000 ml/1000 ml |
| pH (at 25° C., adjusted with sulfuric acid and KOH) | 10.15/12.50 |
| **Blix Solution (bath solution/replenisher):** | |
| Water | 800 ml/800 ml |
| Ammonium thiosulfate (750 g/liter) | 107 ml/214 ml |
| M-carboxybenzenesulfinic acid | 8.3 g/16.5 g |
| Ammonium iron (III) ethylenediaminetetraacetate | 47.0 g/94.0 g |
| Ethylenediamine-tetraacetic acid | 1.4 g/2.8 g |
| Nitric acid (67%) | 16.5 g/33.0 g |
| Imidazole | 14.6 g/29.2 g |
| Ammonium sulfite | 16.0 g/32.0 g |
| Potassium metabisulfite | 23.1 g/46.2 g |
| Water to make | 1000 ml/1000 ml |

-continued

| | |
|---|---|
| pH (at 25° C., adjusted with nitric acid aqueous ammonia) | 6.5/6.5 |
| **Rinsing Solution (bath solution/replenisher)** | |
| Sodium chloroisocyanurate | 0.02 g/0.02 g |
| Deionized water (electroconductivity, at most 5 μS/cm) | 1000 ml/1000 ml |
| pH (at 25° C.) | 6.5/6.5 |

At a wavelength of 450 nm, 550 nm and 650 nm, the reflection density A(450), A(550) and A(650) of the white background area (non-exposed portion) of each processed sample was measured with a spectrophotometer, Hitachi's U-3410 Model.

On the other hand, the samples were stored in two different conditions, at 25° C. and 55% RH for 10 days, and at 60° C. and 35% % H for 10 days, and then processed according to the process A for development mentioned above. The yellow Dmin of the non-processed area of each processed sample was measured with X-rite Status A. The value Dmin of the sample stored at 25° C. and 55% RH for 10 days was subtracted from the value Dmin thereof stored at 60° C. and 35% RH for 10 days, and this is the fog increase (ΔDmin) of the sample.

60 panelists checked the samples processed before and after storage, under a fluorescent lamp for color evaluation to sensually evaluate the whiteness of the background (non-exposed portion) of the samples according to the 5-point criteria mentioned below. The points of each sample given by 60 panelists were averaged.

5: Very good.

4: Good.

3: Average.

2: Not good.

1: Very bad.

The evaluation results are given in Table 7.

TABLE 7

| Sample | BL Emulsion | BL Sensitizing Dye | Amount of Ultra-marine | A450 | A550 | A650 | A550/A450 | A650/A450 | Sensual Evaluation | ΔDMin | Remarks |
|---|---|---|---|---|---|---|---|---|---|---|---|
| 701 | B' | 1 | 100% | 0.078 | 0.081 | 0.067 | 1.04 | 0.86 | 2.8 | 0.012 | Comparative Sample |
| 602 | G' | 2' | 100% | 0.056 | 0.078 | 0.063 | 1.39 | 1.13 | 4.0 | 0.006 | Sample of the Invention |
| 603 | H' | 3' | 100% | 0.056 | 0.078 | 0.063 | 1.39 | 1.13 | 4.0 | 0.007 | Sample of the Invention |
| 604 | I' | II-12 | 100% | 0.058 | 0.078 | 0.063 | 1.34 | 1.09 | 4.2 | 0.008 | Sample of the Invention |
| 605 | J' | II-14 | 100% | 0.059 | 0.078 | 0.063 | 1.32 | 1.07 | 4.2 | 0.007 | Sample of the Invention |
| 606 | K' | II-15 | 100% | 0.058 | 0.078 | 0.063 | 1.34 | 1.09 | 4.2 | 0.008 | Sample of the Invention |
| 607 | L' | 2' & II-15 | 100% | 0.057 | 0.078 | 0.063 | 1.37 | 1.11 | 4.1 | 0.007 | Sample of the Invention |
| 608 | M' | II-15 | 100% | 0.062 | 0.078 | 0.063 | 1.26 | 1.02 | 4.3 | 0.008 | Sample of the Invention |
| 609 | N' | 2' & II-15 | 100% | 0.063 | 0.078 | 0.063 | 1.24 | 1.00 | 4.4 | 0.007 | Sample of the Invention |
| 802 | G' | 2' | 60% | 0.052 | 0.059 | 0.045 | 1.13 | 0.87 | 4.8 | 0.006 | Sample of the Invention |
| 803 | H' | 3' | 60% | 0.052 | 0.059 | 0.045 | 1.13 | 0.87 | 4.8 | 0.007 | Sample of the Invention |
| 804 | I' | II-12 | 60% | 0.054 | 0.059 | 0.045 | 1.09 | 0.83 | 4.7 | 0.008 | Sample of the Invention |
| 805 | J' | II-14 | 60% | 0.055 | 0.059 | 0.045 | 1.07 | 0.82 | 4.7 | 0.007 | Sample of the Invention |

TABLE 7-continued

| Sample | BL Emulsion | BL Sensitizing Dye | Amount of Ultra-marine | A450 | A550 | A650 | A550/A450 | A650/A450 | Sensual Evaluation | ΔDMin | Remarks |
|---|---|---|---|---|---|---|---|---|---|---|---|
| 806 | K' | II-15 | 60% | 0.054 | 0.059 | 0.045 | 1.09 | 0.83 | 4.7 | 0.008 | Sample of the Invention |
| 807 | L' | 2' & II-15 | 60% | 0.053 | 0.059 | 0.045 | 1.11 | 0.85 | 4.8 | 0.007 | Sample of the Invention |
| 808 | M' | II-15 | 60% | 0.058 | 0.059 | 0.045 | 1.02 | 0.78 | 4.6 | 0.008 | Sample of the Invention |
| 809 | N' | 2' & II-15 | 60% | 0.059 | 0.059 | 0.045 | 1.00 | 0.76 | 4.6 | 0.007 | Sample of the Invention |

Table 7 confirms that the samples which satisfy the requirement of the invention in point of the reflection density λ(450), λ(550) and λ(650) of the non-exposed portion of the processed samples all have good whiteness in the highlight background area thereof, and have a good impression on viewers. In particular, the samples having λ(450) of at most 0.06, λ(550) of at most 0.07 and λ(650) of at most 0.05 are extremely good. Moreover, it is understood that the samples containing the specific sensitizing dye of the invention are fogged little in the highlight area thereof even after stored in high-temperature low-humidity conditions, and they keep good whiteness even after stored in such severe conditions.

Example 7

Samples 901 to 909 and 3001 to 3009 were produced, which differ from Samples 601 to 609 and 801 to 809 in that the coating amount of the sixth layer was reduced to 70%.

These samples were exposed and processed in the same manner as in Example 6. In addition, also in the same manner as in Example 6, these were stored in the high-temperature low-humidity condition, then processed and evaluated.

In this, however, the whiteness in the non-exposed portion of the processed samples was measures, using a color analyzer, Hitachi's C-2000 Model, and an ordinary xenon light source. Based on the white point of D65, the values of L*a*b* of each sample were obtained in the color space.

The results are given in Table 8.

TABLE 8

| Sample | BL Emulsion | BL Sensitizing Dye | Amount of Ultra-marine | L* | a* | b* | Sensual Evaluation | ΔDMin | Remarks |
|---|---|---|---|---|---|---|---|---|---|
| 701 | B' | 1 | 100% | 91.0 | 0.9 | −3.9 | 3.2 | 0.012 | Comparative Sample |
| 902 | G' | 2' | 100% | 92.3 | 1.1 | −7.9 | 4.1 | 0.006 | Sample of the Invention |
| 903 | H' | 3' | 100% | 92.3 | 1.1 | −7.9 | 4.0 | 0.007 | Sample of the Invention |
| 904 | I' | II-12 | 100% | 92.3 | 1.1 | −7.5 | 4.2 | 0.008 | Sample of the Invention |
| 905 | J' | II-14 | 100% | 92.3 | 1.1 | −7.2 | 4.3 | 0.007 | Sample of the Invention |
| 906 | K' | II-15 | 100% | 92.3 | 1.1 | −7.5 | 4.2 | 0.008 | Sample of the Invention |
| 907 | L' | 2' & II-15 | 100% | 92.3 | 1.1 | −7.7 | 4.2 | 0.007 | Sample of the Invention |
| 908 | M' | II-15 | 100% | 92.3 | 1.1 | −7.0 | 4.4 | 0.008 | Sample of the Invention |
| 909 | N' | 2' & II-15 | 100% | 92.3 | 1.1 | −7.0 | 4.4 | 0.007 | Sample of the Invention |
| 3002 | G' | 2' | 60% | 93.2 | 1.0 | −6.2 | 4.8 | 0.006 | Sample of the Invention |
| 3003 | H' | 3' | 60% | 93.2 | 1.0 | −6.2 | 4.8 | 0.007 | Sample of the Invention |
| 3004 | I' | II-12 | 60% | 93.2 | 1.0 | −5.8 | 4.7 | 0.008 | Sample of the Invention |
| 3005 | J' | II-14 | 60% | 93.2 | 1.0 | −5.4 | 4.7 | 0.007 | Sample of the Invention |
| 3006 | K' | II-15 | 60% | 93.2 | 1.0 | −5.8 | 4.7 | 0.008 | Sample of the Invention |
| 3007 | L' | 2' & II-15 | 60% | 93.2 | 1.0 | −5.9 | 4.8 | 0.007 | Sample of the Invention |

TABLE 8-continued

| Sample | BL Emulsion | BL Sensitizing Dye | Amount of Ultra-marine | L* | a* | b* | Sensual Evaluation | ΔDMin | Remarks |
|---|---|---|---|---|---|---|---|---|---|
| 3008 | M' | II-15 | 60% | 93.2 | 1.0 | −5.3 | 4.6 | 0.008 | Sample of the Invention |
| 3009 | N' | 2' & II-15 | 60% | 93.2 | 1.0 | −5.3 | 4.6 | 0.007 | Sample of the Invention |

Table 8 confirms that the samples which satisfy the requirement [A] for L*, a* and b* of the invention all have good whiteness in the highlight background area thereof, and have a good impression on viewers. In particular, the samples satisfying the requirement [B] are extremely good. Moreover, it is understood that the samples containing the specific sensitizing dye of the invention are fogged little in the highlight area thereof even after stored in high-temperature low-humidity conditions, and they keep good whiteness even after stored in such severe conditions.

Example 8

Samples 701, 601 to 609, 801 to 809 in Example 6 were exposed and processed, before and after stored under high-temperature low-humidity conditions, and evaluated in the same manner as in Example 6, except that they were developed according to the process B mentioned below.

The results are given in Table 9.

TABLE 9

| Sample | BL Emulsion | BL Sensitizing Dye | Amount of Ultra-marine | A450 | A550 | A650 | A550/ A450 | A650/ A450 | Sensual Evaluation | ΔDMin | Remarks |
|---|---|---|---|---|---|---|---|---|---|---|---|
| 701 | B' | 1 | 100% | 0.078 | 0.082 | 0.067 | 1.05 | 0.86 | 3.0 | 0.012 | Comparative Sample |
| 602 | G' | 2' | 100% | 0.057 | 0.079 | 0.063 | 1.39 | 1.11 | 4.0 | 0.006 | Sample of the Invention |
| 603 | H' | 3' | 100% | 0.057 | 0.079 | 0.063 | 1.39 | 1.11 | 4.0 | 0.007 | Sample of the Invention |
| 604 | I' | II-12 | 100% | 0.058 | 0.079 | 0.063 | 1.36 | 1.09 | 4.2 | 0.008 | Sample of the Invention |
| 605 | J' | II-14 | 100% | 0.059 | 0.079 | 0.063 | 1.34 | 1.07 | 4.2 | 0.007 | Sample of the Invention |
| 606 | K' | II-15 | 100% | 0.058 | 0.078 | 0.063 | 1.34 | 1.09 | 4.2 | 0.008 | Sample of the Invention |
| 607 | L' | 2' & II-15 | 100% | 0.058 | 0.079 | 0.063 | 1.36 | 1.09 | 4.1 | 0.007 | Sample of the Invention |
| 608 | M' | II-15 | 100% | 0.062 | 0.078 | 0.063 | 1.26 | 1.02 | 4.3 | 0.008 | Sample of the Invention |
| 609 | N' | 2' & II-15 | 100% | 0.063 | 0.079 | 0.063 | 1.25 | 1.00 | 4.4 | 0.007 | Sample of the Invention |
| 802 | G' | 2' | 60% | 0.052 | 0.060 | 0.045 | 1.15 | 0.87 | 4.8 | 0.006 | Sample of the Invention |
| 803 | H' | 3' | 60% | 0.052 | 0.060 | 0.045 | 1.15 | 0.87 | 4.8 | 0.007 | Sample of the Invention |
| 804 | I' | II-12 | 60% | 0.054 | 0.060 | 0.045 | 1.11 | 0.83 | 4.7 | 0.008 | Sample of the Invention |
| 805 | J' | II-14 | 60% | 0.055 | 0.060 | 0.045 | 1.09 | 0.82 | 4.7 | 0.007 | Sample of the Invention |
| 806 | K' | II-15 | 60% | 0.054 | 0.060 | 0.045 | 1.11 | 0.83 | 4.7 | 0.008 | Sample of the Invention |
| 807 | L' | 2' & II-15 | 60% | 0.053 | 0.060 | 0.045 | 1.13 | 0.85 | 4.8 | 0.007 | Sample of the Invention |
| 808 | M' | II-15 | 60% | 0.058 | 0.060 | 0.045 | 1.03 | 0.78 | 4.6 | 0.008 | Sample of the Invention |
| 809 | N' | 2' & II-15 | 60% | 0.059 | 0.060 | 0.045 | 1.02 | 0.76 | 4.6 | 0.007 | Sample of the Invention |

Table 9 confirms that, even when processed according to the process B, the samples satisfying the requirement of the invention in point of the reflection density λ(450), λ(550) and λ(650) of the non-exposed portion of the processed samples all have good whiteness in the highlight background area thereof, and have a good impression on viewers. In particular, the samples having λ(450) of at most 0.06, λ(550) of at most 0.07 and λ(650) of at most 0.05 are extremely good. Moreover, it is understood that the samples containing the specific sensitizing dye of the invention are fogged little in the highlight area thereof even after stored in high-temperature low-humidity conditions, and they keep good whiteness even after stored in such severe conditions.

Process B for Development:

This differs from the process B for development mentioned in Example 3 in that the processing solutions used were changed to the following.

The composition of each processing solution used in Development B is mentioned below.

| Color Developer (bath solution/replenisher): | |
|---|---|
| Water | 800 ml/800 ml |
| Fluorescent brightener (FL-3) | 4.0 g/8.0 g |
| Decoloration promoter (SR-1) | 3.0 g/5.5 g |
| Triisopropanolamine | 8.8 g/8.8 g |
| Sodium p-toluenesulfonate | 10.0 g/10.0 g |
| Ethylenediamine-tetraacetic acid | 4.0 g/4.0 g |
| Sodium sulfite | 0.10 g/0.20 g |
| Potassium chloride | 10.0 g/- |
| Sodium 4,5-Dihydroxybenzene-1,3-disulfonate | 0.50 g/0.50 g |
| Disodium-N,N-bis(sulfonatoethyl)hydroxylamine | 8.5 g/14.0 g |
| 4-Amino-3-methyl-N-ethyl-N-(β-methanesulfonamidoethyl)-aniline · 3/2 sulfate · monohydrate | 7.0 g/19.0 g |
| Potassium carbonate | 26.3 g/26.3 g |
| Water to make | 1000 ml/1000 ml |
| pH (at 25° C., adjusted with sulfuric acid and KOH) | 10.25/12.6 |
| **Blix Solution (bath solution/replenisher):** | |
| Water | 800 ml/800 ml |
| Ammonium thiosulfate (750 g/liter) | 107 ml/214 ml |
| Succinic acid | 29.5 g/59.0 g |
| Ammonium iron (III) ethylenediaminetetraacetate | 47.0 g/94.0 g |
| Ethylenediamine-tetraacetic acid | 1.4 g/2.8 g |
| Nitric acid (67%) | 17.5 g/35.0 g |
| Imidazole | 14.6 g/29.2 g |
| Ammonium sulfite | 16.0 g/32.0 g |
| Potassium metabisulfite | 23.1 g/46.2 g |
| Water to make | 1000 ml/1000 ml |
| pH (at 25° C., adjusted with nitric acid and aqueous ammonia) | 6.00/6.00 |
| **Rinsing Solution (bath solution/replenisher)** | |
| Sodium chloroisocyanurate | 0.02 g/0.02 g |
| Deionized water (electroconductivity, at most 5 μS/cm) | 1000 ml/1000 ml |
| pH (at 25° C.) | 6.5/6.5 |

Example 9

Samples 901 to 909, and 3001 to 3009 in Example 7 were exposed and processed, before and after stored under high-temperature low-humidity conditions, and evaluated in the same manner as in Example 7, except that they were developed according to the process B mentioned above.

Like in Example 7, the samples processed herein all had good whiteness, fogged little even after stored under high-temperature low-humidity conditions. This confirms the storage stability of the samples in point of the background whiteness thereof.

Example 10

The photographic material samples of Examples 6 and 7 were processed and evaluated in the same manner as in Examples 6 to 9, except that they were exposed in a mode of scanning exposure mentioned below, through the digital information taken from the corresponding negative information by the use of a scanner. The images formed on the thus-processed samples were evaluated. It was confirmed that the samples of the invention all have good whiteness, and they still have good whiteness even after stored.

Scanning Exposure:

The scanning exposure system of FIG. 6 in JP-A 11-88619 was used. The light sources used gave 688 nm light (R light) from a semiconductor laser, 532 nm light (G light) from a semiconductor laser combined with SHG, and 473 nm light (B light). The light quantity was modulated by the use of an external light modulator. The light was reflected on a rotary polyhedron, and scanned relative to the sample moving in the direction perpendicular to the scanning direction. The power of the scanning exposure was 400 dpi, and the mean exposure time per one pixel was $8\times10^{-8}$ seconds. To prevent the light quantity fluctuation depending on the ambient temperature, the temperature of the semiconductor lasers was kept constant by the use of a Peltier device.

What is claimed is:

1. A silver halide color photographic material comprising at least one yellow-coloring photosensitive silver halide emulsion layer, at least one magenta-coloring photosensitive silver halide emulsion layer, at least one cyan-coloring photosensitive silver halide emulsion layer, and at least one non-photosensitive non-coloring hydrophilic colloid layer on a reflective support;

wherein, after being color developed, the reflection density A(λ) at a wavelength of λ nm in a non-exposed portion of the material is at most 0.07 at 450 nm, at most 0.09 at 550 nm and at most 0.07 at 650 nm, the silver halide grains in each of the at least one yellow-coloring photosensitive silver halide emulsion layer include an iridium metal complex and at least one of metal complexes including at least one of Cr, Mo, Re, Fe, Ru, Os, Co, Rh, Pd and Pt, the mean grain size of the silver halide grains in each of the at least one yellow-coloring photosensitive silver halide emulsion layer in the material is at most 0.55 μm; and the total amount of silver in the at least one yellow-coloring photosensitive silver halide emulsion layer is 0.1 to 0.20 g/m$^2$.

2. The silver halide color photographic material according to claim 1, wherein, after being color developed, the reflection density A(λ) at a wavelength of λ nm in the non-exposed portion is at most 0.06 at 450 nm, at most 0.07 at 550 nm and at most 0.05 at 650 nm.

3. The silver halide color photographic material according to claim 1, wherein, after being color developed, the ratio of the reflection density A(λ) at a wavelength of λ nm in the non-exposed portion satisfies the following conditions (I) and (II):

$$1.0 \leqq A(550)/A(450) \leqq 1.4 \quad \text{(I)}$$

$$0.6 \leqq A(650)/A(450) \leqq 1.2. \quad \text{(II)}$$

4. The silver halide color photographic material according to claim 1, wherein the mean grain size of the silver halide grains in each of at least one yellow-coloring photosensitive silver halide emulsion layer is at most 0.48 μm.

5. The silver halide color photographic material according to claim 1, including at least one color-sensitizing dye of formula (I):

formula (I)

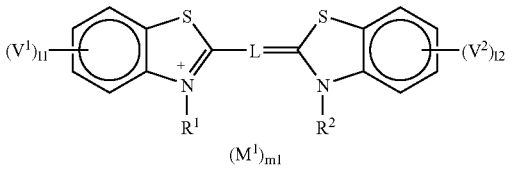

wherein $V^1$ and $V^2$ each independently represent a monovalent substituent, provided that neither $V^1$ nor $V^2$ is an aromatic group and at least two mutually adjacent $V^1$s and mutually adjacent $V^2$s do not bond to each other to form an aromatic or alicyclic ring that forms a condensed ring with a benzene ring, and at least one of $V^1$ and $V^2$ is not a bromine atom; $l_1$ and $l_2$ each independently represent 0, 1, 2, 3 or 4; L represents a methine group; $R^1$ and $R^2$ each independently represent an alkyl group; $M^1$ represents a counter ion; and $m_1$ represents a number of at least 0, which number is necessary to neutralize the charge in the molecule.

6. The silver halide color photographic material according to claim 1, including at least one color-sensitizing dye of formula (II):

formula (II)

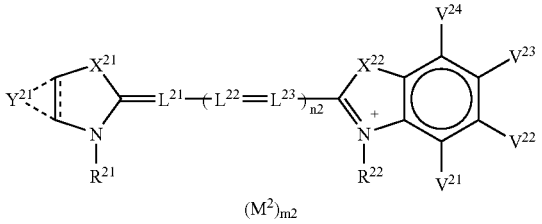

wherein $Y^{21}$ represents an atomic group necessary for forming a pyrrole, furan or thiophene ring, and may be condensed with any other carbon ring or hetero ring and may be substituted; $X^{21}$ and $X^{22}$ each independently represent an oxygen atom, a sulfur atom, a selenium atom or $NR^{2;}$ $R^{21}$, $R^{22}$ and $R^{23}$ each independently represent an alkyl group, an aryl group or a heterocyclic group; $V^{21}$, $V^{22}$, $V^{23}$ and $V^{24}$, each independently represent a hydrogen atom or a substituent, provided that two of the substituents $V^{21}$, $V^{22}$, $V^{23}$ and $V^{24}$, which are adjacent to each other, do not bond to each other to form a saturated or unsaturated condensed ring; $L^{21}$, $L^{22}$ and $L^{23}$ each independently represent a methine group; $n_2$ represents 0, 1,2,3 or 4; $M^2$ represents a counter ion; and $m_2$ represents a number of at least 0, which number is necessary to neutralize the charge in the molecule.

7. The silver halide color photographic material according to claim 1, wherein the total amount of silver in the at least one yellow-coloring photosensitive silver halide emulsion layer is from 0.1 g/m$^2$ to 0.19 g/m$^2$.

8. The silver halide color photographic material according to claim 1, wherein the chromaticity in a non-exposed portion of the material satisfies, after being color developed, the following condition (A):

$$91 \leqq L^* \leqq 96,\ 0.3 \leqq a^* \leqq 1.6,\ -8.0 \leqq b^* \leqq -4.8. \qquad \text{Condition (A)}$$

9. The silver halide color photographic material according to claim 1, wherein the iridium metal complex has at least one organic ligand.

10. An image forming method including imagewise exposing a silver halide color photographic material, color developing the imagewise exposed silver halide color photographic material and drying the developed silver halide color photographic material, wherein the silver halide color photographic material is a silver halide color photographic material according to claim 1 and the total processing time from the start of the color developing to the end of the drying is at most 90 seconds.

11. The image forming method according to claim 10, wherein the color developing is conducted for 20 seconds or less.

12. A silver halide color photographic material comprising at least one yellow-coloring photosensitive silver halide emulsion layer, at least one magenta-coloring photosensitive silver halide emulsion layer, at least one cyan-coloring photosensitive silver halide emulsion layer, and at least one non-photosensitive non-coloring hydrophilic colloid layer on a reflective support;

the chromaticity in a non-exposed portion of the material satisfies, after being color developed, the following condition (A), the silver halide grains in each of the at least one yellow-coloring photosensitive silver halide emulsion layer include an iridium metal complex and at least one of metal complexes including at least one of Cr, Mo, Re, Fe, Ru, Os, Co, Rh, Pd and Pt, and the mean grain size of the silver halide grains in each of the at least one yellow-coloring photosensitive silver halide emulsion layer in the material is at most 0.55 μm; and the total amount of silver in the at least one yellow-coloring photosensitive silver halide emulsion layer is 0.1 to 0.20 g/m$^2$;

$$91 \leqq L^* \leqq 96,\ 0.3 \leqq a^* \leqq 1.6,\ -8.0 \leqq b^* \leqq -4.8. \qquad \text{Condition (A)}$$

13. The silver halide color photographic material according to claim 12, wherein the chromaticity in the non-exposed portion satisfies, after being color developed, the following condition (B):

$$93 \leqq L^* \leqq 96,\ 0.3 \leqq a^* \leqq 1.6,\ -8.0 \leqq b^* \leqq -4.8. \qquad \text{Condition (B)}$$

14. The silver halide color photographic material according to claim 12, including at least one color-sensitizing dye of formula (I):

formula (I)

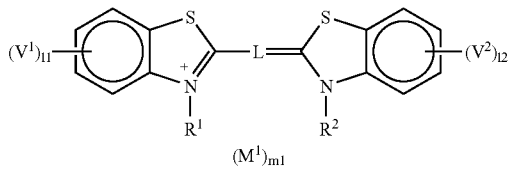

wherein $V^1$ and $V^2$ each independently represent a monovalent substituent, provided that neither $V^1$ nor $V^2$ is an aromatic group and at least two mutually adjacent $V^1$s and mutually adjacent $V^2$s do not bond to each other to form an aromatic or alicyclic ring that forms a condensed ring with a benzene ring, and at least one of $V^1$ and $V^2$ is not a bromine atom; $l_1$ and $l_2$ each independently represent 0, 1, 2, 3 or 4; L represents a methine group; $R^1$ and $R^2$ each independently represent an alkyl group; $M^1$ represents a counter ion; and $m_1$, represents a number of at least 0, which number is necessary to neutralize the charge in the molecule.

15. The silver halide color photographic material according to claim 12, including at least one color-sensitizing dye of formula (II):

formula (II)

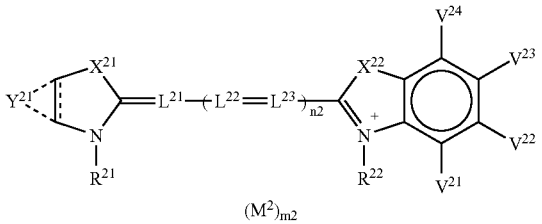

wherein $Y^{21}$ represents an atomic group necessary for forming a pyrrole, furan or thiophene ring, and may be condensed with any other carbon ring or hetero ring and may be substituted; $X^{21}$ and $X^{22}$ each independently represent an oxygen atom, a sulfur atom, a selenium atom or $NR^{23}$; $R^{21}$, $R^{22}$ and $R^{23}$ each independently represent an alkyl group, an aryl group or a heterocyclic group; $V^{21}$, $V^{22}$, $V^{23}$ and $V^{24}$ each independently represent a hydrogen atom or a substituent, provided that two of the substituents $V^{21}$, $V^{22}$, $V^{23}$ and $V^{24}$, which are adjacent to each other, do not bond to each other to form a saturated or unsaturated condensed ring; $L^{21}$, $L^{22}$ and $L^{23}$ each independently represent a methine group; $n_2$ represents 0, 1, 2, 3 or 4; $M^2$ represents a counter ion; and $m_2$ represents a number of at least 0, which number is necessary to neutralize the charge in the molecule.

16. The silver halide color photographic material according to claim 12, wherein the mean grain size of the silver halide grains in each of the at least one yellow-coloring photosensitive silver halide emulsion layer is at most 0.48 μm.

17. The silver halide color photographic material according to claim 12, wherein the total amount of silver in the at least one yellow-coloring photosensitive silver halide emulsion layer is from 0.1 g/m$^2$ to 0.19 g/m$^2$.

18. The silver halide color photographic material according to claim 12, wherein the iridium metal complex has at least one organic ligand.

19. An image forming method including imagewise exposing a silver halide color photographic material, color developing the imagewise exposed silver halide color photographic material and drying the developed silver halide color photographic material, wherein the silver halide color photographic material is a silver halide color photographic material according to claim 12 and the total processing time from the start of the color developing to the end of the drying is at most 90 seconds.

20. The image forming method according to claim 19, wherein the color developing is conducted for 20 seconds or less.

21. A silver halide color photographic material comprising at least one yellow-coloring photosensitive silver halide emulsion layer, at least one magenta-coloring photosensitive silver halide emulsion layer, at least one cyan-coloring photosensitive silver halide emulsion layer, and at least one non-photosensitive non-coloring hydrophilic colloid layer on a reflective support;

wherein the silver halide grains in each of the at least one yellow-coloring photosensitive silver halide emulsion layer include an iridium metal complex and at least one of metal complexes including at least one of Cr, Mo, Re, Fe, Ru, Os, Co, Rh, Pd and Pt, and wherein the mean grain size of the silver halide grains in each of the at least one yellow-coloring photosensitive silver halide emulsion layer in the material is at most 0.55 μm; and the yellow reflection density of the material satisfies the relation of the following formula, after being exposed to light to which the at least one yellow-coloring photosensitive silver halide emulsion layer is sensitive, and then color developed:

$$DS_{0.1}-DS_{0.0001}\leq 0.3$$

wherein $DS_{0.1}$ indicates the yellow reflection density of the material exposed to light to which the at least one yellow-coloring photosensitive silver halide emulsion is sensitive and of which an intensity of illumination for exposure is larger by 0.5 log E than an intensity of illumination necessary for obtaining an yellow reflection density of 0.7 when the material is exposed to the light for a period of 0.1 seconds and then color developed; and $DS_{0.0001}$ indicates the yellow reflection density of the material exposed to light, to which the at least one yellow-coloring photosensitive silver halide emulsion is sensitive and of which the intensity of illumination for exposure is larger by 0.5 log E than an intensity of illumination necessary for obtaining an yellow reflection density of 0.7 when the material is exposed to the light for a period of 0.0001 seconds and then color developed.

22. The silver halide color photographic material according to claim 21, wherein the mean grain size of the silver halide grains in each of the at least one yellow-coloring photosensitive silver halide emulsion layer is at most 0.48 μm.

23. The silver halide color photographic material according to claim 21, wherein the total amount of silver in the at least one yellow-coloring photosensitive silver halide emulsion layer is from 0.1 g/m$^2$ to 0.23 g/m$^2$.

24. The silver halide color photographic material according to claim 21, wherein the total amount of silver in the at least one yellow-coloring photosensitive silver halide emulsion layer is from 0.1 g/m$^2$ to 0.19 g/m$^2$.

25. The silver halide color photographic material according to claim 21, wherein the total amount of silver in the at least one yellow-coloring photosensitive silver halide emulsion layer is from 0.1 g/m$^2$ to 0.18 g/m$^2$.

26. The silver halide color photographic material according to claim 21, wherein, after being color developed, the reflection density A(λ) at a wavelength of λ nm in the non-exposed portion is at most 0.07 at 450 nm, at most 0.09 at 550 nm and at most 0.07 at 650 nm.

27. The silver halide color photographic material according to claim 26, wherein, after being color developed, the reflection density A(λ) at a wavelength of λ nm in the non-exposed portion is at most 0.06 at 450 nm, at most 0.07 at 550 nm and at most 0.05 at 650 nm.

28. The silver halide color photographic material according to claim 26, wherein the chromaticity in a non-exposed portion of the material satisfies, after being color developed, the following condition (A):

$$91 \leqq L^* \leqq 96,\ 0.3 \leqq a^* \leqq 1.6,\ -8.0 \leqq b^* \leqq -4.8. \quad \text{Condition (A)}$$

29. The silver halide color photographic material according to claim 21, wherein, after being color developed, the ratio of the reflection density A(λ) at a wavelength of λ nm in the non-exposed portion satisfies the following conditions (I) and (II):

$$1.0 \leqq A(550)/A(450) \leqq 1.4 \quad \text{(I)}$$

$$0.6 \leqq A(650)/A(450) \leqq 1.2. \quad \text{(II)}$$

30. The silver halide color photographic material according to claim 21, wherein the chromaticity in a non-exposed portion of the material satisfies, after being color developed, the following condition (A):

$$91 \leqq L^* \leqq 96,\ 0.3 \leqq a^* \leqq 1.6,\ -8.0 \leqq b^* \leqq -4.8. \quad \text{Condition (A)}$$

31. The silver halide color photographic material according to claim 30, wherein the chromaticity in a non-exposed portion of the material satisfies, after being color developed, the following condition (B):

$$93 \leqq L^* \leqq 96,\ 0.3 \leqq a^* \leqq 1.6,\ -8.0 \leqq b^* \leqq -4.8. \quad \text{Condition (B)}$$

32. The silver halide color photographic material according to claim 21, wherein the yellow reflection density of the material satisfies the relation of the following formula, after being exposed to light to which the at least one yellow-coloring photosensitive silver halide emulsion layer is sensitive, and then color developed:

$$DS_{0.1} - DS_{0.0001} \leqq 0.15.$$

33. The silver halide color photographic material according to claim 21, wherein the yellow reflection density of the material satisfies the relation of the following formula, after being exposed to light to which the at least one yellow-coloring photosensitive silver halide emulsion layer is sensitive, and then color developed:

$$DS_{0.1} - DS_{0.0001} \leqq 0.$$

34. The silver halide color photographic material according to claim 21, wherein the silver halide grains in each of the at least one yellow-coloring photosensitive silver halide emulsion layer have a silver chloride content of at least 90 mol % and a silver iodide content of from 0.01 to 0.50 mol %.

35. The silver halide color photographic material according to claim 34, wherein the silver halide grains in each of the at least one yellow-coloring photosensitive silver halide emulsion layer further have a silver bromide content of from 0.2 to 5 mol %.

36. The silver halide color photographic material according to claim 34, wherein an iodide ion source is added to an outer site of the silver halide grains by at least 50% of the grain volume.

37. The silver halide color photographic material according to claim 21, wherein the silver halide grains in each of the at least one yellow-coloring photosensitive silver halide emulsion layer have a silver chloride content of at least 90 mol % and a silver bromide content of from 0.2 to 5 mol %.

38. The silver halide color photographic material according to claim 34, wherein an iodide ion concentration maximum is in the surface of the silver halide grains and an iodide ion concentration decreases toward the inside of the silver halide grains.

39. The silver halide color photographic material according to claim 21, wherein the total amount of gelatin in the material is 3 to 5 g/m$^2$.

40. The silver halide color photographic material according to claim 21, wherein the iridium metal complex has at least one organic ligand.

41. An image forming method including imagewise exposing a silver halide color photographic material, color developing the imagewise exposed silver halide color photographic material and drying the developed silver halide color photographic material, wherein the silver halide color photographic material is a silver halide color photographic material according to claim 21 and the total processing time from the start of the color developing to the end of the drying is at most 90 seconds.

42. The image forming method according to claim 41, wherein the color developing is conducted for 20 seconds or less.

43. A silver halide color photographic material comprising at least one yellow-coloring photosensitive silver halide emulsion layer, at least one magenta-coloring photosensitive silver halide emulsion layer, at least one cyan-coloring photosensitive silver halide emulsion layer, and at least one non-photosensitive non-coloring hydrophilic colloid layer on a reflective support, wherein: after being color developed, the reflection density A(λ) at a wavelength of λ nm in a non-exposed portion of the material is at most 0.07 at 450 nm, at most 0.09 at 550 nm and at most 0.07 at 650 nm;

the silver halide grains in each of the at least one yellow-coloring photosensitive silver halide emulsion layer include an iridium metal complex and at least one of metal complexes including at least one of Cr, Mo, Re, Fe, Ru, Os, Co, Rh, Pd and Pt, the mean grain size of the silver halide grains in each of the at least one yellow-coloring photosensitive silver halide emulsion layer in the material is at most 0.55 μm;

the total amount of silver in the at least one yellow-coloring photosensitive silver halide emulsion layer is 0.1 to 0.20 g/m$^{2;}$ and the material is to be developed in a developing process where developing is conducted with a color developer and desilvered in a desilvering process where desilvering is conducted with a bleaching solution or a blix solution so that no process is interposed between the developing process and the desilvering process.

44. The silver halide color photographic material according to claim 43, wherein the mean grain size of the silver halide grains in each of the at least one yellow-coloring photosensitive silver halide emulsion layer in the material is at most 0.48 μm.

45. The silver halide color photographic material according to claim 43, wherein the iridium metal complex has at least one organic ligand.

46. A silver halide color photographic material comprising at least one yellow-coloring photosensitive silver halide emulsion layer, at least one magenta-coloring photosensitive silver halide emulsion layer, at least one cyan-coloring photosensitive silver halide emulsion layer, and at least one non-photosensitive non-coloring hydrophilic colloid layer on a reflective support, wherein the silver halide grains in each of the at least one yellow-coloring photosensitive silver halide emulsion layer include an iridium metal complex and at least one of metal complexes including at least one of Cr, Mo, Re, Fe, Ru, Os, Co, Rh, Pd and Pt, and wherein the chromaticity in a non-exposed portion of the material, after being color developed, satisfies the following condition (A); the mean grain size of the silver halide grains in each of the at least one yellow-coloring photosensitive silver halide emulsion layer in the material is at most 0.55 μm; the total amount of silver in the at least one yellow-coloring photosensitive silver halide emulsion layer is 0.1 to 0.20 $g/m^2$; and the material is to be developed in a developing process where developing is conducted with a color developer and desilvered in a desilvering process where desilvering is conducted with a bleaching solution or a blix solution so that no process is interposed between the developing process and the desilvering process;

$$91 \leqq L^* \leqq 96,\ 0.3 \leqq a^* \leqq 1.6,\ -8.0 \leqq b^* \leqq -4.8. \qquad \text{Condition (A)}$$

47. The silver halide color photographic material according to claim 46, wherein the mean grain size of the silver halide grains in each of the at least one yellow-coloring photosensitive silver halide emulsion layer in the material is at most 0.48 μm.

48. The silver halide color photographic material according to claim 46, wherein the iridium metal complex has at least one organic ligand.

49. A silver halide color photographic material comprising at least one yellow-coloring photosensitive silver halide emulsion layer, at least one magenta-coloring photosensitive silver halide emulsion layer, at least one cyan-coloring photosensitive silver halide, and at least one non-photosensitive non-coloring hydrophilic colloid layer on a reflective support, wherein the silver halide grains in each of the at least one yellow-coloring photosensitive silver halide emulsion layer include an iridium metal complex and at least one of metal complexes including at least one of Cr, Mo, Re, Fe, Ru, Os, Co, Rh, Pd and Pt, wherein the mean grain size of the silver halide grains in each of the at least one yellow-coloring photosensitive silver halide emulsion layer in the material is at most 0.55 μm; the material is to be developed in a developing process where developing is conducted with a color developer and desilvered in a desilvering process where desilvering is conducted with a bleaching solution or a blix solution so that no process is interposed between the developing process and the desilvering process; and the yellow reflection density of the material satisfies the relation of the following formula, after being exposed to light to which the at least one yellow-coloring photosensitive silver halide emulsion layer is sensitive, and then color developed:

$$DS_{0.1} - DS_{0.0001} \leqq 0.3$$

wherein $DS_{0.1}$ indicates the yellow reflection density of the material exposed to light to which the at least one yellow-coloring photosensitive silver halide emulsion is sensitive and of which an intensity of illumination for exposure is larger by 0.5 log E than an intensity of illumination necessary for obtaining a yellow reflection density of 0.7 when the material is exposed to the light for a period of 0.1 seconds and then color developed, and $DS_{0.0001}$ indicates the yellow reflection density of the material exposed to light, to which the at least one yellow-coloring photosensitive silver halide emulsion is sensitive and of which the intensity of illumination for exposure is larger by 0.5 log E than an intensity of illumination necessary for obtaining a yellow reflection density of 0.7 when the material is exposed to the light for a period of 0.0001 seconds and then color developed.

50. The silver halide color photographic material according to claim 49, wherein the mean grain size of the silver halide grains in each of the at least one yellow-coloring photosensitive silver halide emulsion layer in the material is at most 0.48 μm.

51. The silver halide color photographic material according to claim 49, wherein the iridium metal complex has at least one organic ligand.

* * * * *